US006720134B2

(12) United States Patent
Miyamoto et al.

(10) Patent No.: US 6,720,134 B2
(45) Date of Patent: Apr. 13, 2004

(54) SILVER HALIDE PHOTOGRAPHIC EMULSION AND SILVER HALIDE PHOTOGRAPHIC LIGHTSENSITIVE MATERIAL USING THE SAME

(75) Inventors: Yasushi Miyamoto, Minami-Ashigara (JP); Toshihiro Nishikawa, Minami-Ashigara (JP); Nobuyuki Haraguchi, Minami-Ashigara (JP); Hideo Ikeda, Minami-Ashigara (JP); Takayoshi Mori, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/043,094

(22) Filed: Jan. 14, 2002

(65) Prior Publication Data

US 2003/0068592 A1 Apr. 10, 2003

(30) Foreign Application Priority Data

| | | |
|---|---|---|
| Jan. 15, 2001 | (JP) | 2001-006756 |
| Apr. 26, 2001 | (JP) | 2001-130131 |
| Dec. 12, 2001 | (JP) | 2001-378886 |

(51) Int. Cl.[7] ..... G03C 1/005; G03C 1/494

(52) U.S. Cl. ..... 430/567; 430/607; 430/611; 430/551; 430/627; 430/630; 430/631; 430/634; 430/570; 430/581; 430/582; 430/583; 430/584; 430/585

(58) Field of Search ..... 430/567, 607, 430/611, 551, 627, 630, 631, 634, 570, 581, 582, 583, 584, 585

(56) References Cited

U.S. PATENT DOCUMENTS

| | | | | |
|---|---|---|---|---|
| 4,435,501 A | | 3/1984 | Maskasky | |
| 5,494,789 A | | 2/1996 | Daubendiek et al. | |
| 5,614,359 A | * | 3/1997 | Eshelman et al. | 430/567 |
| 5,830,633 A | | 11/1998 | Matsumoto | |
| 5,935,774 A | * | 8/1999 | Bringley et al. | 430/567 |

* cited by examiner

*Primary Examiner*—Geraldine Letscher
(74) *Attorney, Agent, or Firm*—Sughrue Mion, PLLC

(57) ABSTRACT

A silver halide photographic emulsion comprising grains, wherein 70% or more of the total projected area of the grains is occupied by silver halide grains each meeting requirements (a) to (d) below (a) the grain is composed of a tabular silver halide host grain having two mutually parallel main planes and aspect ratio of 2 or more, and a silver halide protrusion portion epitaxially junctioned on the surface of the host grain;

(b) the silver bromide contents of both the host grain and the protrusion portion are 70 mol % or more;

(c) the percentage of the silver amount in the protrusion is 12% or less of the silver amount in the host grain; and (d) the grain has a shallow electron-trapping zone.

20 Claims, No Drawings

SILVER HALIDE PHOTOGRAPHIC EMULSION AND SILVER HALIDE PHOTOGRAPHIC LIGHTSENSITIVE MATERIAL USING THE SAME

CROSS-REFERENCE TO RELATED APPLICATIONS

This application is based upon and claims the benefit of priority from the prior Japanese Patent Applications No. 2001-006756, filed Jan. 15, 2001; No. 2001-130131, filed Apr. 26, 2001; and 2001-378886, filed Dec. 12, 2001, the entire contents of three of which are incorporated herein by reference.

BACKGROUND OF THE INVENTION

The present invention relates to a silver halide photographic emulsion having a high sensitivity, excellent storability, and excellent reciprocity law property at low illumination. More specifically, the present invention relates to a silver halide photographic emulsion having excellent stability, which change little in its performance during the time from dissolution to coating of the emulsion, and further having excellent pressure resistance.

The use of tabular silver halide grains (to be referred to as "tabular grains" hereinafter) to obtain a high-speed silver halide photographic lightsensitive material is well known to those skilled in the art. As methods of sensitizing these tabular grains, methods of sensitizing by using epitaxial junction are disclosed in Jpn. Pat. Appln. KOKAI Publication No. (hereinafter referred to as JP-A-) 59-133540. Also, applications to thinner tabular grains or to tabular grains having larger equivalent-circle diameters are disclosed in JP-A's-8-69069, 8-101472, 8-101474, 8-101475, 8-171162, 8-171163, 8-101473, 8-101476, 9-211762, and 9-211763, and U.S. Pat. Nos. 5,612,176, 5,614,359, 5,629,144, 5,631,126, 5,691,127, and 5,726,007. An epitaxial sensitization method disclosed mainly in these patent applications and patents refers to a method of depositing silver halide having a relatively high silver chloride content on a host tabular grain having a relatively high silver bromide content by epitaxial junction.

However, an epitaxial emulsion prepared in such a manner is basically unstable, and thus unsuitable to obtain a stable performance of a photographic lightsensitive material. The reason is that the solubility product of silver chloride is larger than the solubility product of silver bromide, so silver chloride readily undergoes halogen conversion. Therefore, a sensitive material using the epitaxial emulsion lowers its sensitivity and increases fog during storage.

On the other hand, a technique of depositing silver halide having a relatively high silver bromide content to a host tabular grain having a relatively high silver bromide content by epitaxial junction is disclosed in JP-A-58-108526 and JP-A-5-232610.However, the research of the present invention reveals that these emulsions are insufficient in sensitivity and have a problem of considerable reduction in sensitivity in the case of performing long-exposure at low illumination (low intensity reciprocity law failure is large). In order to provide a photographic material having a sufficient sensitivity even at a photographic scene of such relatively dark conditions that the shutter speed cannot be made fast, a silver halide emulsion having a small reciprocity law failure at low illumination is strongly desired.

Meanwhile, the silver halide emulsion is generally used being coated on a support. In order to provide a lightsensitive material having a stable performance, a silver halide emulsion which changes little in its performance during the time from dissolution to coating of the emulsion, is strongly desired. However, with respect to the stability in a dissolved state, the conventional epitaxial emulsion was unstable and was required to be improved.

In general, various pressures are applied to a photographic lightsensitive material coated with a silver halide emulsion. For example, a 35-mm color negative film or a color reversal film is caught in a film cartridge, folded when it is loaded in a camera, and stretched during a frame advance. A silver halide emulsion which provides a lightsensitive material having excellent resistance to such external pressures is strongly needed. However, it becomes clear that the level of the pressure resistance of the conventional epitaxial emulsion is highly unsatisfactory.

Further, in order to obtain a silver halide photographic lightsensitive material having a high sensitivity, it is suitable to use a silver halide emulsion comprising tabular silver halide grains with a large ratio of surface area to volume. This increases the adsorption of the sensitizing dyes on the surfaces of the grains, and as a result, a higher spectral sensitization can be obtained.

However, the problem of a rise in residual color after processing occurs, due to this increased adsorption of sensitizing dyes. It was found that, in this invention, by using sensitizing dyes having a high sensitivity and less residual color, described in JP-A-2001-75224, for an epitaxial emulsion, residual color after processing can be improved, while maintaining high spectral sensitization.

BRIEF SUMMARY OF THE INVENTION

It is an object of the present invention to provide a silver halide photographic emulsion having a high sensitivity, high storage stability, and excellent reciprocity law property at low illumination. Furthermore, it is another object of the present invention to provide the silver halide photographic emulsion which is also excellent in both stability in the dissolved state and pressure resistance.

The above objects are achieved by means (1) to (21) below.

(1) A silver halide photographic emulsion comprising grains, wherein 70% or more of the total projected area of the grains is occupied by silver halide grains each meeting requirements (a) to (d) below:
  (a) the grain is composed of a tabular silver halide host grain having two mutually parallel main planes and aspect ratio of 2 or more, and a silver halide protrusion portion epitaxially joined on the surface of the host grain;
  (b) the silver bromide contents of both the host grain and the protrusion portion are 70 mol % or more;
  (c) the percentage of the silver amount in the protrusion is 12% or less of the silver amount in the host grain; and
  (d) the grain has a shallow electron-trapping zone.

(2) The silver halide photographic emulsion described in item (1) above, wherein 70% or more of the total projected area of the grains is occupied by silver halide grains each further meeting the following requirement (e) in addition to the above requirements (a) to (d):
  (e) at least one main plane of the host grain has at least one apex, and the protrusion portion is present on each apex of the main plane.

(3) The silver halide photographic emulsion described in item (1) above, wherein 70% or more of the total projected area of the grains is occupied by silver halide grains each further meeting the following requirement (f) in addition to the above requirements (a) to (d):

(f) the silver iodide content of each silver halide grain is in a range of 0.6I to 1.4I mol %, wherein I (mol %) is the average silver iodide content of all the grains.

(4) The silver halide photographic emulsion described in item (2) above, wherein 70% or more of the total projected area of the grains is occupied by silver halide grains each further meeting the following requirement (f) in addition to the above requirements (a) to (e):

(f) the silver iodide content of each silver halide grain is in a range of 0.6I to 1.4I mol %, wherein I (mol %) is the average silver iodide content of all the grains.

(5) The silver halide photographic emulsion described in item (1) above, wherein 70% or more of the total projected area of the grains is occupied by silver halide grains each further meeting the following requirement (g) in addition to the above requirements (a) to (d) β(g) the grain has a hole-trapping zone.

(6) The silver halide photographic emulsion described in item (2) above, wherein 70% or more of the total projected area of the grains is occupied by silver halide grains each further meeting the following requirement (g) in addition to the above requirements (a) to (e):

(g) the grain has a hole-trapping zone.

(7) The silver halide photographic emulsion described in item (3) above, wherein 70% or more of the total projected area of the grains is occupied by silver halide grains each further meeting the following requirement (g) in addition to the above requirements (a) to (d) and (f):

(g) the grain has a hole-trapping zone.

(8) The silver halide photographic emulsion described in item (1) above, wherein 70% or more of the total projected area of the grains is occupied by silver halide grains each further meeting the following requirement (h) in addition to the above requirements (a) to (d):

(h) the protrusion portion contains a pseudo halide.

(9) The silver halide photographic emulsion described in item (1) above, wherein 70% or more of the total projected area of the grains is occupied by silver halide grains each further meeting the following requirement (i) in addition to the above requirements (a) to (d):

(i) the average silver iodide content in an outer-shell-8%-region (in relation to the silver amount of the host grain) of the host grain is (I+5) mol % or more, wherein I mol % is the average silver iodide content of all the grains.

(10) The silver halide photographic emulsion described in item (1) above, wherein 70% or more of the total projected area of the grains is occupied by silver halide grains each further meeting the following requirement (j) in addition to the above requirements (a) to (d):

(j) the aspect ratio of the host grain is 15 or more.

(11) The silver halide photographic emulsion described in item (1) above, wherein 70% or more of the total projected area of the grains is occupied by silver halide grains each further meeting the following requirement (k) in addition to the above requirements (a) to (d):

(k) the emulsion has a full development sensitivity that is higher than a surface development sensitivity thereof.

(12) The silver halide photographic emulsion described in item (1) above, wherein at least one of the compounds represented by the following formula (DYE-I) is contained:

Formula (DYE-I)

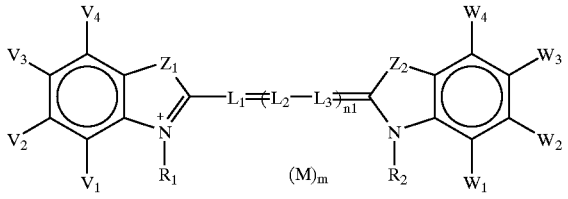

In the formula (DYE-I), $Z_1$ and $Z_2$ each independently represent an oxygen atom, a sulfur atom, a selenium atom, a tellurium atom, or a >NR group. R represents an alkyl group, an aryl group, or a heterocyclic group. Each of $L_1$, $L_2$ and $L_3$ independently represents a methine group, and n1 is 0, 1, 2 or 3. Each of $V_1$, $V_2$, $V_3$, $V_4$, $W_1$, $W_2$, $W_3$, and $W_4$ independently represents a hydrogen atom or a substituent. Two substituents may be bonded to each other to form a ring. If the sum of the π value of the substituents $V_1$ to $V_4$ is regarded as πV, and the sum of the π value of the substituents $W_1$ to $W_4$ is regarded as πW, either of the πV or πW is 0.70 or less. M represents a charge-balanced counter ion, and m represents a number needed for neutralizing the charge of a molecule. $R_1$ represents an alkyl group, an aryl group, or a heterocyclic group. $R_2$ represents a substituent represented by any one of the following formulae:

$—(La)_{ka}CONHSO_2Ra;$ $—(Lb)_{kb}SO_2NHCORb;$ $—(Lc)_{kc}CONHCORc;$ $—(Ld)_{kd}SO_2NHSO_2Rd;$ and $—(Le)_{ke}COOH$ In the formulae, Ra, Rb, Rc and Rd independently represent an alkyl group, an aryl group, a heterocyclic group, an alkoxy group, an aryloxy group, heterocyclyloxy group, or an amino group. La, Lb, Lc, Ld and Le independently represent a methylene group, and ka, kb, kc, kd and ke independently represent integers of 1 or more.

(13) The silver halide photographic emulsion described in item (12) above, wherein calcium is contained.

(14) The silver halide photographic emulsion described in item (1) above, wherein a polyvinylpyrrolidone-based compound having a repeating unit represented by the following formula (PP-I) is contained:

Formula (PP-I)

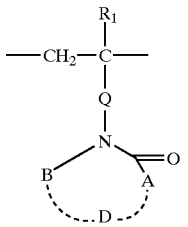

$R_1$ represents a hydrogen atom or an alkyl group. Q represents a single bond, $—COOR_2—$, or $—CONHR_2—$. A represents a single bond or an oxygen atom. B represents a single bond or —CO—. D represents $—(CH{=}CH)_2—$, $—(CH_2)_n—$ (provided that n is an integer of 3 to 5 if both A and B are a single bond, n is 2 or 3 if A is an oxygen atom and B is a single bond, and n is an integer of 2 to 4 if A is a single bond and B is —CO—), or a phenylene group (if A is a single bond and B is —CO—). $R_2$ represents a substituted or unsubstituted divalent hydrocarbon group having 2 to 8 carbon atoms.

(15) The silver halide photographic emulsion described in item (1) above, wherein a compound represented by the following formula (PP-II) is contained:

Formula (PP-II)

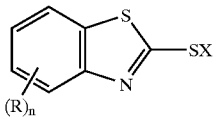

In the formula, X represents hydrogen or an alkali metal atom. R represents a hydrogen atom, a halogen atom, or an alkyl group having 1 to 5 carbon atoms, and n represents an integer of 1 to 4.

(16) The silver halide photographic emulsion described in item (1) above, wherein at least one compound selected from the group consisting of the compounds represented by the following formula (PP-III) which is capable of selectively adsorbing to the (100) plane of the silver halide grain, and a spectral sensitizing dye which is capable of selectively adsorbing to the (100) plane of the silver halide grain, is contained:

Formula (PP-III)

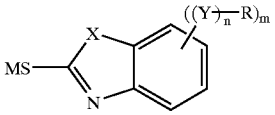

In the formula, R represents an alkyl group, alkenyl group, alkynyl group, aryl group, or aralkyl group, each of which may be substituted or unsubstituted. Y represents —O—, —S—, —$NR_1$—, —$NR_2CO$—, —$CONR_3$—, —$NR_4SO_2$—, —$SO_2NR_5$—, —COO—, —OCO—, —CO—, —$SO_2$—, —$NR_6CONR_7$—, —$NR_8CSNR_9$—, or —$NR_{10}COO$—. $R_1$, $R_2$, $R_3$, $R_4$, $R_5$, $R_6$, $R_7$, $R_8$, $R_9$ and $R_{10}$ independently represent a hydrogen atom, or an alkyl group, alkenyl group, alkynyl group, aryl group, or aralkyl group, each of which may be substituted or unsubstituted. n is 0 or 1, and m is an integer from 1 to 4. X represents —O—, —S—, or —NR'—, and R' represents a hydrogen atom, or an alkyl group or alkenyl group, which may be substituted or unsubstituted. M represents a hydrogen atom, an alkali metal atom, an alkaline-earth metal atom, an ammonium group, or a group capable of cleaving under an alkali condition. The sum of the carbon atoms of $—((Y)_n—R)_m$ is 1 or more and 30 or less.

(17) The silver halide photographic emulsion described in item (1) above, wherein at least one kind of polymer having a repeating unit represented by the following formula (PP-IV) is contained:

Formula (PP-IV)

$$—(R—O)_n—$$

In the formula, R represents an alkylene group having 2 to 10 carbon atoms, and n represents the average number of the repeating units, and is from 4 to 200.

(18) The silver halide photographic emulsion described in item (17) above, wherein the polymer having a repeating unit represented by the formula (PP-IV) is a polymer selected from a group consisting of vinyl polymers obtained from at least one kind of monomer component of the following formula (PP-V), and polyurethane of the following formula (PP-VI):

Formula (PP-V)

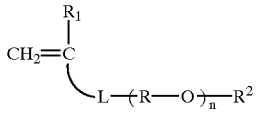

Formula (PP-VI)

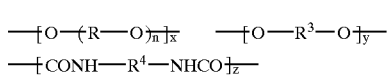

In the formulae, R represents an alkylene group having 2 to 10 carbon atoms. n represents the average number of repeating units, and is from 4 to 200. $R^1$ represents a hydrogen atom, or a lower alkyl group, and $R^2$ represents a monovalent substituent. L represents a divalent linkage group. $R^3$ and $R^4$ independently represent an alkylene group having 1 to 20 carbon atoms, a phenylene group having 6 to 20 carbon atoms, or an aralkylene group having 7 to 20 carbon atoms. x, y and z represent a weight percentage of each component, and x is 1 to 70, y is 1 to 70, and z is 20 to 70, where x+y+z=100.

(19) The silver halide photographic emulsion described in item (17) above, wherein the polymer having a repeating unit represented by the formula (PP-IV) contains a block polymer components of polyalkyleneoxide represented by the following formulae (PP-VII) and (PP-VIII):

Formula (PP-VII)

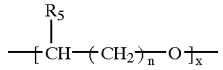

Formula (PP-VIII)

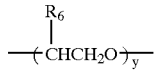

In the formulae, $R^5$ represents a hydrogen atom, an alkyl group having 1 to 10 carbon atoms, or an aryl group having 6 to 10 carbon atoms, and n represents an integer of 1 to 10, provided that when n=1, $R^5$ will not be a hydrogen atom. $R^6$ represents a hydrogen atom, or a lower alkyl group having 4 or less carbon atoms substituted by a hydrophilic group. x and y independently represent the repeating number (number average polymerization degree) of each unit.

(20) The silver halide photographic emulsion described in item (12) above, wherein 70% or more of the total projected area of the grains is occupied by silver halide grains further meeting the following requirements (h) to (j) in addition to the above requirements (a) to (d):

(h) the protrusion portion contains a pseudo halide;

(i) the average silver iodide content in an outer-shell-8%-region (in relation to the silver amount of the host grain) of the host grain is (I+5) mol % or more, wherein I (mol %) is the average silver iodide content of all the grains;

(j) the aspect ratio of the host grain is 15 or more; and (k) the emulsion has a full development sensitivity that is higher than a surface development sensitivity thereof.

(21) A silver halide photographic lightsensitive material comprising a lightsensitive layer on a support, wherein the lightsensitive layer contains the silver halide photographic emulsion described in any one of items (1) to (20) above.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

The present invention will be described in more detail below.

One of the characteristics of the silver halide emulsion of the present invention is that 70% or more of the total projected area of the grains is occupied by silver halide grains each of which is composed of a tabular silver halide host grain and a protruded portion of silver halide epitaxially joined or epitaxially junctioned on the surface of the host grain. The tabular silver halide host grain (hereinafter referred to as "a host tabular grain" or "a host grain") has two mutually parallel main planes and aspect ratio of 2 or more. Preferably, 80% or more of the total projected area is occupied by the aforementioned silver halide grains, and further preferably, 90% or more of the total projected area is occupied by the aforementioned silver halide grain. The protruded portion (hereinafter referred to as "a silver halide protrusion" or "a protrusion") means the protruded or bulged portion from the host grain, which may be recognized with electron microscopic observation.

In the present invention, the host tabular grain comprises two mutually parallel main planes, and side faces for connecting these main planes. The main plane may have any polygonal shape bordered by lines, a shape bordered by indefinite curves, such as a circle or an oval, or a shape bordered by the combination of lines and curves. It is preferable that the main plane has at least one apex. Further, any of a triangular shape having three apexes, a tetragonal shape having four apexes, a pentagonal shape having five apexes, and a hexagonal shape having six apexes, or the combination thereof is more preferable. Herein the apex means a non-rounded corner formed with two neighboring sides of the main plane. When the corner is rounded, the apex means a point that bisects the length of the rounded carve portion.

In the present invention, the main planes of the host tabular grain may have any kind of crystal structure. That is, the crystal structure of the main plane may be a (111) plane, (100) plane, (110) plane, or a higher-order plane. The most preferable structure is a tabular grain whose main planes are the (111) planes or (100) planes. In the case of a tabular grain having (111) planes as main planes, the embodiment wherein 70% or more of the total projected area of the grains is occupied by the grains, whose main planes have a hexagonal shape with six apexes, is preferable. In the case of a tabular grain having (100) planes as main planes, the embodiment wherein 70% or more of the total projected area of the grains is occupied by the grains, whose main planes have a tetragonal shape having four apexes, is preferable.

In the present invention, one of the characteristics of the host tabular grain is that the aspect ratio, obtained by dividing the equivalent-circle diameter by the grain thickness, is 2 or more. The aspect ratio is preferably 5 or more and 200 or less, more preferably, 8 or more and 200 or less, and most preferably, 15 or more and 200 or less. The equivalent-circle diameter of a grain refers to the diameter of a circle having the area equal to the projected area of the main plane.

The equivalent-circle diameter of a host tabular grain is obtained by taking a transmission electron micrograph using, e.g., the replica method, obtaining the projected area value of each grain by correcting the magnification for photography, and converting the value into equivalent-circle diameter. When the thickness of a grain cannot be simply calculated from the length of the shadow of a replica owing to epitaxial deposition, the thickness can be calculated by measuring the length of the shadow of a replica before epitaxial deposition. Alternatively, even after epitaxial deposition, the thickness can be readily obtained by cutting a sample coated with a emulsion and taking an electron micrograph of the section of the sample.

In the present invention, the host tabular grains preferably have the equivalent-circle diameters of 0.5 to 10.0 $\mu$m, and more preferably, 0.7 to 10.0 $\mu$m, and the thickness of 0.02 to 0.5 $\mu$m, more preferably, 0.02 to 0.2 $\mu$m, and most preferably, 0.02 to 0.1 $\mu$m.

In the present invention, the host tabular grains preferably have the inter-grain variation coefficient of the equivalent-circle diameters of 40% or less, more preferably, 30% or less, and most preferably, 25% or less. The inter-grain variation coefficient of equivalent-circle diameters is the value obtained by dividing the standard deviation of the distribution of the equivalent-circle diameters of individual silver halide grains by their average equivalent-circle diameter, and multiply by 100.

In the present invention, the silver halide protrusion is formed by epitaxial junction in any location on the surface of the host tabular grain. The protrusion is preferably formed on the main planes, apex portions, or sides other than the apex portions of the host tabular grain, and most preferably, on apex portions. The apex portion refers to the area of the segment of a circle, centered on the tip of an apex, having a radius equal to the length of one third the length of the shorter of the two sides adjacent the apex, as viewed perpendicularly to the grain's main plane. It is more preferable that the silver halide photographic emulsion of the invention is occupied by silver halide grains each having a protrusion on each of all the apex portions on the main planes of the host tabular grains, in an amount of 70% or more of the total projected area of the grains. The amount occupied by such silver halide grains is preferably 80% or more, and more preferably 90% or more.

It is one of the characteristics that the percentage of the silver amount in the silver halide protrusion portion of the present invention is 12% or less of the silver amount in the host tabular grain. The percentage of the silver amount is more preferably 0.5% or more and 10% or less, and most preferably 1% or more and 8% or less. Too low a percentage of the silver amount deteriorates the repetition reproducibility of the epitaxial formation. Too high a percentage causes sensitivity lowering or deterioration of the graininess. In addition, the percentage of the occupied by the silver halide protrusion portion is preferably 50% or less of the host tabular grain surface, and more preferably, 20% or less.

The silver halide protrusion portion of the present invention preferably contains a pseudo halide. The term "pseudo halide" refers to those known as having similar properties to those of a halide. That is, as described in JP-A-7-72569, the disclosure of which is incorporated herein by reference, the pseudo halides are a group of compound capable of providing a sufficiently electronegative monovalent anion group, indicating at least a positive Hammett sigma value which is the same as that of a halide, such as $CN^-$, $OCN^-$, $SCN^-$, $SeCN^-$, $TeCN^-$, $N_3^-$, $C(CN)_3^-$, and $CH^-$, for example. The pseudo halide content of the protrusion portion is preferably 0.01 to 10 mol % in relation to the silver amount of the protrusion portion, and more preferably, 0.1 to 5 mol %.

In the silver halide grain of the present invention, the halogen composition of both the host grain and the protrusion portion is pure silver bromide, or silver iodobromide, silver chlorobromide, or silver chloroiodobromide having a silver bromide content of 70 mol % or more. If the content is less than 70 mol %, fog increase after storage will heighten, which is detrimental. The silver bromide content is more preferably 80 mol % or more, and most preferably, 90 mol % or more.

In the silver halide grain of the present invention, the average silver iodide content of all the grains is preferably 20 mol % or less, more preferably, 15 mol % or less, and most preferably, 10 mol % or less. If the silver iodide content exceeds 20 mol %, a sufficient sensitivity cannot be obtained. An embodiment wherein the average silver iodide content of the protrusion portion is lower than that of an outer-shell-8%-region (in relation to the silver amount of the host grain) of the host grain. The difference of the iodide contents is preferably 5 mol % or more. The outer-shell-8%-region of the host grain herein means a layered region spread from the surface toward the center of the host grain, and the silver amount of the layered region accounts for 8% with respect to the total silver amount of the host grain.

In the silver halide grain of the present invention, the silver chloride content of both the host grain and the protrusion portion is preferably 8 mol % or less, more preferably, 4% or less, and most preferably, 1 mol % or less.

In the silver halide grain of the present invention, the inter-grain distribution of the silver iodide content is preferably monodisperse. More specifically, an embodiment wherein 70% or more of the total projected area of the grains is occupied by the silver halide grains having a silver iodide content within the range of 0.6I to 1.4I, if the average silver iodide content of all the grains is regarded as I (mol %), is preferable. An embodiment wherein 70% or more of the total projected area of the grains is occupied by the silver halide grains having a silver iodide content within the range of 0.7I to 1.3I is more preferable.

In the silver halide grain of the present invention, the host grain or protrusion portion, or both the host grain and protrusion portion may contain, as a part of silver halide, a silver salt other than silver chloride, silver bromide, or silver iodide, such as silver rhodanide, silver selenocyanate, silver tellurocyanate, silver sulfide, silver selenide, silver telluride, silver carbonate, silver phosphate, organic silver salt, etc. These may be contained in the emulsion of the present invention, as another grain.

The host grain used in the present invention may have a multiple structure of a double structure or more concerning the intra-grain halogen composition distribution. The host grain may have a quintuple structure, for example. The structure refers to a structure concerning the intra-grain silver iodide distribution, and it is indicated that the difference in silver iodide content between each structure is of 1 mol % or more. This intra-grain silver iodide distribution structure can be basically obtained by calculations from the prescribed value in the grain preparation step. In the interface between layers of the structure, the silver iodide content can change either abruptly or moderately. The EPMA (Electron Probe Micro Analyzer) method is usually effective to confirm this structure, although the measurement accuracy of analysis must be taken into consideration. By forming a sample in which emulsion grains are dispersed so as not to contact each other and analyzing radiated X-rays by radiating an electron beam, elements in a micro region irradiated with the electron beam can be analyzed. The measurement is preferably performed under cooling at low temperatures in order to prevent damage to the sample by the electron beam. By this method, the intra-grain silver iodide distribution of a tabular grain can be analyzed when the grain is viewed in a direction perpendicular to its main planes. Additionally, when a specimen obtained by hardening a sample and cutting the sample into a very thin piece using microtome is used, the intra-grain silver iodide distribution in the section of a tabular grain can be analyzed.

An embodiment wherein the average silver iodide content of the outer-shell-8%-region (in relation to the silver amount of the host grain) of the host grain is (I+5) mol % or more, if the average silver iodide content of all the grains in the silver halide emulsion of the present invention is regarded as I (mol %), is preferable. An embodiment wherein the average silver iodide content is (I+8) mol % or more is more preferable.

In the present invention, the silver iodide content of the outermost shell of a host grain is preferably higher than that of the core. The ratio of the outermost shell is preferably 1 to 40 mol % of the total silver amount, and the average silver iodide content is 1 to 30 mol %. "The ratio of the outermost shell" means the ratio of a silver amount used in the preparation of outermost shells to a silver amount used to obtain final grains. "The average silver iodide content of the outermost shell" means the molar ratio by % of a silver iodide amount used in the preparation of outermost shells to a silver amount used in the preparation of these outermost shells of the host final grains. The distribution of the average silver iodide content can be either uniform or nonuniform. More preferably, the ratio of the outermost shell is 5 to 30 mol % of the total silver amount of the host grains, and the average silver iodide content is 1 to 20 mol %.

In the silver halide emulsion of the present invention, an embodiment wherein 70% or more of the total projected area of the grains is occupied by the silver halide grains having no dislocation lines in the portions other than the epitaxial junction portions is preferable. An embodiment wherein 80% or more of the total projected area of the grains is occupied by the aforementioned silver halide grain is more preferable. However, an epitaxially deposited region is excluded. That is, the epitaxially deposited region may or may not have dislocation lines.

Dislocation lines in tabular grains can be observed by a direct method using a transmission electron micro scope at a low temperature described in, e.g., J. F. Hamilton, Phot. Sci. Eng., 11, 57, (1967) or T. Shiozawa, J. Soc. Phot. Sci. Japan, 35, 213, (1972). That is, silver halide grains, extracted carefully from an emulsion so as not to apply a pressure at which dislocations are produced in the grains, are placed on a mesh for electron microscopic observation. Observation is performed by a transmission method while the sample is cooled to prevent damage (e.g., print out) due to an electron beam. In this case, as the thickness of a grain is increased, it becomes more difficult to transmit an electron beam through it. Therefore, grains can be observed more clearly by using an electron microscope of a high voltage type (200 kV or more for a grain having a thickness of 0.25 $\mu$m).

The surface development sensitivity and the full development sensitivity of the present invention are defined respectively by the following formula, in the case where the emulsion coated product is exposed for 1 to 1/100 second, and afterwards, the following surface development (A) and the full development (B) are carried out:

$$S=100/Eh$$

where S represents a sensitivity, and Eh represents a light exposure needed to obtain a density midway between the sum of the maximum density (Dmax) and the minimum density (Dmin)

(Surface Development (A))

The development is performed at the temperature of 20° C. for 10 minutes, in the developer formulated as follows:

| | |
|---|---|
| N-methyl-p-aminophenol (hemisulfate salt) | 2.5 g |
| Ascorbic acid | 10 g |
| Sodium metaborate · tetrahydrate salt | 35 g |
| Potassium bromide | 1 g |
| Water to make | 1 L |

(Full Development (B))

The development is performed at the temperature of 20° C. for 10 minutes, in a developer further containing 0.5 g/liter of sodium thiosulfate in addition to the above developer (A).

The research conducted in the course of arriving at the present invention indicated that, especially in a process, such as a reversal processing, using a silver halide solvent (KSCN, etc.), it is preferable that the full development sensitivity be higher than the surface development sensitivity, in order to obtain a high sensitivity.

Next, a process of preparing tabular grains having (111) planes as main planes (hereinafter referred to as "(111) tabular grains"), which is one of preferable embodiments of the host tabular grains in the present invention, will be described below.

The (111) tabular grains used in the present invention can be prepared by improving the methods described in Cleve, "Photography Theory and Practice (1930)", p. 13; gutoff, "Photographic Science and Engineering", Vol. 14, pp. 248 to 257 (1970); and U.S. Pat. Nos. 4,434,226, 4,414,310, 4,433,048, 4,439,520, and GB2,112,157, etc., the disclosures of which are incorporated herein by reference.

The preparation of the (111) tabular grains is basically the combination of three steps: nucleation, ripening, and growth.

In the nucleation step of grains used in the present invention, it is extremely effective to use gelatin having a small methionine content described in U.S. Pat. Nos. 4,713,320 and 4,942,120, perform nucleation at a high pBr described in U.S. Pat. No. 4,914,014, and perform nucleation within short time periods described in JP-A-2-222940. In the present invention, it is particularly preferable to perform stirring in the presence of low-molecular-weight, oxidization-processed gelatin at a temperature of 20° C. to 40° C. and add an aqueous silver nitrate solution, aqueous halogen solution, and low-molecular-weight, oxidization-processed gelatin within one minute. The pBr and pH of the system are preferably 2 or more and 7 or less, respectively. The concentration of an aqueous silver nitrate solution is 0.6 mol/liter or less.

The ripening step of a tabular grain emulsion of the present invention can be performed in the presence of a low-concentration base described in U.S. Pat. No. 5,254,453 or at a high pH described in U.S. Pat. No. 5,013,641. Polyalkylene oxide compounds described in U.S. Pat. Nos. 5,147,771, 5,147,772, 5,147,773, 5,171,659, 5,210,013, and 5,252,453 can be added in the ripening step or in the subsequent growth step. In the present invention, the ripening step is preferably performed at a temperature of 50° C. to 80° C. The pBr is preferably lowered to 2 or less immediately after nucleation or during ripening. Also, additional gelatin is preferably added during a period from the timing immediately after nucleation to the end of ripening. Particularly preferred gelatin is that 95% or more of an amino group are modified by succination or trimellitation.

The growth step is usually performed by a known method of simultaneously adding an aqueous silver nitrate solution and an aqueous halogen solution, but a method of adding a silver nitrate solution, a halide solution containing a bromide, and an emulsion containing silver iodide fine-grains (hereinafter referred to as a silver iodide fine-grain emulsion), as described in U.S. Pat. Nos. 4,672,027 and 4,693,964.

The silver halide grains contained in the silver iodide fine-grain emulsion substantially need only be silver iodide and can contain silver bromide and/or silver chloride as long as a mixed crystal can be formed. The emulsion is preferably 100% silver iodide. The crystal structure of silver iodide can be a β body, a y body, or, as described in U.S. Pat. No. 4,672,026, an a body or an a body similar structure. In the present invention, the crystal structure is not particularly restricted but is preferably a mixture of β and γ bodies, and more preferably, a β body. The silver iodide fine-grain emulsion can be either an emulsion formed immediately before addition described in, e.g., U.S. Pat. No. 5,004,679 or an emulsion subjected to a regular washing step. In the present invention, an emulsion subjected to a regular washing step is preferably used. The silver iodide fine-grain emulsion can be readily formed by a method described in, e.g., U.S. Pat. No. 4,672,026. A double-jet addition method using an aqueous silver salt solution and an aqueous iodide salt solution in which grain formation is performed with a fixed pI value is preferred. The pI is the logarithm of the reciprocal of the $I^-$ ion concentration of the system. The temperature, pI, and pH of the system, the type and concentration of a protective colloid agent such as gelatin, and the presence/absence, type, and concentration of a silver halide solvent are not particularly limited. However, a grain size of preferably 0.1 μm or less, and more preferably, 0.07 μm or less is convenient for the present invention. Although the grain shapes cannot be perfectly specified because the grains are fine grains, the variation coefficient of a grain size distribution is preferably 25% or less. The effect of the present invention is particularly remarkable when the variation coefficient is 20% or less.

The sizes and the size distribution of the silver iodide fine-grain emulsion are obtained by placing silver iodide fine grains on a mesh for electron microscopic observation and directly observing the grains by a transmission method instead of a carbon replica method. This is because measurement errors are increased by observation done by the carbon replica method since the grain sizes are small. The grain size is defined as the diameter of a circle having an area equal to the projected surface area of the observed grain. The grain size distribution also is obtained by using this equivalent-circle diameter of the projected surface area. In the present invention, the most effective silver iodide fine grains have a grain size of 0.06 to 0.02 μm and a grain size distribution variation coefficient of 18% or less.

After the grain formation described above, the silver iodide fine-grain emulsion is preferably subjected to regular washing described in, e.g., U.S. Pat. No. 2,614,929, and adjustments of the pH, the pI, the concentration of a protective colloid agent such as gelatin, and the concentration of the contained silver iodide are performed. The pH is preferably 5 to 7. The pI value is preferably the one at which the solubility of silver iodide is a minimum or the one higher than that value. As the protective colloid agent, a common gelatin having an average molecular weight of approximately 100,000 is preferably used. A low-molecular-weight gelatin having an average molecular weight of 20,000 or less also is favorably used. It is sometimes convenient to use a mixture of the gelatins having different molecular weights. The gelatin amount is preferably 10 to 100 g, and more preferably, 20 to 80 g per kg of an emulsion. The silver amount is preferably 10 to 100 g, and more preferably, 20 to 80 g, as the amount of silver atoms, per kg of an emulsion. The silver iodide fine-grain emulsion is usually dissolved before being added. During the addition it is necessary to sufficiently raise the efficiency of stirring of the system. The rotational speed of stirring is preferably set to be higher than usual. The addition of an antifoaming agent is effective to prevent the formation of foam during the stirring. More specifically, an antifoaming agent described in, e.g., examples of U.S. Pat. No. 5,275,929 is used.

In the growth step of the present invention, an external stirring apparatus described in JP-A-10-43570 can be used. That is, an emulsion containing fine grains of silver bromide, silver iodobromide, or silver iodochlorobromide (hereinafter referred to as an "ultrafine-grain emulsion"), which is prepared in the stirring apparatus immediately before addition thereof, is continuously added, whereupon it dissolves and the tabular grains grow. The external mixer used for preparing the ultrafine-grain emulsion has a high stirring power. An aqueous silver nitrate solution, aqueous halogen solution, and gelatin are added to the mixer. Gelatin can be mixed in the aqueous silver nitrate solution and/or the aqueous halogen solution beforehand or immediately before the addition. Alternatively, an aqueous gelatin solution can be added separately. The molecular weight of the gelatin is preferably lower than usual, and more preferably, 10,000 to 50,000. It is particularly preferable to use a gelatin in which 90% or more of an amino group is modified by phthalation, succination, or trimellitation and/or an oxidization-processed gelatin whose methionine content is decreased.

Next, a polyvinyl pyrrolidone-based compound having a repeating unit represented by the formula (PP-I), used in the present invention will be explained.

Formula (PP-I)

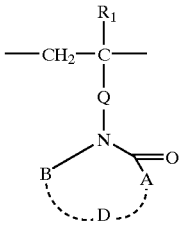

$R_1$ represents a hydrogen atom or an alkyl group. Q represents a single bond, —$COOR_2$—, or —$CONHR_2$—. A represents a single bond, or an oxygen atom. B represents a single bond, or —CO—. D represents —$(CH{=}CH)_2$—, —$(CH_2)_n$— (provided that n is an integer of 3 to 5 if both A and B are a single bond, n is 2 or 3 if A is an oxygen atom and B is a single bond, and n is an integer of 2 to 4 if A is a single bond and B is —CO—), or a phenylene group (if A is a single bond and B is —CO—). $R_2$ represents a substituted or unsubstituted divalent hydrocarbon group having 2 to 8 carbon atoms.

The polymer having a repeating unit represented by the formula (PP-I) used in the present invention may be any of a homo polymer consisting of monomers of a kind represented by the formula (PP-IA); a co-polymer consisting of two or more kinds of monomers; and a co-polymer consisting of a monomer represented by the formula (PP-IA) and one or more unsaturated compounds which can be additionally polymerized with the monomer represented by the formula (PP-IA).

Formula (PP-IA)

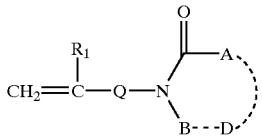

(In this formula, $R_1$, Q, A, B, and D have the same as those in the formula (PP-I), respectively.).

Examples of a monomer represented by the formula (PP-IA) are N-vinyllactam, N-vinylimide, N-acryloyloxyalkyllactam, N-acryloyloxyalkylimide, N-methacryloyloxyalkyllactam, N-methacryloyloxyalkylimide, N-(acrylamidealkyl)lactam, N-(acrylamidealkyl)imide, N-(methacrylamidealkyl)lactam, and N-(methacrylamidealkyl)imide. Further, specific examples are, for example, N-vinyl-ϵ-caprolactam, N-vinylpiperidone, N-vinylpyrolidone, N-vinyloxazolidone, N-vinyl-2-pyridone, N-vinylsuccinimide, N-vinylglutarimide, N-vinyladipimide, N-vinylphthalimide, N-(2-acryloyloxyethyl)pyrolidone, N-(2-acryloyloxyethyl) oxazolidone, N-(2-acryloyloxyethyl)succinimide, N-(2-methacryloyloxyethyl)pyrolidone, N-(2-methacryloyloxyethyl)succinimide, N-(2-acrylamideethyl) pyrolidone, N-(2-acrylamideethyl)succinimide, and N-(2-(methacrylamideethyl)succinimide.

Examples of an unsaturated compound capable of undergoing addition polymerization thereby to form a copolymer together with the monomer represented by the formula (PP-IA) are acrylic esters, methacrylic esters, acrylamides, methacrylamides, an allyl compound, vinyl ethers, vinyl esters, a vinylheterocyclic compounds, styrenes, maleic esters, fumaric esters, itaconic esters, crotonic esters, and olefins. Specific examples thereof are, methyl acrylate, ethyl acrylate, n-propyl acrylate, isopropyl acrylate, n-butyl acrylate, octyl acrylate, 2-chloroethyl acrylate, 2-cyanoethyl acrylate, N— (β-dimethylaminoethyl) acrylate, benzil acrylate, dichlohexyl acrylate, phenyl acrylate; methyl methacrylate, ethyl methacrylate, n-propyl methacrylate, isopropyl methacrylate, n-butyl methacrylate, octyl methacrylate, cyclohexyl methacrylate, benzil methacrylate; N-ethyl acrylamide, N-(tert-butyl) acrylamide, N-(1,1-dimethyl-3-oxobutyl) acrylamide, N-(1,1-dimethyl-3-hydroxybutyl) acrylamide, N-benzyl acrylamide, β-dimethylaminoethyl acrylamide, N,N-diethyl acrylamide, N-acryloylmorpholine, N-acryloylpiperidine, N-(β-morpholinoethyl) acrylamide, N-(tert-butyl) methacrylamide, N-benzyl methacrylamide, N,N-diethyl methacrylamide, N-methacryloylpiperidine; allyl acetate, allyl caprylate, allyl caproate, allyl laurate, allyl benzoate; allylbutyl ether, allylphenyl ether; methylvinyl ether, butylvinyl ether, octylvinyl ether, methoxyethylvinyl ether, 2-chloroethylvinyl ether, 2-hydroxyethylvinyl ether, (2-dimethylaminoethyl)vinyl ether, vinylphenyl ether, vinyl triether, vinylchlorphenyl ether; vinyl acetate, vinyl propionate, vinyl butyrate, vinyl isobutyrate, vinyl caproate, vinyl chlor acetate, vinyl methoxy acetate, vinyl phenyl acetate, vinyl acetoacetate, vinyl lactate, vinyl benzoate, vinyl chlorobenzoate, vinyl naphthoate; vinylpyridine, N-vinylimidazole, N-vinylcarbazole, vinyl thiophene; styrene, chlormethyl styrene, p-acetoxy styrene, p-methyl styrene; p-vinyl benzoic acid, p-vinyl methyl benzoate; crotonamide, butyl crotonate, glycerol monocrotonate; methyl vinyl ketone; phenyl vinyl ketone; ethylene, propylene, 1-butene, 4-methyl-1-hexene, 4,4-dimethyl-1-pentene, etc.; methyl itaconate, ethyl itaconate, diethyl itaconate, etc.; methyl sorbate, ethyl maleate, butyl maleate, dibutyl maleate, octyl maleate, etc.; ethyl fumarate, dibutyl fumarate, octyl fumarate, etc.; halogenated olefins, such as vinyl chloride, vinylidene chloride, and chloroprene; unsaturated nitriles, such as acrylonitrile, methacrylonitrile. Two or more compounds can be used according to necessity.

Of these monomers, from the viewpoint of the solubility of the polymer, lipophilicity, affinity with protective colloid, and development suitability, N-vinyllactam, N-vinylimide, and N-vinyloxazolidone of the monomers represented by the formula (PP-IA) are preferable, and N-vinylpyrolidone and N-vinylsuccinimide are especially preferable. Of the addition polymerizationization unsaturated compounds which form a copolymer together with the monomer represented by the formula (PP-IA), acrylic esters, or methacrylic esters, vinyl esters, acrylamides, and methacrylamides are preferable. The composition ratio of the copolymer containing the repeating unit represented by the formula (PP-I) is not particularly limited. However, the component represented by the formula (PP-I) is of 40 to 100 mol %, and especially preferably, 70 to 98 mol %.

The average molecular weight of the polymer having a repeating unit represented by general formula (PP-I) used in the present invention is not particularly limited. However, about 10,000 to 1,000,000 is preferable, and about 50,000 to 500,000 is more preferable from the viewpoint of diffusibility to an adjacent layer, handleability, etc. The synthesis of the polymer used in the present invention can be carried out by referring to the methods described in GB 1,211,039, JP-B-47-29195, JP-A-48-76593, JP-A-48-92022, JP-A-49-21134, JP-A-49-120634, gB 961,395, U.S. Pat. Nos. 3,227,672, 3,290,417, 3,262,919, 3,245,932, 2,681,897, 3,230,275, "Official Digest", John C. Petropoulos et al, vol. 33, pp. 719 to 736 (1961), "Synthetic macromolecule", Shunsuke Murahashi et al, vol. 1, pp. 246 to 290, vol. 3, pp. 1 to 108 (Asakurashoten), etc. Needless to say, a polymerization initiator, density, polymerization temperature, reaction time period, etc., can be broadly and easily changed according to the object. For example, polymerization is performed, in general, at 20 to 180° C., and preferably at 40 to 120° C., using, in general, 0.05 to 5 weight % of a radical polymerization initiator in relation to a monomer to be polymerized. As the initiator, an azobis compound, peroxide, hydroperoxide, redox catalyst, such as potassium persulfate, tert-butyl peroctoate, benzoyl peroxide, and azobisisobutyronitrile are used.

Next, representative examples of a polymer used in the present invention will be shown below. However, the polymer is not limited to these examples.

(PP-I-1)poly-N-vinylpyrrolidone
(PP-I-2)poly-N-vinyloxazolidine
(PP-I-3)poly-N-vinylpiperidone
(PP-I-4)poly-N-vinylsuccinimide
(PP-I-S)poly-N-vinylphthalimide
(PP-I-6)poly-N-vinyl-ϵ-caprolactam
(PP-I-7)N-vinylpyrolidone-vinyl acetate copolymer (molar ratio of 70:30)
(PP-I-8)N-vinylpyrolidone-vinyl acetate copolymer (molar ratio of 80:20)
(PP-I-9)N-vinylpyrolidone-vinyl acetate copolymer (molar ratio of 90:10)
(PP-I-10)N-vinylpyrolidone-vinyl acetate copolymer (molar ratio of 95:5)
(PP-I-11)N-vinylpyrolidone-n-butyl methacrylate copolymer (molar ratio of 90:10)
(PP-I-12)N-vinylpyrolidone-n-butyl methacrylate copolymer (molar ratio of 95:5)
(PP-I-13)N-vinylpyrolidone-n-butyl acrylate copolymer (molar ratio of 80:20)
(PP-I-14)N-vinylpyrolidone-methyl methacrylate copolymer (molar ratio of 90:10)
(PP-I-15)N-vinylpyrolidone-methyl acrylate copolymer (molar ratio of 95:5)
(PP-I-16)N-vinylpyrolidone-methoxyethyl acrylate copolymer (molar ratio of 85:15)
(PP-I-17)N-vinylpyrolidone-N-(1,1-dimethyl-3-oxobutyl acrylamide) copolymer (molar ratio of 50:50)
(PP-I-18)N-vinylpyrolidone-N-(tert-butyl) acrylamide copolymer (molar ratio of 70:30)
(PP-I-19)N-vinylpyrolidone-vinyl alcohol-vinyl acetate copolymer (molar ratio of 80:15:5)
(PP-I-20)N-vinylpyrolidone-N-vinylsuccinimide-vinyl acetate copolymer (molar ratio of 70:20:10)
(PP-I-21)N-vinylpyrolidone-2-ethoxyethyl acrylate copolymer (molar ratio of 92:8)
(PP-I-22)N-vinylpyrolidone-vinyl acetate-dimethyl acrylamide copolymer (molar ratio of 60:20:20)
(PP-I-23)N-vinylsuccinimide-vinyl acetate copolymer (molar ratio 75:25)
(PP-I-24)N-vinylsuccinimide-vinyl acetate copolymer (molar ratio 90:10)
(PP-I-25)N-vinylsuccinimide-n-butyl methacrylate copolymer (molar ratio 93:7)
(PP-I-26)N-vinylsuccinimide-N-(1,1-dimethyl-3-oxobutyl acrylamide) copolymer (molar ratio 65:35)
(PP-I-27)N-vinylsuccinimide-dimethyl acrylamide copolymer (molar ratio 73:27)
(PP-I-28)N-vinyl oxazolidone-vinyl acetate copolymer (molar ratio 92:8)
(PP-I-29)N-vinyl oxazolidone-n-butyl acrylate copolymer (molar ratio 95:5)
(PP-I-30)N-vinyl oxazolidone-N-vinyl phthalimide copolymer (molar ratio 60:40)
(PP-I-31)N-(2-methacryloyloxyethyl)pyrolidone-N-(1,1-dimethyl-3-oxobutyl)acrylamide copolymer (molar ratio 70:30)
(PP-I-32)N-(2-acrylamide ethyl)pyrolidone-vinyl acetate copolymer (molar ratio 75:25)
(PP-I-33)N-vinylpyrolidone-vinyl alcohol copolymer (molar ratio 70:30)

The polyvinyl pyrrolidone-based compound to be added to a lightsensitive tabular silver halide emulsion in the present invention may be added at any point of the preparation step of the tabular silver halide emulsion. However, an embodiment wherein the compound is added after chemical sensitization is preferable. The amount of the compound to be added is not particularly limited. However, 5 to 50 g per mol of a silver halide is preferable, and 10 to 30 g is more preferable. The addition temperature is not limited but the compound is added preferably at 40 to 75° C.

Next, the compound represented by the formula (PP-II) will be explained.

Formula (PP-II)

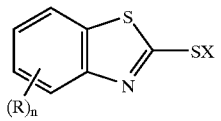

In the formula, X represents a hydrogen atom, or an alkali metal atom (for example, lithium, sodium, or potassium), preferably, a hydrogen atom, Na, or K, and more preferably, a hydrogen atom, or Na.

R represents a hydrogen atom, a halogen atom (for example, fluorine, chlorine, or bromine), or an alkyl group having 1 to 5 carbon atoms. The number of substituents represented by R (n in the formula (PP-II)) is an integer from 1 to 4, preferably 1 or 2. When n is 2 or more, a plural R may be the same or different.

Next, the preferable specific examples of the compounds represented by the formula (PP-II) will be shown below.

PP-II-1

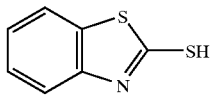

PP-II-2

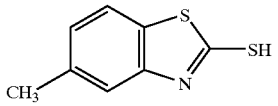

PP-II-3

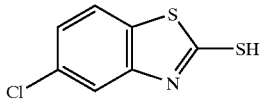

PP-II-4

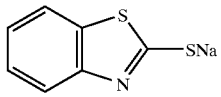

PP-II-5

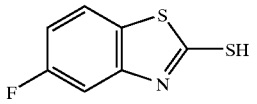

PP-II-6

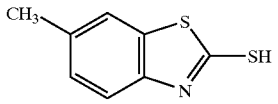

PP-II-7

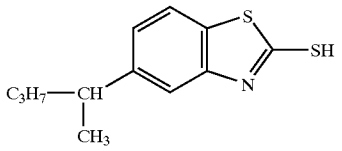

PP-II-8

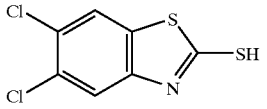

The addition amount, the method of adding, and the addition timing of the compounds represented by general formula (PP-II) are the same as those of the polymer having a repeating unit represented by general formula (PP-I) mentioned above.

Next, a (100) plane selective compound will be described.

In general, compounds adsorptive to a silver halide are broadly divided, based on the molecular skeleton or substituent thereof, to belong to a (100) plane selective or other planes selective. That is, the (100) plane selective refers to that the initial adsorption of the added compound to the silver halide occurs on the (100) plane in priority to the other planes. The (100) plane selective compound in the present invention refers to a compound which can be judged to be (100) plane selective by the plane selectivity determining method described below.

The method of determining the crystal habit plane selectivity of a compound will be described below.

A core silver bromide grain with a tetradecahedral form of 0.85 μm, having a crystal habit in which a ratio of the area of the (100) plane to the area of the (111) plane is 52:48, is prepared. Various kinds of dyes and additives are adsorbed in order that the adsorption amount thereof may be $8\times10^{-4}$ mol (one-half of this amount if the dyes alone are adsorbed) per mol of the silver amount of a whole grain. After that, shell provision of 125% of the silver amount of the core silver bromide grain is performed. If the ratio of the (100) plane area to the (111) plane area of the above grain is 65% or more, it is defined as a (100) plane selective compound. That is, if a compound having a high (100) plane adsorption selectivity is adsorbed, in the grain growth afterwards, the tendency of lamination on the (111) plane increases. Thereby, the (100) plane is formed.

The ratio of the (100) plane area to the (111) plane is calculated as follows. The sample of the grain after growth is prepared by the replica method, observed by a transmission electron microscope, and the ratio of the (100) plane area to the total surface area is determined on the basis of the length of the periphery of the (100) plane, and the grain size. From these values, the percentage is determined.

The method of preparing the tetradecahedron grain will be described below.

(Preparation of an Emulsion Containing Tetradecahedron Grains)

739 mL of an aqueous solution containing 0.3 g of potassium bromide and 14.8 g of gelatin were held at 60° C. and stirred, while 26.4 mL of an aqueous silver nitrate solution (0.471M) and 26.4 mL of an aqueous potassium bromide solution (0.477M) were added simultaneously over 1 minute. After that, 5.28 g of ammonium nitrate and 4.5 mL of a 25% aqueous ammonia solution were added. Then, 739 mL of an aqueous silver nitrate solution (1.17M) and an aqueous potassium bromide solution (1.30M) were further added over 50 minutes while maintaining the silver potential at 28 mV. After the grain formation is finished, desalting by an ordinary flocculation method, and washing were performed. After that, gelatin and water were added, and the pH and the pAg were adjusted to 6.3 and 8.7, respectively. The silver bromide emulsion A thus obtained was a monodisperse tetradecahedron emulsion with a grain diameter of 0.85 μm, and a grain diameter variation coefficient of 12%. As a result of measuring the (100) plane ratio concerning this emulsion using the aforementioned method, the percentage was 52%.

The (100) plane selective compound is not particularly limited as long as it is judged to be (100) plane selective by the above determination method. In addition, two or more compounds may be used in combination.

The (100) plane selective compound can be dissolved in a solvent such as water or alcohols, or made into a gelatin disperse product, and can be added at any point, i.e., during the grain formation, before or after chemical sensitization, and at the time of emulsion coating. The compound may be especially preferably added after grain formation and before chemical sensitization.

Next, the (100) plane selective compound represented by the formula (PP-III) will be explained in detail.

Formula (PP-III)

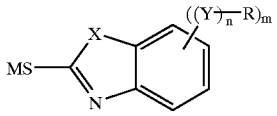

In the formula, R represents a substituted or unsubstituted alkyl group (e.g., methyl, ethyl, n-propyl, isopropyl, n-butyl, t-butyl, n-hexyl, 1-ethylpentyl, 1-methylbutyl, 2-methylpropyl, 2-methylbutyl, n-heptyl, n-nonyl, n-decyl, 2-hydroxyethyl, and 2-dimethylaminoethyl), a substituted or unsubstituted an alkenyl group (e.g., vinyl, allyl, and 3-butenyl), a substituted or unsubstituted alkynyl group (e.g., propargyl), an aryl group (e.g., phenyl, naphthyl, 4-methylphenyl, 3-chlorophenyl, and 4-methoxyphenyl), or a substituted or unsubstituted aralkyl group (e.g., benzyl, and phenethyl). Y represents —O—, —S—, —$NR_1$—, —$NR_2CO$—, —$CONR_3$—, —$NR_4SO_2$—, —$SO_2NR_5$—, —COO—, —OCO—, —CO—, —$SO_2$—, —$NR_6CONR_7$—, —$NR_8CSNR_9$—, or —$NR_{10}COO$—. $R_1$, $R_2$, $R_3$, $R_4$, $R_5$, $R_6$, $R_7$, $R_8$, $R_9$ and $R_{10}$ independently represent a hydrogen atom, or an alkyl group, alkenyl group, alkynyl group, aryl group, or aralkyl group, each of which may be substituted or unsubstituted. The substituted or unsubstituted alkyl group, alkenyl group, aryl group, and aralkyl group represented by $R_1$, $R_2$, $R_3$, $R_4$, $R_5$, $R_6$, $R_7$, $R_8$, $R_9$, and $R_{10}$ have the same meaning as those of each group represented by R. If m is 2 or more, each —$(Y)_n$—R group may be the same or different. X represents —O—, —S— or —NR'—. R' represents a hydrogen atom, a substituted or unsubstituted lower alkyl group having preferably 1 to 4 carbon atoms (e.g., methyl, ethyl, n-propyl, isopropyl, n-butyl, and 2-hydroxyehtyl), or an alkenyl group having preferably 2 to 4 carbon atoms (e.g., vinyl and allyl). M represents a hydrogen atom, an alkali metal atom (e.g., a sodium atom, and potassium atom), an alkaline-earth metal atom (e.g., a magnesium atom, and calcium atom), an ammonium group (e.g., trimethylammonium and dimethylbenzylammonium group), or a group capable of cleaving under an alkali condition (e.g., alkaliethyl and methanesulfonylethyl group). The number of carbon atoms in —$((Y)_n$—$R)_m$ portion is 1 to 30.

In the formula (PP-III), each group represented by $R_1$, $R_2$, $R_3$, $R_4$, $R_5$, $R_6$, $R_7$, $R_8$, $R_9$, $R_{10}$, and R' may be substituted. Examples of the substituent are as follows.

A halogen atom (e.g., a fluorine atom, chlorine atom, and bromine atom), an alkyl group (e.g., methyl, ethyl, n-propyl, isopropyl, t-butyl, n-octyl, cyclopentyl, and cyclohexyl), an alkenyl group (e.g., allyl, 2-butenyl, and 3-pentenyl), an alkinyl group (e.g., propargyl and 3-pentinyl), an aralkyl group (e.g., benzyl and phenethyl), an aryl group (e.g., phenyl, naphthyl, and 4-methylphenyl), a heterocyclic group (e.g., pyridyl, furyl, imidazolyl, piperidyl, and morpholino), an alkoxy group (e.g., methoxy, ethoxy, and butoxy), an amino group (e.g., unsubstituted amino, dimethylamino, ethylamino, and anilino), an acylamino group (e.g., acetylamino and benzoylamino), an ureido group (e.g., unsubstituted ureido, N-methylureido, and N-phenylureido), an urethane group (e.g., methoxycarbonylamino and phenoxycarbonylamino), a sulfonylamino group (e.g., methylsulfonylamino and phenylsulfonylamino), a sulfamoyl group (e.g., unsubstituted sulfamoyl, N,N-dimethylsulfamoyl, and N-phenylsulfamoyl), a carbamoyl group (e.g., unsubstituted carbamoyl, N,N-diethylcarbamoyl, and N-phenylcarbamoyl), a sulfonyl group (e.g., mesyl and tosyl), an alkyloxycarbonyl group (e.g., methoxycarbonyl and ethoxycarbonyl), an aryloxycarbonyl group (e.g., phenoxycarbonyl), an acyl group (e.g., acetyl, benzoyl, formyl, and pivaloyl), an acyloxy group (e.g., acetoxy and benzoyloxy), an amide phosphate group (e.g., N,N-diethyl amide phosphate), an alkylthio group (e.g., methylthio and ethylthio), an arylthio group (e.g., phenylthio), a cyano group, a sulfo group, a carboxy group, a hydroxy group, a phosphono group, a nitro group, a sulfino group, an ammonio group (e.g., trimethylammonio), a phosphonio group, and a hydrazino group. These groups can be further substituted. If two or more substituents exist, these substituents can be the same or different.

In the formula (PP-III), R represents a substituted or unsubstituted alkyl group. Y represents —$NR_2CO$—, —$CONR_3$—, —$NR_4SO_2$—, —$SO_2NR_5$—, or —$NR_6CONR_7$—. $R_2$, $R_3$, $R_4$, $R_5$, $R_6$, and $R_7$ represent a hydrogen atom, or a substituted or unsubstituted lower alkyl group having 1 to 4 carbon atoms. n is 1, and m is 1 to 2. X represents —NR'—, and R' represents a hydrogen atom, or a substituted or unsubstituted lower alkyl group. M represents a hydrogen atom, an alkali metal atom, or an ammonium group. The sum of the carbon atoms of —$((Y)_n$—$R)_m$ is 1 or more and 20 or less.

In the formula (PP-III), it is preferable that R represents a substituted or unsubstituted alkyl group having 4 to 10 carbon atoms, and Y represents —NHCO— or —NHCONH—. n is 1, and m is 1. X represents —NH-. In the formula (PP-III), it is most preferable that R represents an unsubstituted branched alkyl group having 4 to 10 carbon atoms, and Y represents —NHCO—.

Specific examples of the (100) plane selective compound represented by the formula (PP-III) will be shown below. However, the compound is not limited to these examples.

PP-III-1

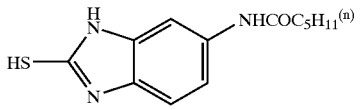

PP-III-2

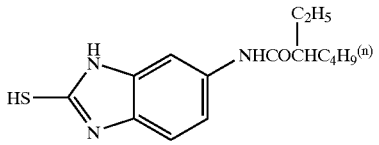

PP-III-3

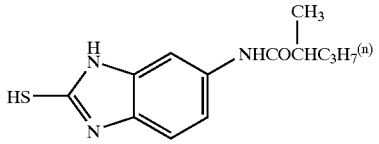

PP-III-4

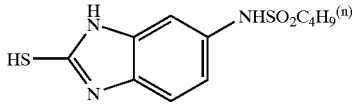

-continued
PP-III-5
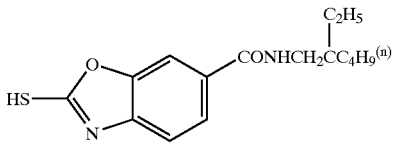
PP-III-6
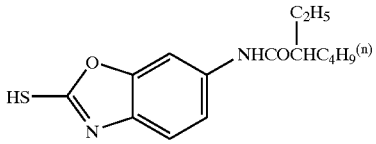
PP-III-7
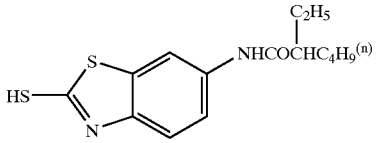
PP-III-8
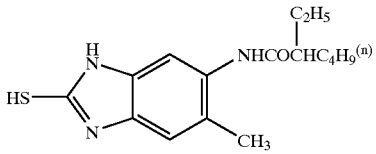
PP-III-9
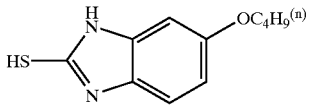
PP-III-10
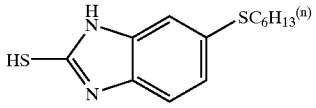
PP-III-11
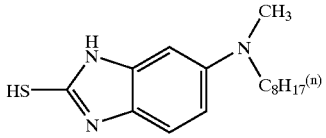
PP-III-12
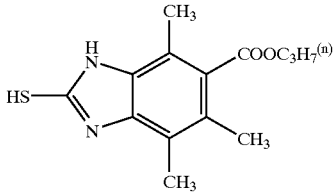
PP-III-13
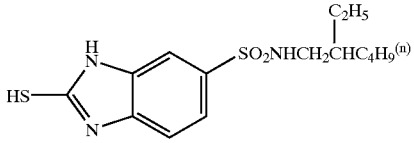
PP-III-14
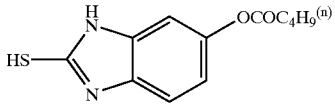
-continued
PP-III-15
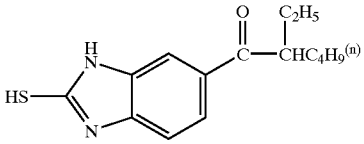
PP-III-16
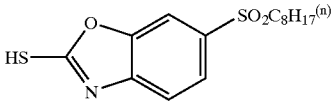
PP-III-17
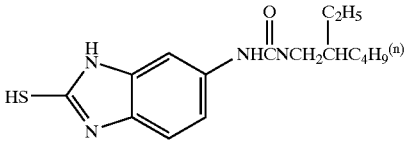
PP-III-18
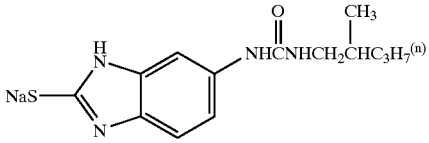
PP-III-19
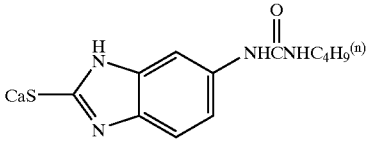
PP-III-20
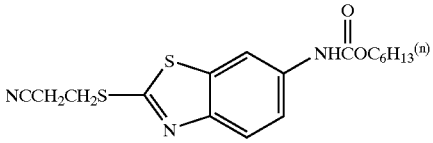
PP-III-21
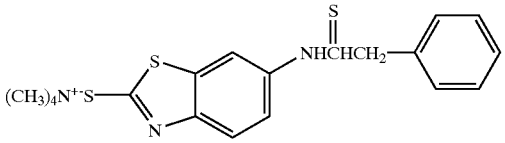
PP-III-22
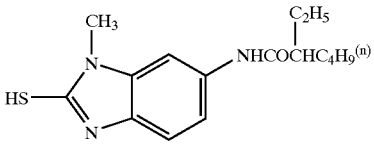
PP-III-23
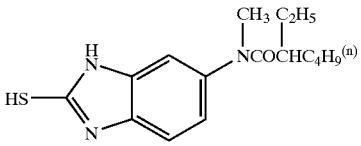
PP-III-24
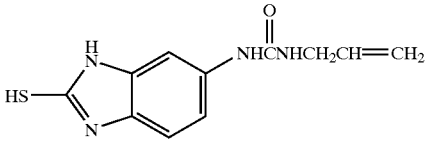

-continued

PP-III-25

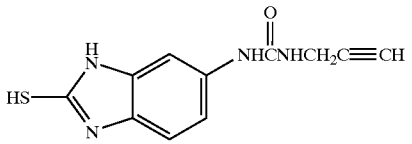

PP-III-26

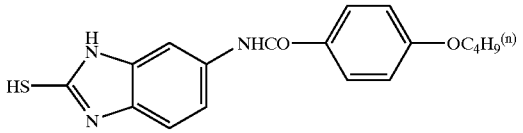

PP-III-27

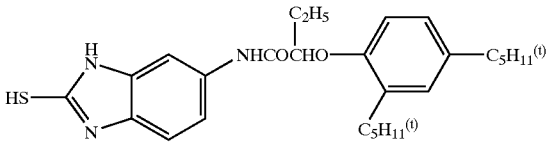

PP-III-28

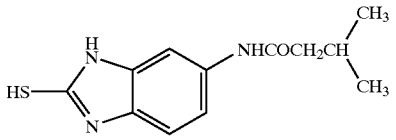

PP-III-29

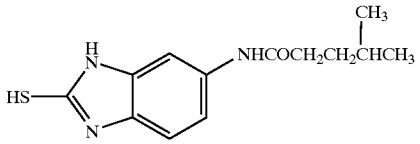

PP-III-30

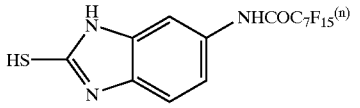

PP-III-31

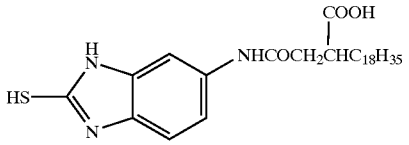

PP-III-32

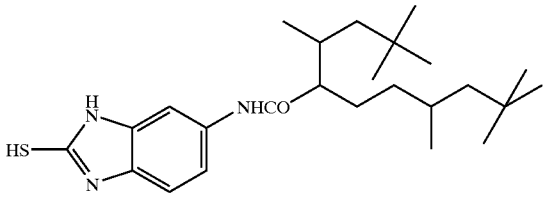

The compound represented by the formula (PP-III) can be synthesized based on the methods, described in the following publications, J. Van Alan, B. D. Deacon, Org. Synth., IV, 569 (1963), J. Bunner, Ber., 9,465 (1876), L. B. Sebrell, C. E. Boord, J. Am. Chem. Soc., 45,2390 (1923), JP-A-61-48832, etc.

The addition amount, the method of adding, and the addition timing of the compounds represented by general formula (PP-III) are the same as those of the polymer having a repeating unit represented by general formula (PP-I) mentioned above.

Next, the polymer having the repeating unit represented by the following formula (PP-IV) will be explained.

Formula (PP-IV)

$$-(R-O)_n-$$

In the formula, R represents an alkylene group having 2 or more and 10 or less carbon atoms. n represents the average number of repeating units of 4 or more and 200 or less. In the present invention, a polymer containing the repeating unit of the formula (PP-IV) may be preferably used. However, a vinyl polymer containing, as a component, at least one kind of monomer represented by the formula (PP-V), or a polyurethane of the following formula (PP-VI) may be more preferably used. A vinyl polymer containing the repeating unit represented by the formula (PP-V) is especially preferable. The polymer having a repeating unit represented by general formula (PP-IV) is not particularly limited, but about 10,000 to 1,000,000 is preferable, and about 20,000 to 500,000 is more preferable.

Formula (PP-V)

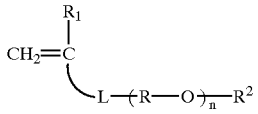

Formula (PP-VI)

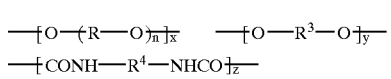

In the formulae, R represents an alkylene group having 2 or more and 10 or less carbon atoms. n represents the average number of repeating units of 4 or more and 200 or less. $R^1$ represents a hydrogen atom, or a lower alkyl group, $R^2$ represents a monovalent substituent, and L represents a divalent linkage group. $R^3$ and $R^4$ independently represent an alkylene group having 1 to 20 carbon atoms, a phenylene group having 6 to 20 carbon atoms, or an aralkylene group having 7 to 20 carbon atoms. x, y and z represent a weight percentage of each component, and x is 1 to 70, y is 1 to 70, and z is 20 to 70, where x+y+z=100.

Specific examples of the polymer used in the present invention will be shown below. However, the polymer of the present invention is not limited to these examples. More detailed specific examples, and a general description are described in JP-A-9-54377, the disclosure of which is incorporated herein by reference.

PP-V-1

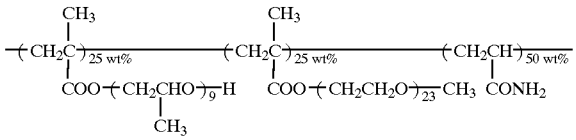

PP-V-2

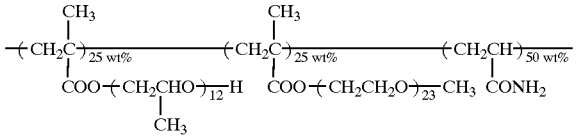

PP-V-3

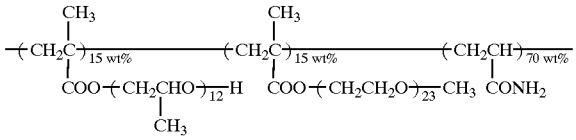

-continued

PP-V-4

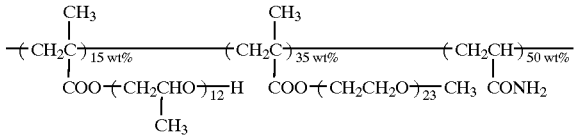

PP-V-5

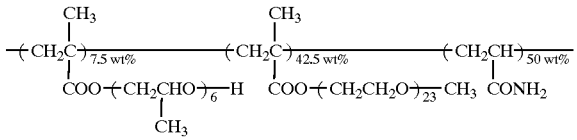

A preferred example of the polymer containing the repeating unit represented by the formula (PP-IV) of the present invention is a block polymer of polyalkylene oxide represented by the following formulae (PP-VII) and (PP-VIII).

Formula (PP-VII)

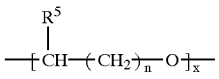

Formula (PP-VIII)

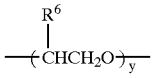

In the formula, $R^5$ represents a hydrogen atom, an alkyl group having 1 to 10 carbon atoms, or an aryl group having 6 to 10 carbon atoms, and n represents an integer of 1 to 10. If n=1, $R^5$ will not be a hydrogen atom. $R^6$ represents a hydrogen atom, or a lower alkyl group having 4 or less carbon atoms, substituted by a hydrophilic group. x and y independently represent the repeating number of each unit (number average polymerization degree).

Specific examples of the block polymer used in the present invention will be shown below. However, the polymer of the present invention is not limited to these examples. More detailed specific examples, and a general description are described in EP's 513722, 513723, 513724, 513735, 513742, 513743, and 518066, and JP-A-9-54377, all the disclosures of which are incorporated herein by reference.

PP-VII-1

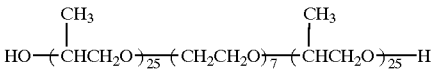

PP-VII-2

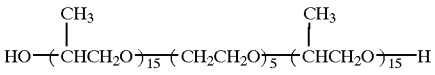

PP-VII-3

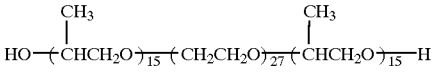

Next, a process of preparing tabular grains having (100) planes as main planes (hereinafter referred to as "(100) tabular grains"), which is another preferable embodiment of the host tabular grains in the present invention, will be described below.

The (100) tabular grains are formed preferably in the presence of a polyvinylalcohol derivative (hereinafter referred to as "polymer (P)"). The polymer (P) strongly adsorbs to a silver halide grain and has a strong protective colloidal activity. The polymer (P) also inhibits a silver halide from being further laminated on the adsorbed surface.

The formation of tabular nuclei of the (100) tabular grains is completed when polymer (P) is adsorbed by a pair of (100) planes, which can be main planes of the silver halide grain, and gelatin adsorbs on the side faces (the other faces). The tabular nuclei can be formed by (1) adding $Ag^+$ ions and $X^-$ ions to the aqueous solution containing the polymer (P) and the gelatin in advance, or (2) adding $Ag^+$ ions and $X^-$ ions to the aqueous solution containing the gelatin alone, to form a fine crystal, and afterwards adding the polymer (P). If the adsorbability of the polymer (P) and the gelatin can be controlled skillfully in the more unstable initial stage of nucleation, it is preferable for thickness monodispersing to form tabular nuclei by method (1).

The control of the adsorbability of the polymer (P) and the gelatin can be performed by controlling the type (molecular weight, substituent, etc.) of the polymer (P) and the gelatin used, or the used amount thereof, or the pH, pAg, etc., during tabular nuclei formation. For example, as the molecular weight of the polymer (P) increases, the adsorbability thereof becomes stronger. In this case, it is necessary to increase the molecular weight of the gelatin or to increase the amount of gelatin used to balance the adsorbability. In nucleation, the highest priority is put on realizing a uniform adsorption state of the polymer (P) and the gelatin in the grains, and it is preferable that the amount of polymer (P) used be small. It is necessary to select the type and the amount of gelatin to be used accordingly, and to select the pH and pAg suitable for the selected gelatin. The adsorbability is based on the relationship between the crystal phase of the AgX grain surface, polymer (P), and gelatin, and is therefore not specifically definable.

In the ripening and growth steps after the nucleation, the balance of the adsorbability is required to be changed according to necessity.

The ripening step is not needed if the tabular nuclei formed by the methods (1) and (2) are all preferable tabular nuclei (the state in which the polymer (P) is adsorbed on the aforementioned pair of (100) planes, which can be main planes, and the gelatin is adsorbed on the side faces (the other faces)). However, the ripening step is needed if the unpreferable nucleus crystal is present. At this time, the nucleus crystal is caused to disappear by Ostwald ripening. The adsorbability of the polymer (P) having a strong protective colloid activity is weakened, to accelerate ripening. It is also preferable to provide an atmosphere, in which ripening is easily performed, by increasing the temperature, or to add $Ag^+$ ions and $X^-$ ions to accelerate ripening.

In the growth step of the (100) tabular grains, it is preferable that $Ag^+$ and $X^-$ be added in a state where the largest difference in adsorbability occurs between the polymer (P) and the gelatin, if possible, that is, in a state where the largest difference in solubility between the main planes and the side faces occurs, in order to maintain a low-supersaturation state. In order to cause a difference in adsorbability to occur, it is the easiest and most preferable to control, with pH, the adsorbability of the polymer (P) and the gelatin.

In the (100) tabular grain formation, it is preferable that a spectral sensitizing dye be added before the grain formation is completed. Since the polymer (P) is strongly adsorbed by the silver halide grains, in order to cause the spectral sensitizing dye to adsorb on the main planes with a large surface area, the spectral sensitizing dye is substituted by the polymer (P) while maintaining the silver halide surface in a dynamic state (that is, allowing a new lamination by adding silver ions and halogen ions). It is preferable that a gelatin is added in order to relatively reduce the adsorbability of the polymer (P), thereby accelerating substitution.

Next, a process of forming a silver halide protrusion portion epitaxially Functioned on the surface of the host tabular grain will be explained.

Protrusion formation may be carried out immediately after the host tabular grains are formed, or after normal desalting, carried out on the formed host tabular grains. It is preferable that the protrusion formation be carried out immediately after the formation of host tabular grains.

In the present invention, it is preferable that a site director is used to form a protrusion portion. A variety of site directors can be used, and a sensitizing dye is preferably used as the site director. The deposition position of epitaxial can be controlled by the selection of the amount and type of dye used. The addition amount of dye is preferably 50% to 90% of a saturated covering amount. Usable dyes involve a cyanine dye, merocyanine dye, composite cyanine dye, composite merocyanine dye, holopolar cyanine dye, hemicyanine dye, styryl dye, and hemioxonole dye. Most useful dyes are those belonging to a cyanine dye. Any nucleus commonly used as a basic heterocyclic nucleus in cyanine dyes can be applied to these dyes. Examples of an applicable nucleus are a pyrroline nucleus, oxazoline nucleus, thiozoline nucleus, pyrrole nucleus, oxazole nucleus, thiazole nucleus, selenazole nucleus, imidazole nucleus, tetrazole nucleus, and pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, benzindolenine nucleus, indole nucleus, benzoxadole nucleus, naphthoxazole nucleus, benzothiazole nucleus, naphthothiazole nucleus, benzoselenazole nucleus, benzimidazole nucleus, and quinoline nucleus. These nuclei can have a substituent on a carbon atom.

Although these sensitizing dyes can be used singly, they can also be used together. The combination of sensitizing dyes is often used for a supersensitization purpose. Representative examples of the combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patent Nos. 1,344,281 and 1,507,803, Jpn. Pat. Appln. KOKOKU Publication No. (hereinafter referred to as JP-B-)43-4936 and JP-B-53-12375, and JP-A's-52-110618 and 52-109925.

In addition to the sensitizing dyes, dyes having no spectral sensitizing effect or substances not substantially absorbing visible light and presenting supersensitization can be simultaneously or separately added.

In relation to the method for forming a protrusion portion, an embodiment wherein a spectral sensitizing dye is added as a site director prior to formation of the protrusion portion is preferable. An embodiment wherein a spectral sensitizing dye is further added after the protrusion portion is formed is more preferable. The further added dye acts to stably-maintain a protrusion portion, and is advantageous in further enhancing the sensitivity. In this case, a dye of the same kind as the spectral sensitizing dye used before the protrusion portion formation may be used, or a dye of another kind may be contained.

In the epitaxial emulsion of the present invention, the site director added prior to formation of the protrusion portion and/or the compound further added after formation of the protrusion portion preferably comprises at least one of the compounds represented by the following formula (DYE-I).

Formula (DYE-I)

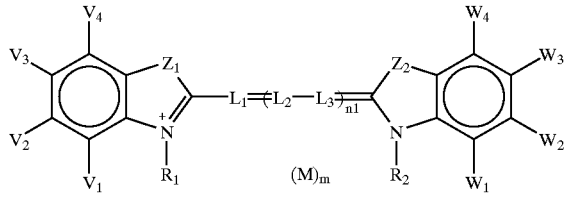

In the formula (DYE-I), $Z_1$ and $Z_2$ independently represent an oxygen atom, a sulfur atom, a selenium atom, a tellurium atom, or a >NR group. R represents an alkyl group, an aryl group, or a heterocyclic group. Each of $L_1$, $L_2$ and $L_3$ independently represents a methine group, and n1 is 0, 1, 2 or 3. Each of $V_1$, $V_2$, $V_3$, $V_4$, $W_1$, $W_2$, $W_3$, and $W_4$ independently represents a hydrogen atom or a substituent. Two substituents may be bonded to each other to form a ring. If the sum of the π value of the substituents $V_1$ to $V_4$ is regarded as πV, and the sum of the π value of the substituents $W_1$ to $W_4$ is regarded as πW, either of the πV or πW is 0.70 or less. M represents a charge-balanced counter ion, and m represents a number needed for neutralizing the charge of a molecule. $R_1$ represents an alkyl group, an aryl group, and a heterocyclic group. $R_2$ represents a substituent represented by any of the following formulae:

$-(La)_{ka}CONHSO_2Ra$;

$-(Lb)_{kb}SO_2NHCORb$;

$-(Lc)_{kc}CONHCORc$;

$-(Ld)_{kd}SO_2NHSO_2Rd$; and $-(Le)_{ke}COOH$

In the formulae, Ra, Rb, Rc and Rd independently represent an alkyl group, an aryl group, a heterocyclic group, an alkoxy group, an aryloxy group, heterocycloxy group, or an amino group. La, Lb, Lc, Ld and Le independently represent a methylene group, and ka, kb, kc, kd and ke independently represent integers equal to or more than 1.

The compounds of the formula (DYE-I) used in the present invention will be specifically explained below.

$Z_1$ and $Z_2$ independently represent an oxygen atom, a sulfur atom, a selenium atom, a tellurium atom, or a >NR group. R represents an alkyl group, an aryl group, or a heterocyclic group. $R_1$ represents an alkyl group, an aryl group, or a heterocyclic group.

Examples of the alkyl group represented by R and $R_1$ are an unsubstituted alkyl group having 1 to 8, and preferably 1 to 4, carbon atoms (for example, methyl, ethyl, propyl, isopropyl, butyl, isobutyl, and hexyl), and an alkyl group having 1 to 8, and preferably 1 to 4, carbon atoms, substituted by the following V. Examples of V includes a halogen atom (for example, chlorine, bromine, iodine or fluorine), a mercapto group, a cyano group, a carboxyl group, a phosphoric acid group, a sulfo group, a hydroxy group, a carbamoyl group having 1 to 7 carbon atoms, preferably 2 to 3 carbon atoms (for example, methylcarbamoyl, ethylcarbamoyl or morpholinocarbonyl), a sulfamoyl group having 0 to 7 carbon atoms, preferably 2 to 5 carbon atoms, and more preferably 2 to 3 carbon atoms (for example, methylsulfamoyl, ethylsulfamoyl or piperidinosulfonyl), a nitro group, an alkoxy group having 1 to 5 carbon atoms, preferably 1 to 3 carbon atoms (for example, methoxy, ethoxy, 2-methoxyethoxy or 2-phenylethoxy), an aryloxy group having 6 to 11 carbon atoms (for example, phenoxy, p-methylphenoxy, p-chlorophenoxy or naphthoxy), an acyl group having 1 to 7 carbon atoms, preferably 2 to 5 carbon atoms, and more preferably 2 to 3 carbon atoms (for example, acetyl, benzoyl or trichloroacetyl), an acyloxy group having 1 to 7 carbon atoms, preferably 2 to 5 carbon atoms, and more preferably 2 to 3 carbon atoms (for example, acetyloxy or benzoyloxy), an acylamino group having 1 to 7 carbon atoms, preferably 2 to 5 carbon atoms, and more preferably 2 to 3 carbon atoms (for example, acetylamino), a sulfonyl group having 1 to 7 carbon atoms, preferably 1 to 5 carbon atoms, and more preferably 1 to 3 carbon atoms (for example, methanesulfonyl, ethanesulfonyl or benzenesulfonyl), a sulfinyl group having 1 to 7 carbon atoms, preferably 1 to 5 carbon atoms, and more preferably 1 to 3 carbon atoms (for example, methanesulfinyl or benzenesulfinyl), a sulfonylamino group having 1 to 7 carbon atoms, preferably 1 to 5 carbon atoms, and more preferably 1 to 3 carbon atoms (for example, methanesulfonylamino, ethanesulfonylamino or benzenesulfonylamino), an amino group, a substituted amino group having 1 to 7 carbon atoms, preferably 1 to 5 carbon atoms, and more preferably 1 to 3 carbon atoms (for example, methylamino, dimethylamino, benzylamino, or anilino), an ammonium group having 0 to 7 carbon atoms, preferably 0 to 5 carbon atoms, and more preferably 0 to 3 carbon atoms (for example, trimethylammonium or triethylammonium), a hydrazino group having 0 to 7 carbon atoms, preferably 1 to 5 carbon atoms, and more preferably 1 to 3 carbon atoms (for example, trimethylhydrazino), a ureido group having 1 to 7 carbon atoms, preferably 1 to 5 carbon atoms, and more preferably 1 to 3 carbon atoms (for example, ureido or N,N-dimethylureido), an imido group having 1 to 7 carbon atoms, preferably 1 to 5 carbon atoms, and more preferably 1 to 3 carbon atoms (for example, succinimido), an alkyl- or arylthio group having 1 to 7 carbon atoms, preferably 1 to 5 carbon atoms, and more preferably 1 to 3 carbon atoms (for example, methylthio, ethylthio, carboxyethylthio, sulfobutylthio or phenylthio), an alkoxycarbonyl group having 2 to 7 carbon atoms, preferably 2 to 5 carbon atoms, and more preferably 2 to 3 carbon atoms (for example, methoxycarbonyl, ethoxycarbonyl or benzyloxycarbonyl), an aryloxycarbonyl group having 7 to 10 carbon atoms (for example, phenoxycarbonyl), an unsubstituted alkyl group having 1 to 7 carbon atoms, preferably 1 to 5 carbon atoms, and more preferably 1 to 3 carbon atoms (for example, methyl, ethyl, propyl or butyl), a substituted alkyl group having 1 to 7 carbon atoms, preferably 1 to 5 carbon atoms, and more preferably 1 to 3 carbon atoms (for example, hydroxymethyl, trifluoromethyl, benzyl, carboxyethyl, ethoxycarbonylmethyl or acetylaminomethyl; provided that the substituted alkyl groups include an unsaturated hydrocarbon group preferably having 2 to 7 carbon atoms, more preferably 2 to 5 carbon atoms, and most preferably 2 to 3 carbon atoms (for example, vinyl, ethynyl, 1-cyclohexenyl, benzylidyne or benzylidene)), a substituted or unsubstituted aryl group having 6 to 7 carbon atoms (for example, phenyl, p-carboxyphenyl, p-nitrophenyl, 3,5-dichlorophenyl, p-cyanophenyl, m-fluorophenyl or p-tolyl) and a heterocyclic group that may be substituted, having 1 to 7 carbon atoms, preferably 2 to 5 carbon atoms (for example, pyridyl, 5-methylpyridyl, thienyl, furyl, morpholino or tetrahydrofurfuryl; provided that two substituents of the heterocyclic group may be bonded to form a benzene ring, naphthalene ring, or anthracene ring or a heterocyclic ring, thereby to form a fused ring structure).

Examples of the aryl group represented by R and $R_1$ are an unsubstituted aryl group having 6 to 20, preferably 6 to 10, and more preferably, 6 to 8 carbon atoms (for example, a phenyl group, or an 1-naphthyl group), a substituted aryl group having 6 to 20, preferably 6 to 10, and more preferably, 6 to 8 carbon atoms (for example, the aforementioned aryl group in which V is substituted. More specifically, a p-methoxyphenyl group, p-methylphenyl group, p-chlorophenyl group, etc.).

Examples of the heterocyclic group represented by R and $R_1$ are an unsubstituted heterocyclic group having 1 to 20, preferably 3 to 10, and more preferably, 4 to 8 carbon atoms (for example, a 2-furyl, 2-thienyl, 2-pyridyl, 3-pyrazolyl, 3-isoxazolyl, 3-isothiazolyl, 2-imidazolyl, 2-oxazolyl, 2-thiazolyl, 2-pyridazyl, 2-pyrimidyl, 3-pyrazyl, 2-(1,3,5-triazolyl), 3-(1,2,4-triazolyl), 5-tetrazolyl), and a substituted heterocyclic group having 1 to 20, preferably 3 to 10, and more preferably, 4 to 8 carbon atoms (for example, the aforementioned heterocyclic group in which V is substituted. More specifically, a 5-methyl-2-thienyl, 4-methoxy-2-pyridyl, etc.).

R preferably represents an alkyl group, more preferably, a substituted or unsubstituted alkyl group having 1 to 6 carbon atoms, and more preferably, an unsubstituted alkyl group having 1 to 4 carbon atoms.

$Z_1$ and $Z_2$ preferably represent an oxygen atom or a sulfur atom. At least one of $Z_1$ and $Z_2$ preferably represents a sulfur atom.

$R_1$ preferably represents an alkyl group, and preferably contains an acidic group (for example, a sulfo group, carboxyl group, sulfato group, phosphono group, boron group, or each substituent represented by $R_2$). More preferably, $R_1$ represents an alkyl group having 1 to 6 carbon atoms, and containing a sulfo group, and especially preferably, a sulfoalkyl group having 2 to 4 carbon atoms.

The methine group represented by $L_1$, $L_2$ and $L_3$ may be unsubstituted or substituted. Examples of the substituent in the case of the methine group being substituted, are the same substituent as those of the aforementioned substituent V. n1 is 0, 1 or 2. If n1 is 2, two pairs of $L_2$ and $L_3$ may be the same or different. The two methine groups may be bonded to each other to form a ring. Preferably, n1 is 1, $L_1$ and $L_3$ represent an unsubstituted methine group, and $L_2$ represents a methine group substituted by an alkyl group. The alkyl group on the methine group represented by $L_2$ may preferably be a substituted or unsubstituted alkyl group having 1 to 4 carbon atoms, and especially preferably, methyl or ethyl.

Each of $V_1$, $V_2$, $V_3$, $V_4$, $W_1$, $W_2$, $W_3$, and $W_4$ independently represents a hydrogen atom or a substituent. Two of the substituents may be bonded to each other to form a fused ring.

The definition of a $\pi$ value in the present invention will be explained. The $\pi$ value is a parameter showing the influence of a substituent upon the hydrophilicity/hydrophobicity of a compound molecule, and is defined by the following formula:

$$\pi = \log P(PhX) - \log P(PhH).$$

In the above formula, P represents a distribution coefficient of a compound to octanol/water. The difference between the log P value of the substituted benzene PhX and the log P value of the benzene PhH is assigned as the $\pi$ value of the substituent X. The log P value can be determined by the method of the following publication (a), and also can be determined by the fragment method described in the publication (a) or by calculation using a software package described in the publication (b). If the actual value does not correspond to the calculated value, the actually measured π value is used in principle.

(a) C. Hansch, A. J. Leo, "Substituent Constants for Correlation Analysis in Chemistry and Biology", John Wiley & Sons, New York, 1979

(b) Medichem software package (Ver. 3.54, developed and sold by Pomona College, Claremont, Calif.)

If the $V_1$ and $V_2$ are bonded to each other to form a naphthoazole ring system, the π value to be assigned to $V_1$ and $V_2$ is determined as follows, by regarding —CH═CH—CH═CH— as a substituent. The same applies to another fused ring.

$$\pi(\text{—(CH)}_4\text{—})=\log P(\text{naphthalene})-\log P(\text{benzene})=1.32$$

The π value for each substituent thus determined is listed in the publication (a). Main π values excerpted are shown below.

| Substituent | π value |
|---|---|
| OH | −0.67 |
| CN | −0.57 |
| $COCH_3$ | −0.55 |
| COOH | −0.32 |
| $OCH_3$ | −0.02 |
| $COOCH_3$ | −0.01 |
| H | 0.00 |
| F | 0.14 |
| $CH_3$ | 0.56 |
| Cl | 0.71 |
| Br | 0.86 |
| I | 1.12 |
| —$(CH)_4$— | 1.32 |
| $C_6H_5$ | 1.96 |

In the present invention, if the sum of the π value of the substituents $V_1$ to $V_4$ is regarded as πV, and the sum of the π value of the substituents $W_1$ to $W_4$ is regarded as πW, either of the πV or πW needs to be 0.70 or less. The sum of the πV and πW is preferably 1.40 or less. More preferably, either of the πV or πW is 0.70 or more, and the other is 0.70 or less, and especially preferably, one is 0.70 or more and 1.40 or less and the other is 0.00 or more and 0.70 or less. The πV is preferably 0.70 or less, and πW is 0.70 or more, and most preferably, πV is 0.00 or more and 0.70 or less, and πW is 0.70 or more and 1.40 or less.

In the substituent represented by $R_2$, each of Ra, Rb, Rc and Rd represents an alkyl group, an aryl group, a heterocyclic group, an alkoxy group, an aryloxy group, heterocycloxy group, or an amino group. Examples thereof are as follows:

an unsubstituted alkyl group having 1 to 18, preferably 1 to 10, and more preferably 1 to 5 carbon atoms (for example, methyl, ethyl, propyl, butyl); a substituted alkyl group having 1 to 18, preferably 1 to 10, and more preferably 1 to 5 carbon atoms (for example, hydroxymethyl, trifluoromethyl, benzyl, carboxyethyl, ethoxycarbonylmethyl, acetylaminomethyl, where an unsaturated hydrocarbon group preferably having 2 to 18 carbon atoms, more preferably 3 to 10, and especially preferably 3 to 5 carbon atoms (for example, vinyl, ethinyl, 1-cyclohexenyl, benzylidyne, benzylidene) is included in the substituted alkyl group); a substituted or unsubstituted aryl group having 6 to 20, preferably 6 to 15, and more preferably 6 to 10 carbon atoms (for example, phenyl, 1-naphthyl, p-carboxyphenyl, p-nitrophenyl, 3,5-dichlorophenyl, p-cyanophenyl, m-fluorophenyl, p-tolyl); a heterocyclic group which may be substituted, having 1 to 20, preferably 2 to 10, and more preferably 4 to 6 carbon atoms (for example, pyridyl, 5-methylpyridyl, thienyl, furyl, morpholino, tetrahydrofurfuryl); an alkoxy group having 1 to 10, and preferably 1 to 8 carbon atoms (methoxy, ethoxy, 2-methoxyethoxy, 2-hydroxyethoxy, 2-phenylethoxy); and an aryloxy group having 6 to 20, preferably 6 to 12, and more preferably 6 to 10 (for example, phenoxy, p-methylphenoxy, p-chlorophenoxy, naphthoxy), a heterocyclyloxy group having 1 to 20, preferably 3 to 12, and more preferably 3 to 10 carbon atoms (for example, 2-thienyloxy, 2-morpholinoxy). Examples of the amino group are an amino group having 0 to 20, preferably 0 to 12, and more preferably 0 to 8 carbon atoms (for example, amino, methylamino, dimethylamino, ethylamino, diethylamino, hydroxyethylamino, benzylamino, anilino, diphenylamino, cyclic morpholino, pyrrolidino). Further, these may be substituted by the aforementioned substituent V. As $R_2$, methyl, ethyl, and hydroxyethyl are more preferable, and methyl is especially preferable.

The methylene group represented by La, Lb, Lc, Ld and Le may be unsubstituted or substituted. Examples of the substituent are not particularly limited. However, the aforementioned substituent V is preferable. Specific examples of the substituted methylene group are methyl-substituted methylene group, ethyl-substituted methylene group, phenyl-substituted methylene group, hydroxy-substituted methylene group, halogen(for example, chlorine, bromine)-substituted methylene group. The unsubstituted methylene group is preferable.

ka, kb, kc, kd and ke independently represent integers equal to or more than 1, preferably 1 to 4, more preferably 1 or 2, and especially preferably 1. If ka, kb, kc, kd and ke represent 2 or more, the repeated La, Lb, Lc, Ld and Le need not be the same.

Although the dissociation groups NH and OH of $R_2$ are expressed in an undissociated form, they may be in a dissociated form ($N^-$ and $O^-$, respectively). In actuality, whether the dyes are dissociated or not depends on the atmosphere, such as pH value, etc, in which the dyes are present. The dissociation groups are expressed as $N^-$, for example, if they are in a dissociated state. If a cation compound (for example, a sodium ion) is present as a counter ion, it is expressed as $N^-Na^+$. Even if it is in an undissociated state, it can be expressed as $N^-H^+$ if only the cation compound of the counter ion is regarded as proton.

Preferable examples of $R_2$ are shown below, each of which are expressed in an undissociated form.

R2a=—$CH_2CONHSO_2CH_3$

R2b=—$CH_2COOH$

R2c=—$CH_2SO_2NHCOCH_3$

R2d=—$CH_2CONHCOCH_3$

R2e=—$CH_2SO_2NHSO_2CH_3$

R2f=—$(CH_2)_2CONHSO_2CH_3$

R2g=—$(CH_2)_2COOH$

R2h=—$(CH_2)_2SO_2NHCOCH_3$

R2i=—$(CH_2)_2CONHCOCH_3$

R2j=—$(CH_2)_2SO_2NHSO_2CH_3$

Of the above examples, those listed towards the top are preferable, and R2a or R2b is especially preferable.

M is included in the formula in order to indicate the presence of a cation or anion, when it is required for neutralizing an ionic charge. Whether a dye is a cation or anion, or whether the dye has a net ionic charge, depends on the substituent. Examples of the typical cation are an inorganic cation, such as a hydrogen ion, alkali metal ion (a sodium ion, potassium ion, lithium ion), and an alkaline-earth metal ion (for example, a calcium ion), and an organic cation, such as an ammonium ion (for example, an ammonium ion, tetraalkylammonium ion, pyridinium ion, ethylpyridinium ion). The anion may be an inorganic anion or organic anion. Examples of the anion are a halide anion (for example, a fluoride ion, chloride ion, bromide ion, iodide ion), a substituted arylsulfonate ion (for example, a p-toluenesulfonate ion, p-chlorobenzenesulfonate ion), an aryl disulfonate ion (an 1,3-benzenedisulfonate ion, 2,6-naphthalenedisulfonate ion), an alkylsulfate ion (for example, a methylsulfate ion), a sulfate ion, a thiocyanate ion, a perchlorate ion, a tetrafluoroborate ion, a picrate ion, an acetate ion, and a trifluoromethansulfonate ion. Preferable cations are a sodium ion, potassium ion, a triethylammonium ion, a tetraethylammonium ion, a pyridinium ion, an ethylpyridinium ion, and a methylpyridinium ion. Preferable anions are a perchlorate ion, an iodide ion, a bromide ion, and a substituted arylsulfonate ion (for example, a p-toluenesulfonate ion).

m represents a number 0, or more, needed for neutralizing the charge of a molecule. If an intramolecular salt is formed, m is 0. m is preferably 0 or more and 4 or less.

Further, the compound represented by the formula (DYE-I) is preferably selected from the compounds represented by the following formula (DYE-II) or formula (DYE-III):

Formula (DYE-II)

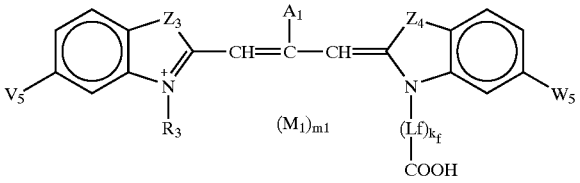

Formula (DYE-III)

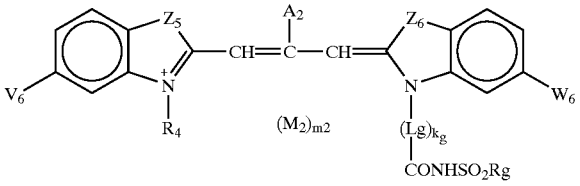

The compound of the formula (DYE-II) will be specifically explained below. $Z_3$ and $Z_4$ independently represent an oxygen atom or a sulfur atom. At least one of $Z_3$ and $Z_4$ preferably represents a sulfur atom, and more preferably, both of them represent a sulfur atom. A1 represents a hydrogen atom or an alkyl group. Preferable examples of the alkyl group are an unsubstituted or substituted alkyl group represented by the aforementioned R. A substituted or unsubstituted alkyl group having 1 to 4 carbon atoms is more preferable, and methyl or ethyl is especially preferable.

One of $V_5$ and $W_5$ represents a substituent selected from a hydrogen atom, fluorine atom, methyl group, methylthio group, ethoxy group, ethoxycarbonyl group, 2-pyridyl group, and 4-pyridyl group, and preferably, a hydrogen atom or fluorine atom. The other represents a substituent selected from a chlorine atom, bromine atom, iodide atom, trifluoromethyl group, ethyl group, benzoyl group, and 1-pyrrolyl group, and preferably, a chlorine atom or bromine atom.

The alkyl group represented by $R_3$, containing a sulfo group as a substituent, may contain a substituent other than a sulfo group. For example, as in a sulfopropyloxyethyl group, oxygen and other non-carbon atomic group may be sandwiched between a sulfo group and an alkyl group. $R_3$ preferably represents an alkyl group directly substituted by a sulfo group, and especially preferably, 3-sulfopropyl group, 3-sulfobutyl group, and 4-sulfobutyl group. Preferable examples of the methylene group represented by Lf are the same as the aforementioned La, and more preferably, an unsubstituted methylene group. kf represents an integer of 1 to 3, preferably 1 or 2, and especially preferably 1. $M_1$ and $m_1$ have the same meaning as M and m in general formula (DYE-I), respectively.

The compound of the formula (DYE-III) will be specifically explained below. $Z_5$ and $Z_6$ independently represent an oxygen atom or a sulfur atom. At least one of $Z_5$ and $Z_6$ preferably represents a sulfur atom, and more preferably, both of them represent a sulfur atom. $A_2$ represents a hydrogen atom or an alkyl group. Preferable examples of the alkyl group are an unsubstituted or substituted alkyl group represented by the aforementioned R. A substituted or unsubstituted alkyl group having 1 to 4 carbon atoms is more preferable, and methyl or ethyl is especially preferable.

$V_6$ represents a substituent selected from a hydrogen atom, fluorine atom, mercapt group, methyl group, methylthio group, ethoxy group, ethoxycarbonyl group, 2-pyridyl group, and 4-pyridyl group, preferably, a hydrogen atom or fluorine atom, and especially preferably, a fluorine atom. $W_6$ represents a substituent selected from a chlorine atom, bromine atom, iodide atom, trifluoromethyl group, ethyl group, benzoyl group, and 1-pyrrolyl group, preferably, a chlorine atom or bromine atom, and especially preferably a chlorine atom.

$R_4$ represents an alkyl group containing a sulfo group as a substituent, and preferable examples thereof are the same as the aforementioned $R_3$. $R_4$ preferably represents an alkyl group directly substituted by a sulfo group, and especially preferably, 3-sulfopropyl group, 3-sulfobutyl group, and 4-sulfobutyl group. Preferable examples of the alkyl group represented by Rg are the same as the aforementioned Ra. Rg preferably represents methyl or ethyl, and especially preferably methyl. Preferable examples of the methylene group represented by Lg are the same as the aforementioned Le. Rg preferably represents an unsubstituted methylene group. kg represents an integer of 1 to 3, preferably 1 or 2, and especially preferably 1. $M_2$ and m2 have the same meaning as M and m of general formula (DYE-I), respectively.

Specific examples of the compounds represented by the formulae (DYE-I), (DYE-II) and (DYE-III) of the present invention will be shown below. However, the present invention is not limited to these examples.

DYE-I-1
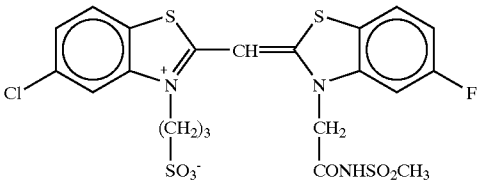
DYE-I-2
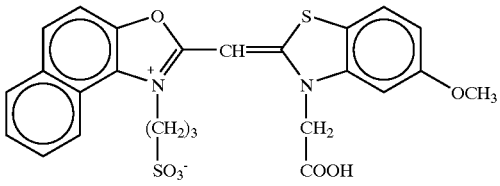
DYE-I-3
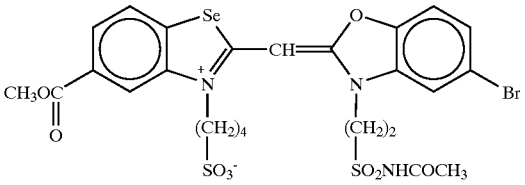
DYE-I-4
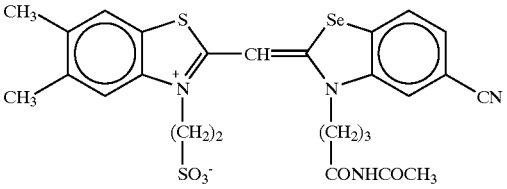
DYE-I-5
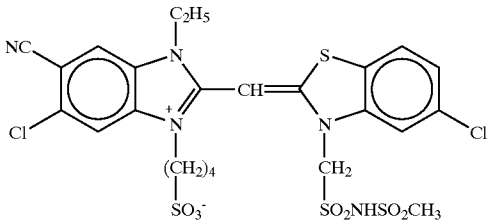
DYE-I-6
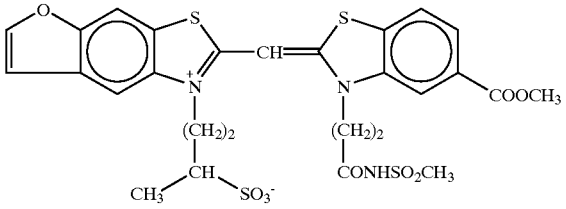
DYE-I-7
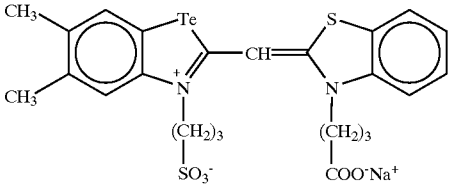
DYE-I-8
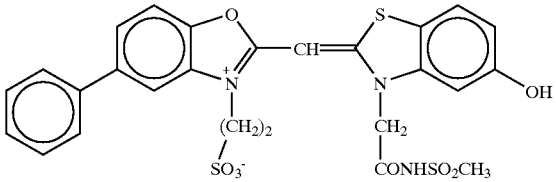
DYE-I-9
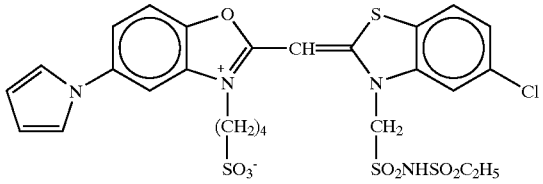
DYE-I-10
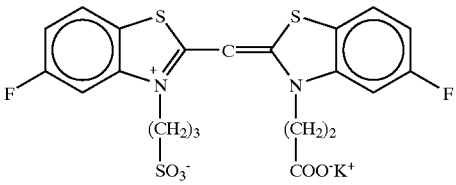
DYE-I-11
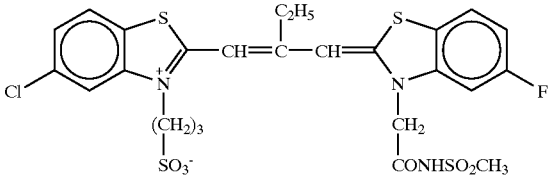
DYE-I-12
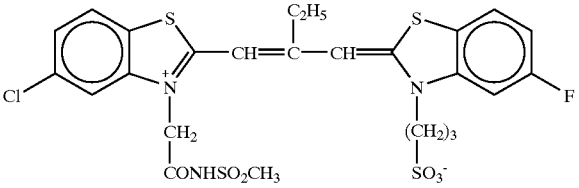
DYE-I-13
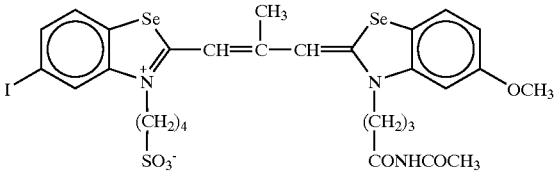
DYE-I-14
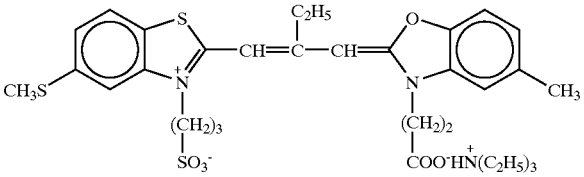

-continued
DYE-I-15
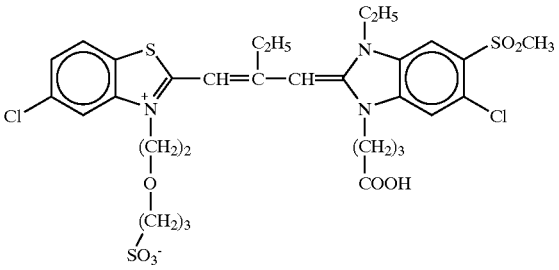
DYE-I-16
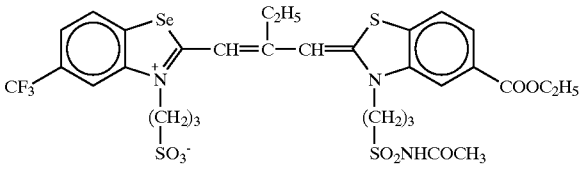
DYE-I-17
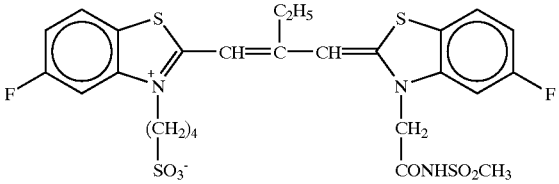
DYE-I-18
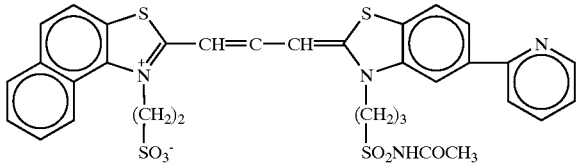
DYE-I-19
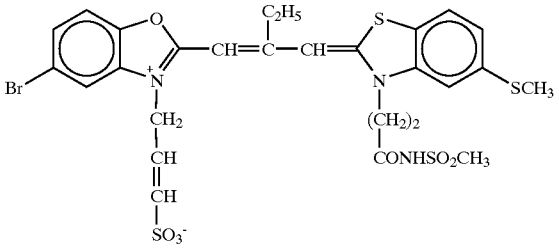
DYE-I-20
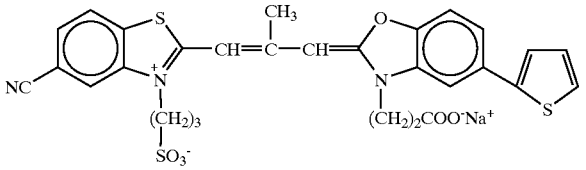
DYE-I-21
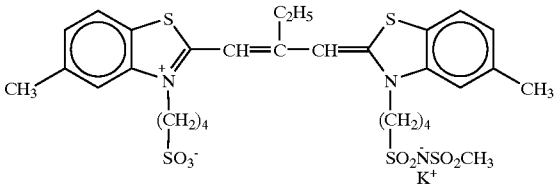
DYE-I-22
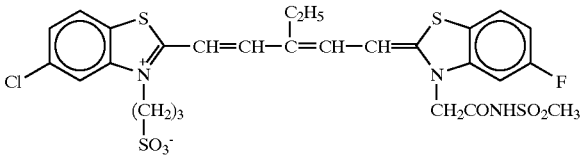
DYE-I-23
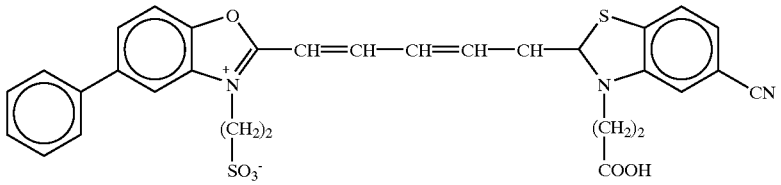
DYE-I-24
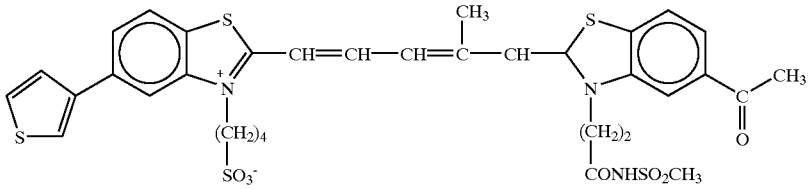

-continued
DYE-I-25
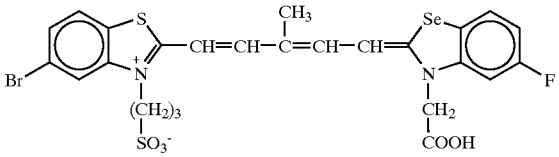
DYE-I-26
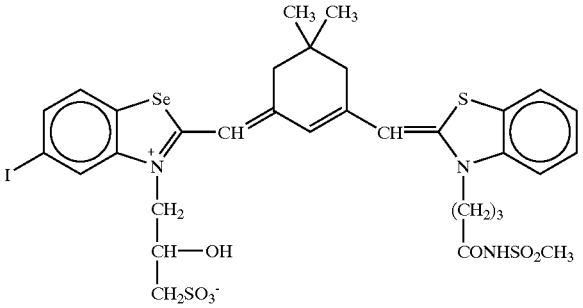
DYE-I-27
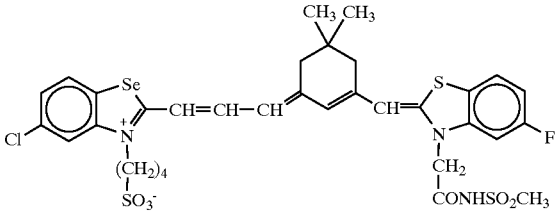
DYE-II-1
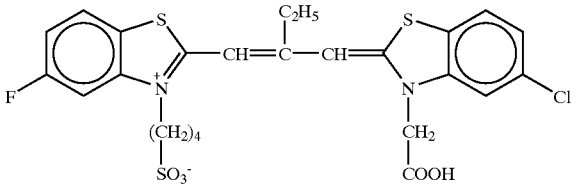
DYE-II-2
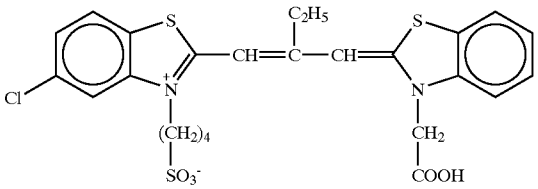
DYE-II-3
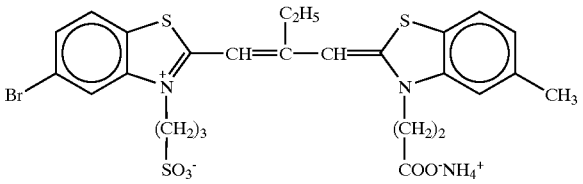
DYE-II-4
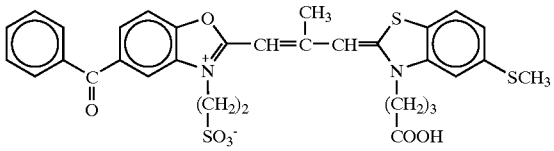
DYE-II-5
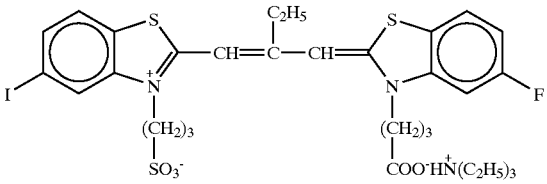
DYE-II-6
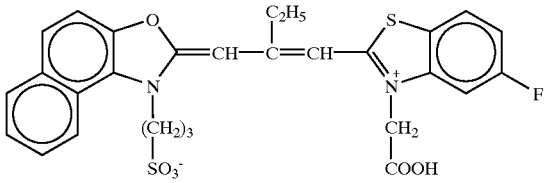
DYE-III-1
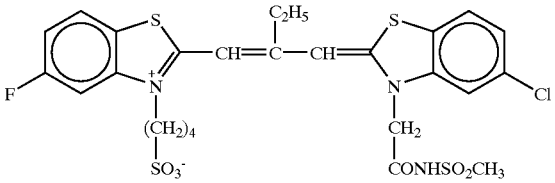
DYE-III-2
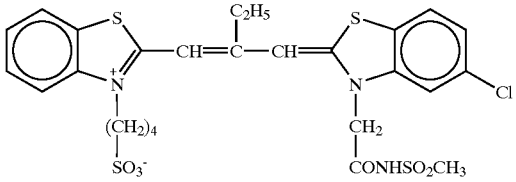
DYE-III-3
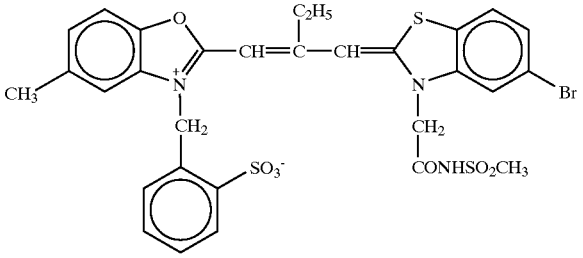

-continued

DYE-III-4

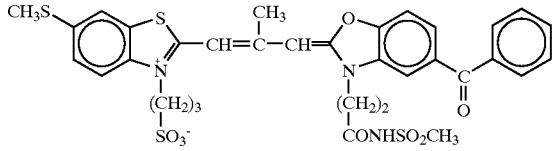

DYE-III-5

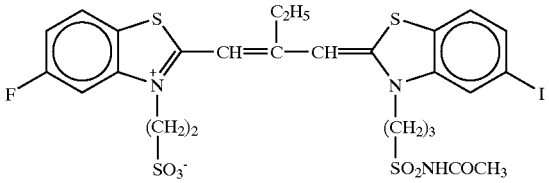

The compounds represented by the formulae (DYE-I), (DYE-II) and (DYE-III) of the present invention can be synthesized based on the methods described in the following publications.

a) F. M. Harmer, "Heterocyclic Compounds-Cyanine dyes and related compounds", John Wiley & Sons, New York, London, 1964;

b) D. M. Sturmer, "Heterocyclic Compounds-Special topics in heterocyclic chemistry", Section 8, Item 4, pp. 482 to 515, John Wiley & Sons, New York, London, 1977; and c) "Rodd's Chemistry of Carbon Compounds", Ver. 2, Vol. 4, Part B, Section 15, pp. 369 to 422, Elsevier Science Publishing Company Inc., New York, 1977.

The silver halide protrusion portion of the present invention can be formed by the addition of a solution containing silver nitrate. A method of simultaneously adding an aqueous silver nitrate solution and a halide solution is often used. However, the halide solution and silver nitrate solution can be added separately. The protrusion portion can be formed by the addition of silver bromide fine grains, silver iodide fine grains, and silver chloride fine grains having a grain size smaller than the thickness of the host tabular grain, or the addition of fine grains consisting of the mixed crystals thereof. In the case of the method of simultaneously adding an aqueous silver nitrate solution and a halide solution, a method of adding the solutions while maintaining the pBr of the system constant is preferable. It is preferable that the time for adding the silver nitrate solution is preferably from 30 seconds or more and 30 minutes or less, and more preferably from 1 minute or more and 20 minutes or less. The concentration of the silver nitrate solution is preferably 1.5 mol/liter or less, and more preferably, 0.5 mol/liter or less (hereinafter liter is also referred to as "L").

The pBr at the time of forming a silver halide protrusion portion is 3.5 or more, and more preferably 4.0 or more. The temperature at which the formation is carried out is preferably from 35° C. or more and 45° C. or less. The pH is preferably from 3 or more and 8 or less.

To make the protrusion portion contain a pseudo halide can be achieved by adding a pseudo halide salt before or during the formation of a protrusion portion, or containing a pseudo halide salt in the aqueous halide solution to be added at the same time as the silver nitrate. For example, it can be achieved by using KCN, KSCN, KSeCN, etc.

In the present invention, the pseudo halide content of the protrusion portion can be determined by the following method.

The tabular silver halide grain in the silver halide photographic lightsensitive material is extracted by processing the lightsensitive material with protease, and centrifuging the processed material. The grain is re-dispersed and laid on a support film on a copper mesh. Spot analysis of the protrusion portion of the grain, in which the spot diameter is stopped down to 2 nm or less, is performed using an analytical electron microscope, thereby determining the pseudo halide content. The silver halide grain whose content is already known is processed in the same manner, and the ratio of the characteristic X-ray intensity originated form Ag to the characteristic X-ray intensity originated form pseudo halide is determined in advance as a calibration curve. Thereby, the pseudo halide content can be determined. In the case of $SCN^-$, for example, the content can be determined from the ratio of the characteristic X-ray intensity originated from Ag to the characteristic X-ray intensity originated from S. As an analysis line source of the analytical electron microscope, a field emission-type electron gun with a higher electron density is more suitable than one using thermoelectrons. The pseudo halide content of the protrusion portion can easily be analyzed by stopping the spot diameter down to 1 nm or less. If the inter-grain variation coefficient of the pseudo halide content of the protrusion portion is 30% or less, usually 20 grains are measured and averaged to determine the pseudo halide content. If the inter-grain variation coefficient of the pseudo halide content of the protrusion portion is 20% or less, usually 10 grains are measured and averaged to determine the pseudo halide content. The inter-grain variation coefficient of the pseudo halide content of the protrusion portion is preferably 20% or less.

Next, a shallow electron-trapping zone, which the silver halide grain of the present invention has, will be explained.

The shallow electron-trapping zone in the present invention refers to a region having a function of temporarily trapping photoelectrons, during the time until photoelectrons generated by the optical pump form a latent image in a sensitizing step. There are various kinds of methods for providing the silver halide grain with such a shallow electron-trapping zone. It is desirable in the present invention that the zone is provided by a metal dopant.

Whether the metal dopant provides the shallow electron-trapping zone or not can be determined by measuring, by utilizing microwave adsorption, the life of a photoelectron generated when a test piece coated with the silver halide emulsion is radiated with pulsed laser light. If the life of the photoelectron generated by the aforementioned pulsed laser light is prolonged by containing the metal dopant in the silver halide grain, it can be judged that the dopant provides a shallow electron-trapping zone. In the preparation step of the silver halide grain used, if the life of the photoelectron becomes very short due to the introduction of many electron-trapping zones, etc., and thereby the measurement is difficult, the measurement can be facilitated by cooling the samples. Aside from this, whether the metal dopant provides the shallow electron-trapping zone or not can be known by dynamics measurement using ESR which determines electron trap depth, as reported by R. S. Eachus, R. E. Grave and M. T. Olm, in Phys.Stat.Sol(b), Vol. 88, p.705 (1978). If the trap depth determined by this method is used, the metal dopant which provides a shallow electron-trapping zone in the present invention refers to a dopant which provides a trap having a depth of 0.2 eV or less, and more preferably, 0.1 eV or less.

The metal dopant which provides a shallow electron-trapping zone in the sensitizing step preferably used in the present invention refers to a metal complex in which a ligand capable of sharply splitting d orbit on spectral chemistry series is coordinated with metal ions belonging to the first, second or third transition series. As a metal dopant which provides a shallow electron-trapping zone, a hexa-coordinated metal complex represented by the following formula (I) is especially preferable.

$$[ML_6]^{n-} \quad (I)$$

In the formula, M is iron, ruthenium, osmium, cobalt, rhodium, iridium, chromium, palladium, indium, gallium, or platinum, and n is 2, 3 or 4. $L_6$ is six coordinated complex ligands which can be selected independently.

Examples of a preferable ligand are an inorganic ligand such as CN, halide ion, SCN, NCS, $H_2O$, etc., and further, an organic ligand such as pyridine, phenanthroline, imidazole, pyrazole, etc. CN is most preferable. The six ligands may be the same or different. The number of CNs is preferably four or more, and more preferably six.

Examples of the metal dopants which provide a shallow electron-trapping zone, preferably used in the present invention, are shown below. However, the present invention is not limited to these examples.

| | |
|---|---|
| (I-1) | $[Fe(CN)_6]^{4-}$ |
| (I-2) | $[Fe(CN)_6]^{3-}$ |
| (I-3) | $[Ru(CN)_6]^{4-}$ |
| (I-4) | $[Os(CN)_6]^{4-}$ |
| (I-5) | $[Co(CN)_6]^{3-}$ |
| (I-6) | $[Rh(CN)_6]^{3-}$ |
| (I-7) | $[Ir(CN)_6]^{3-}$ |
| (I-8) | $[Cr(CN)_6]^{4-}$ |
| (I-9) | $[Fe(pyrazine)(CN)_5]^{4-}$ |
| (I-10) | $[RuCl(CN)_5]^{4-}$ |
| (I-11) | $[OsBr(CN)_5]^{4-}$ |
| (I-12) | $[RhF(CN)_5]^{3-}$ |
| (I-13) | $[IrBr(CN)_5]^{3-}$ |
| (I-14) | $[Fe(CO)(CN)_5]^{3-}$ |
| (I-15) | $[RuF_2(CN)_4]^{4-}$ |
| (I-16) | $[OsCl_2(CN)_4]^{4-}$ |
| (I-17) | $[RhI_2(CN)_4]^{3-}$ |
| (I-18) | $[IrBr_2(CN)_4]^{3-}$ |
| (I-19) | $[Ru(CN)_5(OCN)]^{4-}$ |
| (I-20) | $[Ru(CN)_5(N_3)]^{4-}$ |
| (I-21) | $[Os(CN)_5(SCN)]^{4-}$ |
| (I-22) | $[Rh(CN)_5(SeCN)]^{3-}$ |
| (I-23) | $[Ir(CN)_5(H_2O)]^{2-}$ |
| (I-24) | $[IrCl_4(H_2O)_2]^{2-}$ |
| (I-25) | $[Fe(CN)_3Cl_3]^{3-}$ |
| (I-26) | $[Ru(CO)_2(CN)_4]^{1-}$ |
| (I-27) | $[Os(CN)Cl_5]^{4-}$ |
| (I-28) | $[Ir(CN)_4(oxalate)]^{3-}$ |
| (I-29) | $[In(NCS)_6]^{3-}$ |
| (I-30) | $[Ga(NCS)_6]^{3-}$ |
| (I-31) | $[Pd(NC)_6]^{4-}$ |
| (I-32) | $[Pt(NC)_6]^{2-}$ |

As a counter cation of a hexa-coordinated complex, it is preferable to use an ion which is readily miscible in water and suited to precipitation of a silver halide emulsion. Examples of a counter ion include alkali metal ions (e.g., sodium ion, potassium ion, rubidium ion, cesium ion, and lithium ion), ammonium ion, and alkylammonium ion.

The metal complex can be added by dissolving it in water or an organic solvent. This organic solvent is preferably miscible in water. Examples of the organic solvent are alcohols, ethers, glycols, ketones, esters, and amides.

For the emulsion used in the present invention, a metal dopant which provides a deep electron-trapping zone in the sensitizing step is preferably used in combination with a metal dopant which provides a shallow electron-trapping zone in the sensitizing step described above. Whether or not the metal dopant provides such a deep electron-trapping zone can be known by measuring the life of a photoelectron, to determine whether or not the life of the electron is shortened by the introduction of metal complexes, as described above. Concerning the trap depth, ascertained from the aforementioned ESR measurement, a metal dopant having a depth of 3.5 eV or more is preferably used. Examples of a metal complex which provides a deep electron-trapping zone in the sensitizing step are ruthenium, rhodium, palladium, or iridium having a halide ion or SCN ion as a ligand, ruthenium having one or more NO, chromium having CN, etc.

In the silver halide emulsion of the present invention, the dope amount of the above metal dopant in the silver halide grains is within the range of approximately $10^{-9}$ to $10^{-2}$ mol per mol of a silver halide. Specifically, the metal complex which provides a shallow electron-trapping zone in the sensitizing step is used preferably within the range of $10^{-8}$ to $10^{-2}$ mol per mol of a silver halide, and the metal complex which provides a deep electron-trapping zone in the sensitizing step is used preferably within the range of $10^{-9}$ to $10^{-3}$ mol per mol of a silver halide.

The dope location of the metal dopant which provides a shallow electron-trapping zone can be varied. That is, the metal dopant can be doped into the host tabular grain, into the epitaxially junctioned protrusion portion, or can be doped into both. If the dopant is doped into the host tabular grain, it may be doped uniformly therein, or be localized in the grain or on the surface. In addition, the dopant can be doped immediately below the surface at a very shallow depth, close to the grain surface. Further, in the case of a silver halide grain having a structure within the grain as described above, the different dopants are preferably doped into the respective regions with different compositions.

There are various methods for doping the metal dopant which provides a shallow electron-trapping zone in the silver halide grain. For example, the following methods can be chosen, if necessary: a method of containing the dopant in the halide solution used to form the host grain or protrusion portion; a method of adding the solution containing the dopant to a reaction vessel, in which host grain growth or protrusion portion formation is carried out, while controlling or not controlling the flow velocity of the solution; and a method of providing a dopant in advance to the silver halide grain or the site director to be added to a reaction vessel in which host grain growth or protrusion portion formation is carried out.

Next, the hole-trapping zone, preferably present in the silver halide grain of the present invention, will be explained.

The silver halide grain of the present invention preferably has the hole-trapping zone within the grain. The hole-trapping zone in the present invention refers to a region having a function of capturing a so-called hole, e.g., a hole generated in pairs with a photoelectron generated by the optical pump. There are various methods for providing such a hole-trapping zone. It is desirable in the present invention that the hole-trapping zone be provided by reduction sensitization.

In the present invention, the hole-trapping zone may be present within the host grain, within the epitaxially Functioned protrusion portion, or can be present in both. An embodiment wherein the hole-trapping zone is present only within the host grain is preferable. In the case of the hole-trapping zone being present within the host grain, it may be present inside the grain, on the surface of the grain, or both. However, reduction silver nuclei are easily destroyed by oxygen or moisture in the air. Thus, if an emulsion itself and a photosensitive material are to be preserved over the long term, it is preferable that the hole-trapping zone be present inside the grain.

In general, the process for manufacturing the silver halide emulsion can be broadly divided into steps, such as grain formation, desalting, chemical sensitization, etc. Grain formation is divided into nucleation, ripening, growth, etc. These steps need not necessarily be carried out in this order. The order may be reversed, or one step may be repeatedly performed. Basically the silver halide emulsion is subjected to reduction sensitization at any stage of each manufacturing step. Reduction sensitization may be performed at the time of nucleation, which is an early stage of grain formation, at the time of physical ripening, or at the time of growth. Reduction sensitization may be performed prior to chemical sensitization, other than reduction sensitization, or after chemical sensitization. In the case of performing chemical sensitization in combination with metal sensitization, it is preferable that the reduction sensitization be performed prior to chemical sensitization, so as to prevent the undesirable occurrence of fog. The method of reduction sensitization during the growth of the host grains is most preferable. The "method of reduction sensitization during the growth" includes the method of performing reduction sensitization whilst the silver halide grain is growing by physical ripening or addition of a water-soluble silver salt and water-soluble alkali halide. It also includes the method wherein during the growth, reduction sensitization is performed after a growth step is temporarily stopped, before a next growth step is initiated.

The reduction sensitization can be selected from a method of adding reduction sensitizers to a silver halide emulsion, a method called silver ripening in which grains are grown or ripened in an atmosphere of low-pAg at pAg 1 to 7, and a method called high-pH ripening in which grains are grown or ripened in an atmosphere of high-pH at pH 8 to 11. Two or more of these methods can also be used together.

The method of adding reduction sensitizers is preferable in that the level of reduction sensitization can be finely adjusted. Known examples of the reduction sensitizer are stannous salt, ascorbic acid and its derivative, amines and polyamines, a hydrazine derivative, formamidinesulfinic acid, a silane compound, and a borane compound. In the reduction sensitization used in the present invention, it is possible to selectively use these known reduction sensitizers or to use two or more types of compounds together. Preferred compounds as the reduction sensitizer are stannous chloride, thiourea dioxide, dimethylamineborane, and ascorbic acid and its derivative. Although the addition amount of the reduction sensitizers must be so selected as to meet the emulsion manufacturing conditions, a preferred amount is $10^{-7}$ to $10^{-3}$ mol per mol of a silver halide. When ascorbic acid compound is used, a suitable amount is $5\times10^{-5}$ to $10^{-1}$ mol per mol of a silver halide.

The reduction sensitizers are dissolved in water or an organic solvent, such as alcohols, glycols, ketones, esters, or amides, and the resultant solution is added during grain growth. Although adding to a reactor vessel in advance is also preferable, adding at a proper timing during grain growth is more preferable. It is also possible to add the reduction sensitizers to an aqueous solution of a water-soluble silver salt or a water-soluble alkali halide to precipitate silver halide grains by using this aqueous solution. Alternatively, a solution of the reduction sensitizers can be added separately several times or continuously over a long time period with grain growth.

In order to dispose a hole-trapping zone only inside the grain, it is effective that at least one compound selected from the compounds represented by the following formulae (I), (II) or (III) is contained.

$$R—SO_2S—M \qquad \text{Formula (I)}$$

$$R—SO_2S—M_1 \qquad \text{Formula (II)}$$

$$R—SO_2S—M_1—SSO_2—R_2 \qquad \text{Formula (III)}$$

In the formulae, R, $R_1$ and $R_2$ may be different or the same, and represent an aliphatic group, an aromatic group, or a heterocyclic group. M represents a cation, L represents a divalent linkage group, and m is 0 or 1. The compounds of formulae (I) to (III) may be a polymer containing a divalent group induced from the structure expressed by (I) to (III) as a repeating unit. In formula (II), R and $R_1$ may form a ring, and in formula (III), two of R, $R_2$ and L may be bonded to each other to form a ring.

The compounds of the formulae (I), (II) and (III) will be explained more specifically. If the R, $R_1$ and $R_2$ are an aliphatic group, the aliphatic group are a saturated or unsaturated, straight-chain, branched, or cyclic, aliphatic hydrocarbon group, and preferably, an alkyl group having 1 to 22 carbon atoms, and an alkenyl group having 2 to 22 carbon atoms and an alkynyl group having 2 to 22 carbon atoms. These groups may have a substituent. Examples of the alkyl group are methyl, ethyl, propyl, butyl, pentyl, hexyl, octyl, 2-ethylhexyl, decyl, dodecyl, hexadecyl, octadecyl, cyclohexyl, isopropyl, and t-butyl.

Examples of the alkenyl group are allyl and butenyl.

Examples of the alkynyl group are propargyl and butynyl.

The aromatic group of the R, $R_1$ and $R_2$ includes a monocyclic or condensed-ring aromatic group, and preferably, a group having 6 to 20 carbon atoms. Examples of such an aromatic group are a phenyl group and a naphthyl group. These groups may be substituted.

The heterocyclic group of the R, $R_1$ and $R_2$ are a 3- to 15-membered heterocyclic group containing at least one element selected from nitrogen, oxygen, sulfur, selenium, and tellurium. Examples of such a heterocyclic group are a pyrrolidine ring, piperidine ring, pyridine ring, tetrahydrofuran ring, thiophene ring, oxazole ring, thiazole ring, imidazole ring, benzothiazole ring, benzoxazole ring, benzimidazole ring, selenazole ring, benzoselenazole ring, tetrazole ring, triazole ring, benzotriazole ring, tetrazole ring, oxadiazole ring, and thiadiazole ring.

Examples of the substituent of the R, $R_1$ and $R_2$ are an alkyl group (such as methyl, ethyl, and hexyl), an alkoxy group (such as methoxy, ethoxy, and octyloxy), an aryl group (such as phenyl, naphthyl, and tolyl), a hydroxy group, a halogen atom (such as fluorine, chlorine, bromine, and iodine), an aryloxy group (such as phenoxy), an alkylthio group (such as methylthio, and butylthio), an arylthio group (such as phenylthio), an acyl group (such as acetyl, propionyl, butyryl, and valeryl), a sulfonyl group (such as methylsulfonyl, and phenylsulfonyl), an acylamino group (such as acetylamino, and benzamino), a sulfonylamino acid (such as methane sulfonylamino and benzene sulfonylamino), an acyloxy group (acetoxy, and benzoxy), a carboxyl group, a cyano group, a sulfo group, and an amino group.

The divalent linkage group represented by L is an atom or an atomic group containing at least one selected from C, N, S and O. To be more specific, the divalent linkage group consists either individually or in combination of an alkylene group, alkenylene group, alkynylene group, arylene group, —O—, —S—, —NH—, —CO—, —$S_2$—, etc.

L is preferably a divalent aliphatic group or a divalent aromatic group. Examples of the divalent aliphatic group of L are —$(CH_2)_n$—(n=1 to 12), —$CH_2$—CH═CH—$CH_2$—, —$CH_2$C—$CCH_2$—, and a xylylene group. Examples of the divalent aromatic group are phenylene and naphthylene.

These substituents may further be substituted by the aforementioned substituents.

M is preferably a metal ion or an organic cation. Examples of the metal ion are a lithium ion, sodium ion, and potassium ion. Examples of the organic cation are an ammonium ion (such as ammonium, tetramethylammonium, and tetrabutylammonium), a phosphonium ion (tetraphenylphosphonium), a guanidine group, etc.

The examples of the compounds represented by the formulae (I), (II) or (III) are described below. However, the compounds are not limited to these examples.

$CH_3SO_2SNa$ (I-1)

$C_2H_5SO_2SNa$ (I-2)

$C_3H_7SO_2SK$ (I-3)

$C_4H_9SO_2SLi$ (I-4)

$C_6H_{13}SO_2SNa$ (I-5)

$C_8H_{17}SO_2SNa$ (I-6)

$CH_3(CH_2)_3CH(C_2H_5)CH_2SO_2S{\bullet}NH_4$ (I-7)

$C_{10}H_{21}SO_2SNa$ (I-8)

$C_{12}H_{25}SO_2SNa$ (I-9)

$C_{16}H_{33}SO_2SNa$ (I-10)

$(CH_3)_3CH—SO_2SK$ (I-11)

t-$C_4H_9SO_2SNa$ (I-12)

$CH_3OCH_2CH_2SO_2S{\bullet}Na$ (I-13)

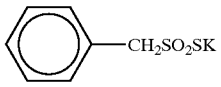

(I-14)

$CH_2{=}CHCH_2SO_2SNa$ (I-15)

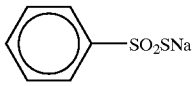

(I-16)

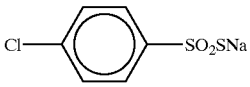

(I-17)

-continued

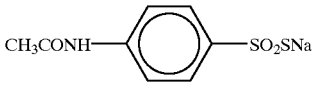

(I-18)

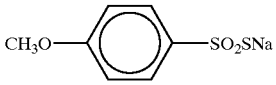

(I-19)

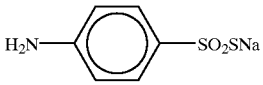

(I-20)

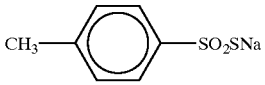

(I-21)

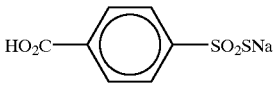

(I-22)

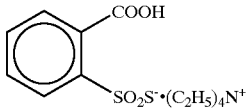

(I-23)

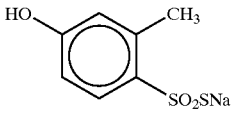

(I-24)

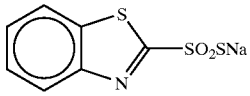

(I-25)

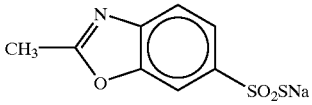

(I-26)

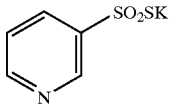

(I-27)

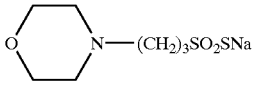

(I-28)

$KSSO_2(CH_2)_2SO_2K$ (I-29)

$NaSSO_2(CH_2)_4SO_2SNa$ (I-30)

$NaSSO_2(CH_2)_4S(CH_2)_4SO_2SNa$ (I-31)

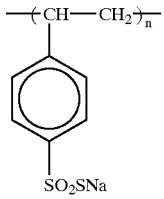

(I-32)

-continued
(I-33)
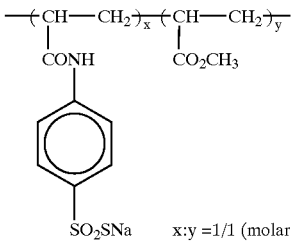
x:y =1/1 (molar ratio)
(II-1)
$C_2H_5SO_2S—CH_3$
(II-2)
$C_8H_{17}SO_2SCH_2CH_3$
(II-3)
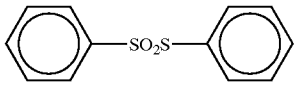
(II-4)
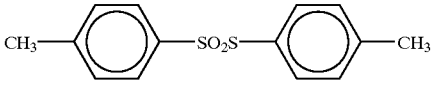
(II-5)
$C_2H_5SO_2SCH_2CH_2CN$
(II-6)
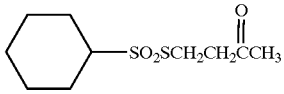
(II-7)
$C_4H_9SO_2SCH(CH_3)CH_2CN$
(II-8)
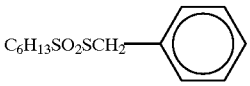
(II-9)
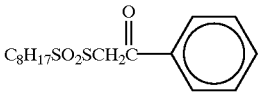
(II-10)
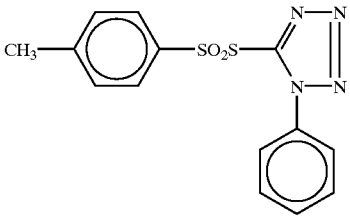
(II-11)
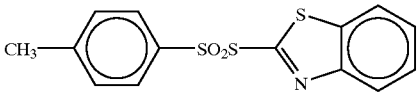
(II-12)
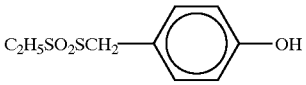
(II-13)
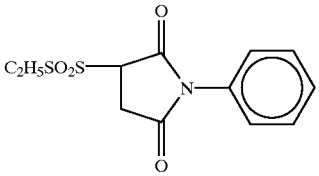
-continued
(II-14)
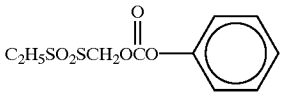
(II-15)
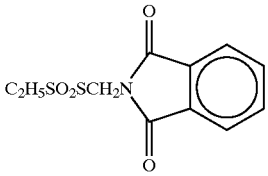
(II-16)
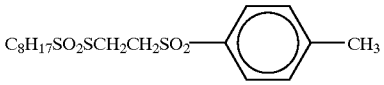
(II-17)
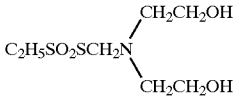
(II-18)
$C_2H_5SO_2SCH_2CH_2CH_2CH_2OH$
(II-19)
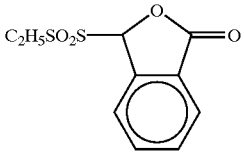
(II-20)
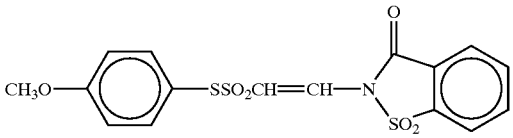
(II-21)
$CH_3SSO_2(CH_2)_4SO_2SCH_3$
(II-22)
$CH_3SSO_2(CH_2)_2SO_2SCH_3$
(II-23)
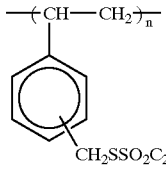
(II-24)
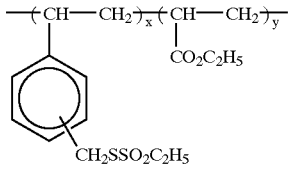
x:y =2/1 (molar ratio)
(II-25)
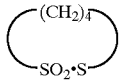
(III-1)
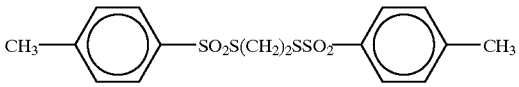
(III-2)
$C_2H_5SO_2SCH_2CH_2SO_2CH_2CH_2SSO_2C_2H_5$ -continued (III-3)

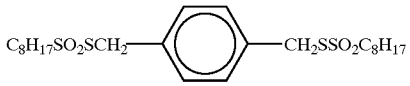

(III-4)

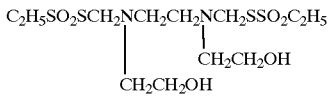

(III-5)

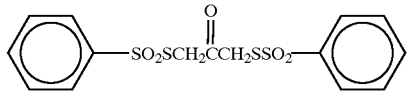

(III-6)

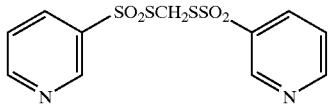

(III-7)

$C_2H_5SO_2SSSO_2C_2H_5$ (III-8)

$(n)C_3H_7SO_2SSSO_2C_3H_7(n)$ (III-9)

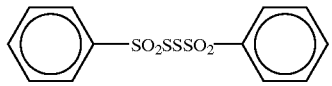

The compounds expressed by the formulae (I), (II) or (III) can easily be synthesized by the methods described in JP-A-54-1019 and GB972,211.

The amount of the compound expressed by the formulae (I), (II) or (III) to be added is preferably $10^{-7}$ to $10^{-1}$ mol per mol of a silver halide, more preferably $10^{-5}$ to $10^{-2}$ mol/molAg, and most preferably $10^{-5}$ to $10^{-3}$ mol/molAg.

In order to add the compound expressed by the formulae (I) to (III), a method commonly used in the case of adding an additive to a photographic emulsion is applicable. For example, a water-soluble compound can be added, in a suitable concentration, as an aqueous solution. A water-soluble or sparingly-water-soluble compound dissolved in a suitable water-mixable organic solvent selected from, for example, alcohols, glycols, ketones, esters, amides having no affect on the photographic properties, can be added as a solution.

The compound expressed by the formulae (I), (II) or (III) may be added at any point before or after chemical sensitization, during the grain formation of a silver halide emulsion. The method of adding the compound before or during reduction sensitization is preferable. The method of adding the compound during the grain growth is especially preferable.

Although adding to a reactor vessel in advance is also preferable, adding at a proper timing during grain growth is more preferable. It is also possible to add the compound of formula (I), (II) or (III) to an aqueous solution of a water-soluble silver salt or a water-soluble alkali halide to precipitate silver halide grains by using this aqueous solution. Alternatively, a solution containing the compound of formula (I), (II) or (III) can be added separately several times or continuously over a long time period with grain growth.

Among the compounds represented by formula (I), (II) and (III), the compound represented by formula (I) is most preferable in the present invention.

As another method of forming hole-trapping zone only inside a grain, method of using oxidizer is effective. The oxidizer can be either an inorganic or organic substance. Examples of the inorganic oxidizer are ozone, hydrogen peroxide and its adduct (e.g., $NaBO_3.H_2O_2.3H_2O$, $2NaCO_3.3H_2O_2$, $Na_4P_2O_7.2H_2O_2$, and $2Na_2SO_4.H_2O_2.2H_2O$), peroxy acid salt (e.g., $K_2S_4O_8$, $K_2C_2O_6$, and $K_4P_2O_8$), a peroxy complex compound (e.g., $K_2[TiO_2C_2O_4].3H_2O$, $4K_2SO_4\ TiO_2.OH.2H_2O$, and $Na_3[VO_2(C_2H_4)_2.6H_2O]$, permanganate (e.g., $KMnO_4$), an oxy-acid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)). Examples of the organic oxidizer are quinones such as p-quinone, an organic peroxide such as peracetic acid and perbenzoic acid, and a compound to release active halogen (e.g., N-bromosuccinimide, chloramine T, and chloramine B). Preferable amount, time and method of adding these oxidizers are the same as those of the above compounds represented by formulae (I), (II) and (III).

Oxidizers used in the present invention are preferably ozone, hydrogen peroxide and its adduct, a halogen element, thiosulfonate and quinones, further preferably, thiosulfonate compounds represented by formulae (I), (II) and (III), and most preferably, the compound represented by formula (I).

In order to form hole-trapping zone in the surface of grains, it is necessary that the aforementioned reduction sensitization is performed after forming 90% or more of the silver amount of the host grain.

Next, the chemical sensitization of the silver halide grains of the present invention will be described.

In the present invention, although the chemical sensitization can be performed either before or after desalting, it is preferable that the reduction sensitization is performed after formation of silver halide protrusion portion.

One chemical sensitization which can be preferably performed in the present invention is chalcogen sensitization, noble metal sensitization, or the combination of these. Chemical sensitization can be performed by using an active gelatin as described in T. H. James, The Theory of the Photographic Process, 4th ed., Macmillan, 1977, pp. 67 to 76. Chemical sensitization can also be performed by using any of sulfur, selenium, tellurium, gold, platinum, palladium, and iridium, or by using the combination of a plurality of these sensitizers at pAg 5 to 10, pH 5 to 8, and a temperature of 30 to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent No. 1,315,755. In noble metal sensitization, salts of noble metals, such as gold, platinum, palladium, and iridium, can be used. In particular, gold sensitization, palladium sensitization, or the combination of the two is preferred. In gold sensitization, it is possible to use known compounds, such as chloroauric acid, potassium chloroaurate, potassium aurithiocyanate, gold sulfide, and gold selenide. A palladium compound means a divalent or tetravalent salt of palladium. A preferred palladium compound is represented by $R_2PdX_6$ or $R_2PdX_4$ wherein R represents a hydrogen atom, an alkali metal atom, or an ammonium group and X represents a halogen atom, i.e., a chlorine, bromine, or iodine atom. More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. The gold compound and the palladium compound are preferably used in combination with thiocyanate or selenocyanate.

In the emulsion of the invention, gold sensitization is preferably combined. The preferable amount of the gold sensitizer is $1\times10^{-3}$ to $1\times10^{-7}$ mol, more preferably $1\times10^{-4}$ to $5\times10^{-7}$ per mol of silver halide. The preferable amount of the palladium compound is $1\times10^{-3}$ to $5\times10^{-7}$ mol per mol of silver. The preferable amounts of the thiocyan compound and selenocyan compound are $5\times10^{-2}$ to $1\times10^{-6}$ mol per mol of silver halide.

Examples of a sulfur sensitizer are hypo, a thiourea-based compound, a rhodanine-based compound, and sulfur-containing compounds described in U.S. Pat. Nos. 3,857,711, 4,266,018, and 4,054,457. Chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of a modifier of the chemical sensitization aid are described in U.S. Pat. Nos. 2,131,038, 3,411,914, and 3,554,757, JP-A-58-126526, and G. F. Duffin, Photographic Emulsion Chemistry, pp. 138 to 143.

The preferable amount of the sulfur sensitizer is $1\times10^{-4}$ to $1\times10^{-7}$, more preferably $1\times10^{-5}$ to $5\times10^{-7}$ per mol of silver halide.

The amount of a gold sensitizer is preferably $1\times10^{-4}$ to $1\times10^{-7}$ mol, and more preferably, $1\times10^{-5}$ to $5\times10^{-7}$ mol per mol of a silver halide. A preferred amount of a palladium compound is $1\times10^{-3}$ to $5\times10^{-7}$ mol per mol of a silver halide.

The silver halide emulsions of the present invention are preferably subjected to selenium sensitization.

Selenium compounds disclosed in hitherto published patents can be used as the selenium sensitizer in the present invention. In the use of liable selenium compound and/or nonliable selenium compound, generally, it is added to an emulsion and the emulsion is agitated at high temperature, preferably 40° C. or above, for a given period of time. Compounds described in, for example, Jpn. Pat. Appln. KOKOKU Publication No. (hereinafter referred to as JP-B-) 44-15748, JP-B-43-13489, JP-A's-4-25832 and 4-109240 are preferably used as the liable selenium compound.

Specific examples of the liable selenium sensitizers include isoselenocyanates (for example, aliphatic isoselenocyanates such as allyl isoselenocyanate), selenoureas, selenoketones, selenoamides, selenocarboxylic acids (for example, 2-selenopropionic acid and 2-selenobutyric acid), selenoesters, diacyl selenides (for example, bis(3-chloro-2, 6-dimethoxybenzoyl) selenide), selenophosphates, phosphine selenides and colloidal metal selenium.

The liable selenium compounds, although preferred types thereof are as mentioned above, are not limited thereto. It is generally understood by persons of ordinary skill in the art to which the invention pertains that the structure of the liable selenium compound as a photographic emulsion sensitizer is not so important as long as the selenium is liable and that the liable selenium compound plays no other role than having its selenium carried by organic portions of selenium sensitizer molecules and causing it to present in unstable form in the emulsion. In the present invention, the liable selenium compounds of this broad concept can be used advantageously.

Compounds described in JP-B's-46-4553, 52-34492 and 52-34491 can be used as the nonliable selenium compound in the present invention. Examples of the nonliable selenium compounds include selenious acid, potassium selenocyanate, selenazoles, quaternary selenazole salts, diaryl selenides, diaryl diselenides, dialkyl selenides, dialkyl diselenides, 2-selenazolidinedione, 2-selenoxazolidinethione and derivatives thereof.

These selenium sensitizers are dissolved in water, or, a single or mixed organic solvent, such as methanol or ethanol, and added at the time of chemical sensitization. The number of selenium sensitizers to be used is not limited to one, and two or more of the above sensitizers can be used in combination. The combined use of the liable selenium compound and the non-liable selenium compound is preferable.

Although the amount of the selenium sensitizer used in the present invention varies according to the activity of the selenium sensitizer used, type or size of the silver halide, temperature or time of ripening, etc., $1\times10^{-8}$ mol per mol of a silver halide or more is preferable. $1\times10^{-7}$ mol or more, and $1\times10^{-5}$ mol or less is more preferable. If a selenium sensitizer is used, chemical ripening is preferably performed at 40° C. or more and 80° C. or less. The pAg and pH are freely chosen. Concerning the pH, for example, the effect of the present invention can be obtained within a wide range of 4 to 9.

The selenium sensitization is preferably performed in combination with either sulfur sensitization or noble metal sensitization, or both. In the present invention, it is preferable that thiocyanate is added to the silver halide emulsion at the time of chemical sensitization. As the thiocyanate, potassium thiocyanate, sodium thiocyanate, ammonium thiocyanate, etc., are used. The thiocyanate is usually dissolved in an aqueous water solution or water-soluble solvent before being added. The amount of the thiocyanate added is $1\times10^{-5}$ mol to $1\times10^{-2}$ mol per mol of a silver halide, and more preferably, $5\times10^{-5}$ mol to $5\times10^{-3}$ mol.

In the emulsion used in the present invention, the surface of a grain or any location further inside may be chemically sensitized. It is preferable that only the surface be chemically sensitized. In the case of chemically sensitizing the inside, a method described in JP-A-63-264740 can be referred to. The lower the chloride ion content of the epitaxially Functioned silver halide protrusion portion is, the higher the chemical sensitization tends to be inside. If the protrusion portion is formed in the presence of thiocyante ions, the area further inside the grain is chemically sensitized.

Next, another preferred embodiment of the silver halide emulsion of the present invention will be explained.

It is preferable that the right amount of calcium ions and/or magnesium ions be contained in the silver halide emulsion of the present invention. Thereby, the graininess and the image quality are increased, and the storability is also improved. The appropriate amounts are: 400 to 2500 ppm of calcium, and/or 50 to 2500 ppm of magnesium, more preferably, 500 to 2000 ppm of calcium, and/or 200 to 2000 ppm of magnesium. The "400 to 2500 ppm of calcium, and/or 50 to 2500 ppm of magnesium" refers to the state in which the concentration of at least one of the two elements is within the specified range. If the calcium or magnesium content is higher than these values, an inorganic salt may be precipitated from the calcium salt, magnesium salt or gelatin, etc. This disrupts the process of manufacturing the lightsensitive material, which is unpreferable. The "calcium or magnesium content" refers to the concentration per unit weight of the emulsion by expressing all the compounds containing calcium or magnesium, such as calcium ions, magnesium ions, calcium salt, magnesium salt, in mass in terms of calcium atoms or magnesium atoms.

The calcium content in the silver halide tabular grain emulsion of the present invention is preferably controlled by adding a calcium salt at the time of chemical sensitization. The gelatin generally used at the time of emulsion preparation already contains calcium in the form of solid gelatin of 100 to 4000 ppm. The calcium content may be controlled by adding a calcium salt to the gelatin. The calcium content can be controlled by a calcium salt after desalting (decalcium) of the gelatin is performed, if necessary, in accordance with known methods, such as washing, ion exchange, etc. As the calcium salt, calcium nitrate and calcium chloride are preferable, and calcium nitrate is most preferable. Similarly, the magnesium content can be controlled by the addition of a magnesium salt at the time of preparing the emulsion. As the magnesium salt, magnesium nitrate and magnesium chloride are preferable, and magnesium nitrate is most preferable. As a quantitative method for determining the calcium or magnesium content, the ICP emission spectral analysis method may be used. The calcium and magnesium can be used alone or in combination, but it is preferable that calcium be contained. The calcium or magnesium can be added at any point during the silver halide emulsion preparation process. The calcium or magnesium is preferably added after the grain formation and before the spectroscopic sensitization or chemical sensitization, and more preferably, after the addition of sensitizing dyes. It is especially preferable that the calcium or magnesium be added after adding sensitizing dyes and before performing chemical sensitization.

As a compound especially useful for the purpose of reducing fog and suppressing fog increase during storage, a mercaptotetrazole compound having a water-soluble group described in JP-A-4-16838 is used. This publication discloses that the storability is enhanced by using a mercaptotetrazole compound and a mercaptothiadiazole compound in combination.

Photographic emulsions used in the present invention can contain various compounds in order to prevent fog during the manufacturing process, storage, or photographic processing of a sensitive material, or to stabilize photographic properties. That is, it is possible to add many compounds known as antifoggants or stabilizers, e.g., thiazoles such as benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxadolinethione; and azaindenes such as triazaindenes, tetrazaindenes (particularly 4-hydroxy-substituted(1,3,3a,7) tetrazaindenes), and pentazaindenes. For example, compounds described in U.S. Pat. Nos. 3,954,474 and 3,982,947 and JP-B-52-28660 can be used. One preferred compound is described in JP-A-63-212932. Antifoggants and stabilizers can be added at any of several different timings, such as before, during, and after grain formation, during washing with water, during dispersion after the washing, during epitaxial formation, before, during, and after chemical sensitization, and before coating, in accordance with the intended application. The antifoggants and stabilizers can be added during preparation of an emulsion to achieve their original fog preventing effect and stabilizing effect. In addition, the antifoggants and stabilizers can be used for various purposes of, e.g., controlling the crystal habit of grains, decreasing the grain size, decreasing the solubility of grains, controlling chemical sensitization, and controlling the arrangement of dyes.

It is advantageous to use gelatin as a protective colloid for use in the preparation of emulsions of the present invention or as a binder for other hydrophilic colloid layers. However, another hydrophilic colloid can also be used in place of gelatin.

Examples of the hydrophilic colloid are protein such as a gelatin derivative, a graft polymer of gelatin and another high polymer, albumin, and casein; cellulose derivatives such as hydroxyethylcellulose, carboxymethylcellulose, and cellulose sulfates; sugar derivatives such as soda alginate and a starch derivative; and a variety of synthetic hydrophilic high polymers such as homopolymers or copolymers, e.g., polyvinyl alcohol, polyvinyl alcohol partial acetal, poly-N-vinylpyrrolidone, polyacrylic acid, polymethacrylic acid, polyacrylamide, polyvinylimidazole, and polyvinyl pyrazole.

Examples of gelatin are lime-processed gelatin, oxidated gelatin, and enzyme-processed gelatin described in Bull. Soc. Sci. Photo. Japan. No. 16, p. 30 (1966). In addition, a hydrolyzed product or an enzyme-decomposed product of gelatin can also be used.

It is preferable to wash with water an emulsion of the present invention to desalt, and disperse into a newly prepared protective colloid. Although the temperature of washing can be selected in accordance with the intended use, it is preferably 5° C. to 50° C. Although the pH of washing can also be selected in accordance with the intended use, it is preferably 2 to 10, and more preferably, 3 to 8. The pAg of washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, a method using an organic solvent, a method using a water-soluble polymer, and a method using a gelatin derivative.

Next, silver halide photographic lightsensitive material using the silver halide photographic emulsion of the present invention will be described.

Although a lightsensitive material of the present invention need only have at least one lightsensitive layer on a support, it is preferable that at least one blue-sensitive silver halide emulsion layer, at least one green-sensitive silver halide emulsion layer, and at least one red-sensitive silver halide emulsion layer on a support, and that these layers are formed by coating in this order from the one farthest from the support. Alternatively, these layers can be arranged in different order from the above order. In the present invention, the sensitive layer is preferably formed by coating red-, green-, and blue-sensitive silver halide emulsion layers in this order from the one closest to the support. Also, each color-sensitive layer preferably has a unit configuration including two or more photosensitive emulsion layers differing in speed. In particular, a three-layered unit configuration including three photosensitive emulsion layers, i.e., low-, medium-, and high-speed layers in this order from the one closest to the support is favored. The aforementioned contents are described in the specifications of JP-B-49-15495 and JP-A-59-20246, etc.

One preferred embodiment of lightsensitive material of the present invention is a photosensitive element in which a support is coated with layers in the order of an undercoat layer/antihalation layer/first interlayer/red-sensitive emulsion layer unit (including three layers in the order of a low-speed red-sensitive layer/medium-speed red-sensitive layer/high-speed red-sensitive layer from the one closest to the support)/second interlayer/green-sensitive emulsion layer unit (including three layers in the order of a low-speed green-sensitive layer/medium-speed green-sensitive layer/ high-speed green-sensitive layer from the one closest to the support)/third interlayer/yellow filter layer/blue-sensitive emulsion layer unit (including three layers in the order of a low-speed blue-sensitive layer/medium-speed blue-sensitive layer/high-speed blue-sensitive layer from the one closest to the support)/first protective layer/second protective layer.

Each of the first, second, and third interlayers can be a single layer or two or more layers. The first interlayer is preferably divided into two or more layers, and the layer directly adjacent to the red-sensitive layer preferably contains yellow colloidal silver. Likewise, the second interlayer preferably includes two or more layers, and the layer directly adjacent to the green-sensitive layer preferably contains yellow colloidal silver. In addition, a fourth interlayer is favorably formed between the yellow filter layer and the blue-sensitive emulsion layer unit.

These interlayers can contain couplers and DIR compounds, etc., such as those which is described in JP-A's-61-43738, 59-113438, 59-113440, 61-20037 and 61-20038, and further, color amalgamation inhibitors to be used usually.

Also, the protective layer preferably has a three-layered configuration including first to third protective layers. When the protective layer includes two or three layers, the second protective layer preferably contains a fine-grain silver halide having an average equivalent-sphere grain size of 0.10 $\mu$m or less. This silver halide is preferably silver bromide or silver iodobromide.

A silver halide color photographic lightsensitive material of the present invention can have a photosensitive emulsion layer other than those enumerated above. It is particularly preferable, in respect of color reproduction, to form a photosensitive emulsion layer spectrally sensitized to a cyan region to give an interlayer effect to a red-sensitive emulsion layer. This layer for imparting an interlayer effect can be blue-, green-, or red-sensitive. As described in U.S. Pat. Nos. 4,663,271, 4,705,744, and 4,707,436, and JP-A's-62-160448 and 63-89850, the disclosures of which are incorporated herein by reference, a donor layer with an interlayer effect, which has a different spectral sensitivity distribution from that of a main sensitive layer such as BL, GL, or RL, is preferably formed adjacent to, or close to, this main sensitive layer.

Next, silver halide emulsions other than the silver halide emulsions of the present invention, which is used in a lightsensitive material of the present invention, will be described.

A preferred silver halide contained in an photographic emulsion layer of a lightsensitive material of the present invention is silver iodobromide, silver iodochloride, or silver bromochloroiodide containing about 30 mol % or less of silver iodide. A particularly preferable silver halide is silver iodobromide or silver bromochloroiodide containing about 1 to about 10 mol % of silver iodide.

Silver halide grains contained in a photographic emulsion can have regular crystals such as cubic, octahedral, or tetradecahedral crystals, irregular crystals such as spherical or tabular crystals, crystals having crystal defects such as twin planes, or composite shapes thereof.

A silver halide can be either fine grains having a grain size of about 0.2 $\mu$m or less or large grains having a projected area diameter of about 10 $\mu$m, and an emulsion can be either a polydisperse or monodisperse emulsion.

A silver halide photographic emulsion usable in the present invention can be prepared by methods described in, e.g., "I. Emulsion preparation and types," Research Disclosure (RD) No. 17643 (December, 1978), pp. 22 and 23, RD No. 18716 (November, 1979), p. 648, and RD No. 307105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964, the disclosures of which are incorporated herein by reference.

Monodisperse emulsions described in, e.g., U.S. Pat. Nos. 3,574,628, 3,655,394, and GB1,413,748 are also favorable, the disclosures of which are incorporated herein by reference.

A crystal structure can be uniform, can have different halogen compositions in the interior and the surface layer thereof, or can be a layered structure. Alternatively, a silver halide having a different composition can be bonded by an epitaxial junction, or a compound except for a silver halide such as silver rhodanide or lead oxide can be bonded. A mixture of grains having various types of crystal shapes can also be used.

The above emulsion can be any of a surface latent image type emulsion which mainly forms a latent image on the surface of a grain, an internal latent image type emulsion which forms a latent image in the interior of a grain, and another type of emulsion which has latent images on the surface and in the interior of a grain. However, the emulsion must be a negative type emulsion. The internal latent image type emulsion can be a core/shell internal latent image type emulsion described in JP-A-63-264740, the disclosure of which is incorporated herein by reference. A method of preparing this core/shell internal latent image type emulsion is described in JP-A-59-133542, the disclosure of which is incorporated herein by reference. Although the thickness of a shell of this emulsion depends on the development conditions and the like, it is preferably 3 to 40 nm, and most preferably, 5 to 20 nm.

It is also possible to preferably use surface-fogged silver halide grains described in U.S. Pat. No. 4,082,553, internally fogged silver halide grains described in U.S. Pat. No. 4,626,498 and JP-A-59-214852, and colloidal silver, in sensitive silver halide emulsion layers and/or substantially non-sensitive hydrophilic colloid layers, all the disclosures of which are incorporated herein by reference. The internally fogged or surface-fogged silver halide grain means a silver halide grain which can be developed uniformly (non-imagewise) regardless of whether the location is a non-exposed portion or an exposed portion of the sensitive material. A method of preparing the internally fogged or surface-fogged silver halide grain is described in U.S. Pat. No. 4,626,498 and JP-A-59-214852, the disclosures of which are incorporated herein by reference.

A silver halide which forms the core of an internally fogged core/shell type silver halide grain can have a different halogen composition. As the internally fogged or surface-fogged silver halide, any of silver chloride, silver chlorobromide, silver bromoiodide, and silver bromochloroiodide can be used. The average grain size of these fogged silver halide grains is preferably 0.01 to 0.75 $\mu$m, and most preferably, 0.05 to 0.6 $\mu$m. The grain shape can be a regular grain shape. Although the emulsion can be a polydisperse emulsion, it is preferably a monodisperse emulsion (in which at least 95% in weight or number of grains of silver halide grains have grain sizes falling within the range of ±40% of the average grain size).

In a lightsensitive material of the present invention, it is possible to mix, in a single layer, two or more types of emulsions different in at least one of characteristics of a photosensitive silver halide emulsion, i.e., a grain size, grain size distribution, halogen composition, grain shape, and sensitivity.

A photographic lightsensitive material of the present invention is usually made by adding photographically useful substances to coating solution, i.e., hydrophilic colloid solution.

Applicable various techniques and inorganic and organic materials usable in the silver halide photographic material and silver halide emulsions used therein are generally those described in Research Disclosure Item 308119 (1989), Item 37038 (1995), and Item 40145 (1997), the disclosures of which are incorporated herein by reference.

In addition, more specifically, techniques and inorganic and organic materials that can used in the color photosensitive materials of the present invention are described in portions of EP436,938A2 and patents cited below, the disclosures of which are incorporated herein by reference.

| | Items | Corresponding portions |
|---|---|---|
| 1) | Layer configurations | page 146, line 34 to page 147, line 25 |
| 2) | Silver halide emulsions usable together | page 147, line 26 to page 148 line 12 |
| 3) | Yellow couplers usable together | page 137, line 35 to page 146, line 33, and page 149, lines 21 to 23 |
| 4) | Magenta couplers usable together | page 149, lines 24 to 28; EP421, 453A1, page 3, line 5 to page 25, line 55 |
| 5) | Cyan couplers usable together | page 149, lines 29 to 33; EP432, 804A2, page 3, line 28 to page 40, line 2 |
| 6) | Polymer couplers | page 149, lines 34 to 38; EP435, 334A2, page 113, line 39 to page 123, line 37 |
| 7) | Colored couplers | page 53, line 42 to page 137, line 34, and page 149, lines 39 to 45 |
| 8) | Functional couplers usable together | page 7, line 1 to page 53, line 41, and page 149, line 46 to page 150, line 3; EP435, 334A2, page 3, line 1 to page 29, line 50 |
| 9) | Antiseptic and mildewproofing agents | page 150, lines 25 to 28 |
| 10) | Formalin scavengers | page 149, lines 15 to 17 |
| 11) | Other additives usable together | page 153, lines 38 to 47; EP421, 453A1, page 75, line 21 to page 84, line 56, and page 27, line 40 to page 37, line 40 |
| 12) | Dispersion methods | page 150, lines 4 to 24 |
| 13) | Supports | page 150, lines 32 to 34 |
| 14) | Film thickness · film physical properties | page 150, lines 35 to 49 |
| 15) | Color development step | page 150, line 50 to page 151, line 47 |
| 16) | Desilvering step | page 151, line 48 to page 152, line 53 |
| 17) | Automatic processor | page 152, line 54 to page 153, line 2 |
| 18) | Washing · stabilizing step | page 153, lines 3 to 37 |

A photographic lightsensitive material of the present invention is usually processed with an alkaline developing solution containing a developing agent after imagewise exposure. After this color developing, the color photographic lightsensitive material is processed by an image forming method by which it is processed with a processing solution containing a bleaching agent and having bleaching capacity.

EXAMPLE

The present invention will be described in detail below by way of its examples. However, the invention is not limited to these examples.

Example-1

(Preparation of Host Tabular Grain Em-H1)

1450 milliliters (hereinafter milliliter is also referred to as "mL") of an aqueous solution containing 1 g of potassium bromide and 1.4 g of low-molecular-weight gelatin with an average molecular weight of 10,000 to 20,000 were held at 35° C. and stirred. 38 mL of an aqueous solution containing 4.3 g of silver nitrate, 38 mL of an aqueous solution containing 3.1 g of potassium bromide, and 38 mL of an aqueous solution containing 0.5 g of low-molecular-weight gelatin with an average molecular weight of 10,000 to 20,000 were added simultaneously by the triple-jet method over 35 seconds. The aqueous potassium bromide solution was added to set the silver potential at −40 mV, and the temperature was raised to 55° C. Then, 31 g of phthalated gelatin were added. 900 mL of an aqueous solution containing 185 g of silver nitrate, and 900 mL of an aqueous solution containing 125 g of potassium bromide and 7.25 g of potassium iodide were added by the double-jet method over 30 minutes while the flow rates were accelerated. During the addition, the silver potential was held at −40 mV with respect to a saturated calomel electrode. Desalting was performed by a publicly-known flocculation method at 35° C. A gelatin was added and the pH and the pAg were adjusted to 6.4 and 8.7, respectively, at 40° C., thereby preparing a host tabular grain emulsion Em-H1. The emulsion Em-H1 comprises tabular grains, each having a (111) planes as a main plane, and with an average equivalent-circle diameter of 0.60 $\mu$m, an equivalent-circle diameter variation coefficient of 33%, an average thickness of 0.06 $\mu$m, and an average aspect ratio of 10. The Em-H1 was a silver bromoiodide emulsion having a silver iodide content of 3.9 mol %.

(Preparation of Comparative Emulsion Em-A2)

Using the Em-H1A as host grains, the protrusion portions were formed on the surfaces of the host grains by epitaxial deposition, and after that, chemical sensitization was performed by the following method to obtain Em-A2.

The Em-H1 was dissolved at 4° C. and the spectral sensitizing dyes S-2 and S-13 at a molar ratio of 96:4 were added at the ratio of 95% of the saturated covering amount.

After that, an aqueous silver nitrate solution and an aqueous sodium chloride solution were added by the double-jet method over 9 minutes with a constant flow rate, and epitaxial deposition was performed. The silver amount used for the epitaxial deposition was 15% of the host grains.

After $5\times10^{-5}$ mol of antifoggant F-7 were added, the emulsion was raised to 48° C. The potassium thiocyanate, chloroauric acid, sodium thiosulfate, and N,N-dimethylselenourea were added to perform optimal chemical sensitization. $5\times10^{-4}$ mol of antifoggant F-1 was added to finish the chemical sensitization. The resultant emulsion was stored in a refrigerator.

The emulsion Em-A2 thus obtained was an emulsion in which 94% of the total projected area of the grains was occupied by silver halide grains each having protrusion portions formed on the surface of the host tabular grain. The protrusion portions were located mainly on the apex portions of the host tabular grain. According to halogen composition analysis of the protrusion portions performed by an analytical electron microscope, the contents of silver iodide:silver bromide:silver chloride was in a ratio of 0.6:23.9:75.5 (mol %).

(Preparation of Comparative Emulsion Em-A3)

Using the Em-H1A as host grains, the protrusion portions were formed on the surfaces of the host grains by epitaxial deposition, and after that, chemical sensitization was performed by the following method to obtain Em-A3.

The Em-H1 was dissolved at 40° C. and the spectral sensitizing dyes S-2 and S-13 were added in the same manner as Em-A2.

After that, an aqueous silver nitrate solution and an aqueous sodium chloride solution were added by the double-jet method over 9 minutes with a constant flow rate, and epitaxial deposition was performed. During the addition, the silver potential was held at +120 mV with respect to a saturated calomel electrode. The silver amount used for the epitaxial deposition was 15% of the host grains.

After $5\times10^{-5}$ mol of antifoggant F-7 were added, the emulsion was raised to 48° C. The potassium thiocyanate, chloroauric acid, sodium thiosulfate, and N,N-dimethylselenourea were added to perform optimal chemical sensitization. $5\times10^{-4}$ mol of antifoggant F-1 was added to finish the chemical sensitization. The resultant emulsion was stored in a refrigerator.

The emulsion Em-A3 thus obtained was an emulsion in which 92% of the total projected area of the grains was occupied by silver halide grains each having protrusion portions formed on the surface of the host tabular grain. The protrusion portions were located mainly on the apex portions of the host tabular grain. According to the halogen composition analysis of the protrusion portions performed by an analytical electron microscope, the contents of silver iodide:silver bromide:silver chloride were in a ratio of 0.5:99.5:0 (mol %).

(Preparation of Comparative Emulsion Em-A4)

The Em-A4 was prepared in the same manner as the emulsion Em-A2, except that in the preparation process, the addition time of the aqueous silver nitrate solution and the aqueous sodium chloride solution for the epitaxial deposition was changed to 5 minutes and 24 seconds while maintaining a constant flow rate, thereby reducing the silver amount of the protrusion portions to 9% in relation to the silver amount of the host grain.

(Preparation of Comparative Emulsion Em-A5)

The Em-A5 was prepared in the same manner as the emulsion Em-A3, except that in the preparation process, the addition time of the aqueous silver nitrate solution and the aqueous sodium bromide solution for the epitaxial deposition was changed to 5 minutes and 24 seconds while maintaining a constant flow rate, thereby reducing the silver amount of the protrusion portions to 9% in relation to the silver amount of the host grain.

(Preparation of Comparative Emulsion Em-A6)

The Em-A6 was prepared in the same manner as the emulsion Em-A2, except that in the preparation process, $3.1\times10^{-6}$ mol of potassium hexacyanoruthenate II per mol of silver amount of host grains was added immediately before starting addition of the aqueous silver nitrate solution for epitaxial deposition.

(Preparation of Comparative Emulsion Em-A7)

The Em-A7 was prepared in the same manner as the emulsion Em-A3, except that in the preparation process, $3.1\times10^{-6}$ mol of potassium hexacyanoruthenate II per mol of silver amount of host grains was added immediately before starting addition of the aqueous silver nitrate solution for epitaxial deposition.

(Preparation of Comparative Emulsion Em-A8)

The Em-A8 was prepared in the same manner as the emulsion Em-A4, except that in the preparation process, $3.1\times10^{-6}$ mol of potassium hexacyanoruthenate II per mol of silver amount of host grains was added immediately before starting addition of the aqueous silver nitrate solution for epitaxial deposition.

(Preparation of Emulsion Em-A9 of the Present Invention)

The Em-A9 was prepared in the same manner as the emulsion Em-A5, except that in the preparation process, $3.1\times10^{-6}$ mol of potassium hexacyanoruthenate II per mol of silver amount of host grains was added immediately before starting addition of the aqueous silver nitrate solution for epitaxial deposition.

(Preparation of Emulsion Em-A10 of the Present Invention)

The Em-A10 was prepared in the same manner as the emulsion Em-A9, except that in the preparation process, the addition time of the aqueous silver nitrate solution and the aqueous sodium bromide solution for the epitaxial deposition was changed to 3 minutes while maintaining the constant flow rate. Thereby the silver amount of the protrusion portions was reduced to 5% in relation to the silver amount of the host grain.

(Preparation of Emulsion Em-A11 of the Present Invention)

The Em-A11 was prepared in the same manner as the emulsion Em-A10, except that in the preparation process, S-2 and S-13 to be added were changed to DYE-I-12 and DYE-II-6, respectively, at a molar ratio of 90:10, in an amount of 95% of the saturated covering amount. The DYE-I-12 and DYE-II-6 were used as solid dispersions, as were S-2 and S-13.

(Preparation of Emulsion Em-A12 of the Present Invention)

The Em-A12 was prepared in the same manner as the emulsion Em-A11, except that $4\times10^{-2}$ mol of calcium per mol of silver amount of host grains was added before the addition of the DYE-I-12 and DYE-II-6.

(Preparation of Comparative Emulsion Em-A1)

The Em-A1 was prepared in the same manner as the emulsion Em-A2, except that in the preparation process, the protrusion portions were not formed by omitting the step of adding the aqueous silver nitrate solution and the aqueous sodium chloride solution for epitaxial deposition.

(Preparation of Dye-Blank Comparative Emulsion Em-A13)

Em-A13 was prepared in the same manner as Em-A1, except that the addition of sensitizing dyes S-2 and S-13 was omitted.

(Formation of Samples 101 to 113)

Each of the emulsions Em-A1 to A13 was dissolved at 40° C., and the compounds described below were added. A triacetyl cellulose film support having an undercoat layer is coated with the resultant emulsion by a co-extrusion method, together with a protective layer. The coated products were left at 40° C. and a relative humidity of 70% for 16 hours, thereby obtaining samples 101 to 113.

(1) Emulsion layer
- Emulsion (Ag $7.7\times10^{-3}$ mol/m$^2$)
- Coupler C-2 ($1.2\times10^{-3}$ mol/m$^2$)
- Gelatin (2.3 g/m$^2$)

(2) Protective layer
- Gelatin harder H-1 (0.08 g/m$^2$)
- Gelatine (1.80 g/m$^2$)

(Confirmation of Shallow Electron-Trapping Zone)

The samples 102–109 were radiated with laser pulsed light, and the life of a photoelectron generated was measured by utilizing microwave absorption. It was confirmed that the life of the photoelectron in samples 106, 107, 108 and 109 was prolonged compared with samples 102, 103, 104 and 105, respectively. This means that a shallow electron-trapping zone was formed within the grains of Em-A6 to A9 by using potassium hexacyanoruthenate II. Similarly, with respect to the emulsions Em-A10 to Em-A12, it was confirmed that a shallow electron-trapping zone was formed by preparing an emulsion in which potassium hexacyanoruthenate II was removed, and by measuring the emulsion using the same method.

(Evaluation Concerning Photographic Properties, Storability and Reciprocity Law Property at Low Illumination)

evaluated by subtracting the magenta stain density of Sample 113 that contains no dye, from the magenta density in the stain of the processed sample sheets. The stain density was measured with Status A, using a densitometer manufacture by X-RITE Inc.

The results obtained are shown in Table 1 below.

TABLE 1

| Sample | Emulsion | Remarks | Halide composition in protrusion portion (mol %) (I/Br/Cl) | Silver amount in protrusion portion (% with respect to host grains) | Shallow electron-trapping zone | Spectral sensitizing dye | Calcium | Relative sensitivity (1/100 sec) | Fog | Fog after storage | Relative sensitivity (20 sec) | Magenta residual density |
|---|---|---|---|---|---|---|---|---|---|---|---|---|
| 101 | Em-A1 | Comp. | | 0 | none | S-2/S-13 | none | 100 | 0.03 | 0.08 | 33 | 0.040 |
| 102 | Em-A2 | Comp. | 0.6/23.9/75.5 | 15 | none | S-2/S-13 | none | 245 | 0.07 | 0.35 | 138 | 0.043 |
| 103 | Em-A3 | Comp. | 0.5/99.5/0 | 15 | none | S-2/S-13 | none | 145 | 0.05 | 0.14 | 81 | 0.041 |
| 104 | Em-A4 | Comp. | 0.6/23.9/75.5 | 9 | none | S-2/S-13 | none | 295 | 0.08 | 0.37 | 170 | 0.041 |
| 105 | Em-A5 | Comp. | 0.5/99.5/0 | 9 | none | S-2/S-13 | none | 166 | 0.06 | 0.16 | 98 | 0.040 |
| 106 | Em-A6 | Comp. | 0.6/23.9/75.5 | 15 | prsnt | S-2/S-13 | none | 275 | 0.07 | 0.39 | 174 | 0.044 |
| 107 | Em-A7 | Comp. | 0.5/99.5/0 | 15 | prsnt | S-2/S-13 | none | 170 | 0.05 | 0.16 | 107 | 0.042 |
| 108 | Em-A8 | Comp. | 0.6/23.9/75.5 | 9 | prsnt | S-2/S-13 | none | 302 | 0.08 | 0.41 | 191 | 0.042 |
| 109 | Em-A9 | Inv. | 0.5/99.5/0 | 9 | prsnt | S-2/S-13 | none | 302 | 0.06 | 0.16 | 251 | 0.040 |
| 110 | Em-A10 | Inv. | 0.5/99.5/0 | 5 | prsnt | S-2/S-13 | none | 309 | 0.06 | 0.13 | 263 | 0.041 |
| 111 | Em-A11 | Inv. | 0.5/99.5/0 | 5 | prsnt | DYE-I-12/ DYE-II-6 | none | 303 | 0.07 | 0.16 | 250 | 0.013 |
| 112 | Em-A12 | Inv. | 0.5/99.5/0 | 5 | prsnt | DYE-I-12/ DYE-II-6 | prsnt | 317 | 0.06 | 0.14 | 269 | 0.014 |
| 113 | Em-A13 | Comp. | | 0 | none | none | none | — | — | — | — | 0.000 |

prsnt = present

The samples 101 to 113 were exposed for 1/100 sec through a gelatin filter SC-5 manufactured by Fuji Photo Film Co., Ltd. Black and white development was carried out at 20° C. for 10 minutes using the developer D-19 of the following composition. After that, stopping, fixing, washing and drying were performed.

The composition of the developer is as follows:

| | |
|---|---|
| Metol | 2.2 g |
| $Na_2SO_3.7H_2O$ | 96 g |
| hydroquinone | 8.8 g |
| $Na_2SO_3$ | 56 g |
| KBr | 5.0 g |
| water to make | 1.0 L |

After that, density measurement was carried out using a visual filter, and sensitivity and fog were evaluated. The value at which density of fog density plus 0.2 is given, is adopted as the sensitivity value. The sensitivity is indicated by the relative value when the sensitivity of the sample 101 is assumed to be 100.

A similar evaluation was performed concerning the sample which was stored for 7 days at 50° C. and a relative humidity of 55% before exposure. The storability was evaluated.

The reciprocity law property at low illumination was evaluated by determining the sensitivity when the exposure time was changed from 1/100 sec to 20 sec.

Further, for residual color evaluation, the above-mentioned developing time was changed to 5 min, and the processing was performed. After that, residual color was As is evident from Table 1, the emulsion of the present invention has a high sensitivity, and fog after storage is good. The emulsion also has excellent properties, that is, a very high sensitivity even in a case of an exposure at low illumination (exposure for 20 sec). It can also be understood that still better effect can be obtained in a case where the silver amount of the protrusion portions is 8% or less. In addition, it is apparent that the use of emulsions to which compounds DYE-I-12 and DYE-II-6 are added, improves residual color. It is also apparent that the further addition of calcium enhances sensitivity higher.

Example-2

(Preparation of Host Tabular Grain Em-H2)

1270 mL of an aqueous solution containing 0.4 g of potassium bromide and 2.1 g of low-molecular-weight oxidation-processed gelatin with an average molecular weight of 10,000 to 20,000 were held at 35° C. and stirred. 45 mL of an aqueous solution containing 2.2 g of silver nitrate, 45 mL of an aqueous solution containing 1.6 g of potassium bromide, and 45 mL of an aqueous solution containing 0.8 g of low-molecular-weight oxidation-processed gelatin with an average molecular weight of 10,000 to 20,000 were added simultaneously over 45 seconds. The aqueous potassium bromide solution was added to set the silver potential at −50 mV, and the temperature was raised to 65° C. Then, 31 g of succinated gelatin were added.

450 mL of an aqueous solution containing 135 g of silver nitrate, and 450 mL of an aqueous solution containing 94 g of potassium bromide and 3.3 g of potassium iodide were added by the double-jet method over 21 minutes while the flow rates were accelerated. During the addition, the silver potential was held at −40 mV with respect to a saturated calomel electrode. Subsequently, 86 mL of an aqueous solution containing 27 g of silver nitrate, and 86 mL of an aqueous solution containing 2.2 g of potassium iodide were added by the double jet method while accelerating the flow rates. During the addition, the silver potential was held at −40 nV with respect to a saturated calomel electrode. $7.4\times10^{-5}$ mol of potassium hexacyanoruthenate II per mol of the total silver amount of host grains was added. Then, 66 mL of an aqueous solution containing 20 g of silver nitrate, and 66 mL of an aqueous solution containing 13 g of potassium bromide and 1.7 g of potassium iodide were added by the double-jet method over 13 minutes with a constant flow rate, while the silver potential was held at +75 mV with respect to a saturated calomel electrode. The grain formation step was completed.

After that, desalting was performed by a publicly-known flocculation method at 35° C. A gelatin was added and the pH and the pAg were adjusted to 5.9 and 8.7, respectively, at 40° C.

Em-H2 comprises tabular grains, each having a (111) plane as a main plane, and with an average equivalent-circle diameter of 1.86 μm, an equivalent-circle diameter variation coefficient of 20%, an average thickness of 0.066 μm, and an average aspect ratio of 28. The Em-H2 was a silver bromoiodide emulsion having a silver iodide content of 4.0 mol %.

(Preparation of Comparative Emulsion Em-B1)

In the grain formation step, the same operations as in Em-H2 were performed. The following operation was added, thereby performing epitaxial deposition using the Em-H2 as host grains to prepare Em-B1.

The temperature of the reaction liquid was lowered to 40 C. The spectral sensitizing dyes S-2, S-8 and S-13 were added at a molar ratio of 88:8:4 at the ratio of 70% of the saturated covering amount. The spectral sensitizing dyes were used as fine solid dispersions, as in the Em-A2. After that, an aqueous silver nitrate solution and an aqueous sodium chloride solution were added by the double-jet method over 23 minutes with a constant flow rate, and epitaxial deposition was performed. The silver amount used for the epitaxial deposition was 3% of the host grains. Then the spectral sensitizing dyes S-2, S-8 and S-13 were further added at a molar ratio of 88:8:4 at the ratio of 25% of the saturated covering amount.

After that, desalting was performed by a publicly-known flocculation method at 35° C. as in the Em-A2. A gelatin was added and the pH and the pAg were adjusted to 5.9 and 8.7, respectively, at 40° C. After $5\times10^{-5}$ mol of antifoggant F-6 was added, the emulsion was raised to 50° C. The potassium thiocyanate, chloroauric acid, sodium thiosulfate, and N,N-dimethylselenourea were added to perform optimal chemical sensitization. $5\times10^{-4}$ mol of antifoggnat F-1 was added to finish the chemical sensitization. The resultant emulsion was stored in a refrigerator.

The emulsion Em-B1 thus obtained was an emulsion in which 87% of the total projected area of the grains was occupied by silver halide grains each having protrusion portions formed on the host tabular grain. 62% of the total projected area of the grains was occupied by silver halide grains each having a protrusion portion formed on each of all the apex portions of the main planes of the host tabular grain. According to the halogen composition analysis of the protrusion portions performed by an analytical electron microscope, the contents of silver iodide:silver bromide:silver chloride were in a ratio of 0.8:17.3:81.9 (mol %).

(Preparation of Comparative Emulsion Em-B2)

In the preparation step of the Em-B1, the velocities of flow of the aqueous silver nitrate solution and the aqueous sodium chloride solution to be added were changed, and the addition time was reduced to 14 minutes. The other operations were performed in the same manner as Em-B1, thereby obtaining the Em-B2.

In the emulsion Em-B2, 89% of the total projected area of the grains was occupied by silver halide grains each having protrusion portions formed on the host tabular grain. 77% of the total projected area of the grains was occupied by silver halide grains each having a protrusion portion on each of all the apex portions of the main planes of the host tabular grain. According to halogen composition analysis of the protrusion portions performed by an analytical electron microscope, the composition was the same as that of the Em-B1.

(Preparation of Comparative Emulsion Em-B3)

In the preparation step of the Em-B1, the velocities of flow of the aqueous silver nitrate solution and the aqueous sodium chloride solution to be added were changed, and the addition time was reduced to 8 minutes. The other operations were performed in the same manner as Em-B1, thereby obtaining the Em-B3.

In the emulsion Em-B3, 95% of the total projected area of the grains was occupied by silver halide grains each having protrusion portions formed on the host tabular grain. 89% of the total projected area of the grains was occupied by silver halide grains each having a protrusion portion formed on each of all the apex portions of the main planes of the host tabular grain. According to halogen composition analysis of the protrusion portions performed by an analytical electron microscope, the composition was the same as that of the Em-B1.

(Preparation of Comparative Emulsion Em-B4)

In the preparation step of the Em-B1, the epitaxial deposition step was changed as follows. That is, after adding the spectral sensitizing dyes, an aqueous silver nitrate solution and an aqueous sodium chloride solution were added by the double-jet method over 23 minutes with a constant flow rate, and epitaxial deposition was performed. At this time, the silver potential was held at +120 mV with respect to a saturated calomel electrode. The silver amount used for the epitaxial deposition was 3% of the host grains.

After that, desalting was performed by a publicly-known flocculation method at 35° C. as in the Em-B1. A gelatin was added and the pH and the pAg were adjusted to 5.9 and 8.7, respectively, at 40° C. After $5\times10^{-5}$ mol of antifoggant F-6 was added, the emulsion was raised to 50° C. The potassium thiocyanate, chloroauric acid, sodium thiosulfate, and N,N-dimethylselenourea were added to perform optimal chemical sensitization. $5\times10^{-4}$ mol of antifoggant F-1 was added to finish the chemical sensitization. The resultant emulsion was stored in a refrigerator.

In the emulsion Em-B4 thus obtained, 88% of the total projected area of the grains was occupied by silver halide grains each having protrusion portions formed on the host tabular grain. 65% of the total projected area of the grains was occupied by silver halide grains each having a protrusion portion formed on each of all the apex portions of the main planes of the host tabular grain. According to halogen composition analysis of the protrusion portions performed by an analytical electron microscope, the ratio of the amount of silver iodide silver bromide silver chloride=0.4:99.6:0 (mol %).

(Preparation of Comparative Emulsion Em-B5)

In the preparation step of the Em-B4, the velocity of flow of the aqueous silver nitrate solution and the aqueous sodium chloride solution to be added was changed, and the addition time was reduced to 14 minutes. The other operations were performed in the same manner as Em-B4, thereby obtaining the Em-B5.

In the emulsion Em-B5, 90% of the total projected area of the grains was occupied by silver halide grains each having a protrusion portion formed on the host tabular grains. 77% of the total projected area of the grains was occupied by silver halide grains each having protrusion portions formed on each of all the apex portions of the main planes of the host tabular grain. According to halogen composition analysis of the protrusion portions performed by an analytical electron microscope, the composition was the same as that of the Em-B4.

(Preparation of Comparative Emulsion Em-B6)

In the preparation step of the Em-B4, the velocity of flow of the aqueous silver nitrate solution and the aqueous sodium chloride solution to be added was changed, and the addition time was reduced to 8 minutes. The other operations were performed in the same manner as Em-B4, thereby obtaining the Em-B6.

In the emulsion Em-B6, 93% of the total projected area of the grains was occupied by silver halide grains each having protrusion portions formed on the host tabular grains. 87% of the total projected area of the grains was occupied by silver halide grains each having a protrusion portion formed on each of all the apex portions of the main planes of the host tabular grain. According to halogen composition analysis of the protrusion portions performed by an analytical electron microscope, the composition was the same as that of the Em-B4.

(Formation of Samples 201 to 212)

A support was coated with the emulsions Em-B1 to Em-B6 in the same manner as Example 1, and samples 201 to 206 were obtained respectively. On the other hand, in the step for forming the samples 201 to 206, each of the emulsions was dissolved at 40° C. and left for 8 hours and the support was coated with the resultant emulsion, thereby obtaining samples 207 to 212 respectively.

In the preparation step of the Em-B1 to B6, an emulsion in which potassium hexacyanoruthenate II was omitted was prepared and, similarly, a support was coated with the emulsion. The life of a photoelectron was measured at the same time as samples 201 to 206. Thereby, it was confirmed that a shallow electron-trapping zone was formed in the Em-B1 to -B6.

(Evaluation Concerning Photographic Properties)

The samples 201 to 212 were exposed for 1/100 sec in the same manner as Example 1 and development was also carried out, then the sensitivity was evaluated. The density that gives fog density plus 0.2 is adopted as the sensitivity value. The sensitivity was indicated relative to that of the sample 201, taken as being 100. The storability was also evaluated in the same manner as in Example 1. The results obtained are shown in Table 2 below.

TABLE 2

| Emulsion | Remarks | Halide composition portion in protrusion (mol %) (I/Br/Cl) | Ratio, to the total projected area, of grains having protrusions in all apex portions | No laps of time after dissolution | | | | Eight hour after dissolution | | | |
|---|---|---|---|---|---|---|---|---|---|---|---|
| | | | | Sample No. | Relative sensitivity | Fog | Fog after storage | Sample No. | Relative sensitivity | Fog | Fog after storage |
| Em-B1 | Comp. | 0.8/17.3/81.9 | 62% | 201 | 100 | 0.08 | 0.41 | 207 | 74 | 0.11 | 0.50 |
| Em-B2 | Comp. | 0.8/17.3/81.9 | 77% | 202 | 110 | 0.08 | 0.40 | 208 | 83 | 0.10 | 0.49 |
| Em-B3 | Comp. | 0.8/17.3/81.9 | 89% | 203 | 115 | 0.07 | 0.40 | 209 | 89 | 0.09 | 0.49 |
| Em-B4 | Inv. | 0.4/99.6/0 | 65% | 204 | 102 | 0.09 | 0.14 | 210 | 91 | 0.10 | 0.16 |
| Em-B5 | Inv. | 0.4/99.6/0 | 77% | 205 | 110 | 0.08 | 0.13 | 211 | 110 | 0.09 | 0.14 |
| Em-B6 | Inv. | 0.4/99.6/0 | 87% | 206 | 117 | 0.07 | 0.12 | 212 | 117 | 0.08 | 0.13 |

As is evident from Table 2, the emulsion of the present invention having high sensitivity and high storage stability in which the silver bromide content of the protrusion portions is 70% or more, has excellent properties, in that the sensitivity does not easily degrade when the emulsion is left in a dissolved state over time before coating, as long as 70% or more of the total projected area of the grains is occupied by the grains each having protrusion portions on all the apex portions thereof.

Example-3

(Preparation of Host Tabular Grain Em-H3a)

1190 mL of an aqueous solution containing 0.5 g of potassium bromide and 2.7 g of low-molecular-weight oxidation-processed gelatin with an average molecular weight of 10,000 to 20,000 were held at 30° C. and stirred. 50 mL of an aqueous solution containing 1.8 g of silver nitrate, 50 mL of an aqueous solution containing 1.3 g of potassium bromide, and 50 mL of an aqueous solution containing 0.6 g of low-molecular-weight oxidation-processed gelatin with an average molecular weight of 10,000 to 20,000 were added simultaneously by the triple-jet method over 60 seconds. The aqueous potassium bromide solution was added to set the silver potential at −55 mV, and the temperature was raised to 75° C. Then, 35 g of oxidation-processed gelatin were added.

855 mL of an aqueous solution containing 140 g of silver nitrate, and 855 mL of an aqueous solution containing 98 g of potassium bromide were added by the double-jet method over 26 minutes while the flow rates were accelerated. During the addition, the silver potential was held at −45 mV with respect to a saturated calomel electrode. $3.2\times10^{-8}$ mol of potassium hexachloroiridium IV per mol of the total silver amount of host grains was added. Then, 120 mL of an aqueous solution containing 25 g of silver nitrate, and 120 mL of an aqueous solution containing 13.2 g of potassium bromide and 5.8 g of potassium iodide were added by the double-jet method over 5 minutes while the flow rates were accelerated. During the addition, the silver potential was held at −45 mV with respect to a saturated calomel electrode. $9.2\times10^{-5}$ mol of potassium hexacyanoruthenate II per mol of the total silver amount of host grains was added. Then, 60 mL of an aqueous solution containing 12.5 g of silver nitrate, and 60 mL of an aqueous solution containing 8.2 g of potassium bromide and 1 g of potassium iodide were added by the double-jet method over 13 minutes with a constant flow rate, while the silver potential was held at +60 mV with respect to a saturated calomel electrode. The grain formation step was completed.

Desalting was performed by a publicly-known flocculation method at 35° C. A gelatin was added and the pH and the pAg were adjusted to 5.9 and 8.7, respectively, at 40° C., thereby obtaining the host tabular grain Em-H3a. Em-H3a comprises tabular grains each having a (111) plane as a main plane, and with an average equivalent-circle diameter of 2.15 μm, an equivalent-circle diameter variation coefficient of 23%, an average thickness of 0.067 μm, and an average aspect ratio of 32. The Em-H3a was a silver bromoiodide emulsion having a silver iodide content of 3.9 mol %.

(Preparation of Host Tabular Grain Em-H3b)

1190 mL of an aqueous solution containing 0.5 g of potassium bromide and 2.7 g of low-molecular-weight oxidation-processed gelatin with an average molecular weight of 10,000 to 20,000 were held at 30° C. and stirred. 50 mL of an aqueous solution containing 1.8 g of silver nitrate, 50 mL of an aqueous solution containing 1.3 g of potassium bromide, and 50 mL of an aqueous solution containing 0.6 g of low-molecular-weight oxidation-processed gelatin with an average molecular weight of 10,000 to 20,000 were added simultaneously by the triple-jet method over 60 seconds. The aqueous potassium bromide solution was added to set the silver potential at −55 mV, and the temperature was raised to 75° C. Then, 35 g of oxidation-processed gelatin were added.

700 mL of an aqueous solution containing 115 g of silver nitrate, and 700 mL of an aqueous solution containing 80 g of potassium bromide were added by the double-jet method over 23 minutes while the flow rates were accelerated. During the addition, the silver potential was held at −45 mV with respect to a saturated calomel electrode. $3.2\times10^{-8}$ mol of potassium hexachloroiridium IV per mol of the total silver amount of host grains was added. Then, 242 mL of an aqueous solution containing 50 g of silver nitrate, and 242 mL of an aqueous solution containing 31 g of potassium bromide and 5.8 g of potassium iodide were added by the double-jet method over 8 minutes while the flow rates were accelerated. During the addition, the silver potential was held at −45 mV with respect to a saturated calomel electrode. $9.2\times10^{-5}$ mol of potassium hexacyanoruthenate II per mol of the total silver amount of host grains was added. Then, 60 mL of an aqueous solution containing 12.5 g of silver nitrate, and 60 mL of an aqueous solution containing 8.2 g of potassium bromide and 1 g of potassium iodide were added by the double-jet method over 13 minutes with a constant flow rate, while the silver potential was held at +60 mV with respect to a saturated calomel electrode. The grain formation step was completed.

Desalting was performed by a publicly-known flocculation method at 35° C. A gelatin was added and the pH and the pAg were adjusted to 5.9 and 8.7, respectively, at 40° C., thereby obtaining the host tabular grain Em-H3b. Em-H3b comprise tabular grains, each having a (111) plane as a main plane, and with an average equivalent-circle diameter of 2.28 μm, an equivalent-circle diameter variation coefficient of 23%, an average thickness of 0.067 μm, and an average aspect ratio of 34. The Em-H3b was a silver bromoiodide emulsion having a silver iodide content of 3.9 mol %.

(Preparation of Host Tabular Grain Em-H3c)

1190 mL of an aqueous solution containing 0.5 g of potassium bromide and 2.7 g of low-molecular-weight oxidation-processed gelatin with an average molecular weight of 10,000 to 20,000 were held at 30° C. and stirred. 50 mL of an aqueous solution containing 1.8 g of silver nitrate, 50 mL of an aqueous solution containing 1.3 g of potassium bromide, and 50 mL of an aqueous solution containing 0.6 g of low-molecular-weight oxidation-processed gelatin with an average molecular weight of 10,000 to 20,000 were added simultaneously by the triple-jet method over 60 seconds. The aqueous potassium bromide solution was added to set the silver potential at −55 mV, and the temperature was raised to 75° C. Then, 35 g of oxidation-processed gelatin were added.

563 mL of an aqueous solution containing 92 g of silver nitrate, and 563 mL of an aqueous solution containing 64.5 g of potassium bromide were added by the double-jet method over 20 minutes while the flow rates were accelerated. During the addition, the silver potential was held at −45 mV with respect to a saturated calomel electrode. $3.2\times10^{-8}$ mol of potassium hexachloroiridium IV per mol of the total silver amount of host grains was added. Then, 350 mL of an aqueous solution containing 73 g of silver nitrate, and 350 mL of an aqueous solution containing 47 g of potassium bromide and 5.8 g of potassium iodide were added by the double-jet method over 10 minutes while the flow rates were accelerated. During the addition, the silver potential was held at −45 mV with respect to a saturated calomel electrode. $9.2\times10^{-5}$ mol of potassium hexacyanoruthenate II per mol of the total silver amount of host grains was added. Then, 60 mL of an aqueous solution containing 12.5 g of silver nitrate, and 60 mL of an aqueous solution containing 8.2 g of potassium bromide and 1 g of potassium iodide were added by the double-jet method over 13 minutes with a constant flow rate, while the silver potential was held at +60 mV with respect to a saturated calomel electrode. The grain formation step was completed.

Desalting was performed by a publicly-known flocculation method at 35° C. A gelatin was added and the pH and the pAg were adjusted to 5.9 and 8.7, respectively, at 40° C., thereby obtaining the host tabular grain Em-H3c. Em-H3c comprises tabular grains each having a (111) plane as a main plane, and with an average equivalent-circle diameter of 2.35 μm, an equivalent-circle diameter variation coefficient of 23%, an average thickness of 0.067 μm, and an average aspect ratio of 35. The Em-H3c was a silver bromoiodide emulsion having a silver iodide content of 3.9 mol %.

(Preparation of Comparative Emulsion Em-C1)

In the grain formation step, the same operations as in Em-H3a were performed. The following operation was added, thereby performing epitaxial deposition using the Em-H3a as host grains.

The temperature of the reaction liquid was lowered to 40° C., and an alkali-processed gelatin was added. The spectral sensitizing dyes S-2, S-8 and S-13 were added at a molar ratio of 88:8:4 at the ratio of 85% of the saturated covering amount. The spectral sensitizing dyes were used as fine solid dispersions, as in the Em-A2. After that, an aqueous silver nitrate solution and an aqueous sodium chloride solution were added by the double-jet method over 8 minutes with a constant flow rate, and epitaxial deposition was performed. The silver amount used for the epitaxial deposition was 4% of the host grains. Then the spectral sensitizing dyes S-2, S-8 and S-13 were further added at a molar ratio of 88:8:4 at the ratio of 10% of the saturated covering amount.

After that, desalting was performed by a publicly-known flocculation method at 35° C. as in the Em-B1. A gelatin was added and the pH and the pAg were adjusted to 5.9 and 8.7, respectively, at 40° C. After $5\times10^{-5}$ mol of antifoggant F-6 was added, the emulsion was raised to 50° C. The potassium thiocyanate, chloroauric acid, sodium thiosulfate, and N,N-dimethylselenourea were added to perform optimal chemical sensitization. $5\times10^{-4}$ mol of antifoggant F-1 was added to finish the chemical sensitization. The resultant emulsion was stored in a refrigerator.

The emulsion Em-C1 thus obtained was an emulsion in which 90% of the total projected area of the grains was occupied by silver halide grains each having protrusion portions formed on the surfaces of the host tabular grain. The protrusions were located mainly on the apex portions of the host tabular grain. The ratio of the silver halide grains each having a silver bromide content in the protrusion portions of 70 mol % or more, was 5% or less, with respect to the total projected area. The average silver halide composition of the protrusion portions was of silver iodide:silver bromide:silver chloride=0.4:9.2:90.4 (mol %). The average silver iodide content of all the grains was 3.8 mol %. If the average silver iodide content was assumed to be I, 48% of the total projected area of the grains were occupied by the grains each having a silver iodide content within the range of 0.6I to 1.4I.

(Preparation of Comparative Emulsion Em-C2)

In the host grain formation step, the same operations as in Em-H3b were performed. In the epitaxial deposition step and the steps that follow, the same operations as in Em-C1 were performed. Thereby, Em-C2 was prepared.

The Em-C2 thus obtained was an emulsion in which 92% of the total projected area of the grains was occupied by silver halide grains each having protrusion portions formed on the surface of the host tabular grain. The protrusion portions were located mainly on the apex portions of the host tabular grain. The ratio of the silver halide grains having a silver iodide content in the protrusion portions of 70 mol % or more, was 5% or less, with respect to the total projected area. The average halide composition in the protrusion portions and the average silver iodide content of all the grains were the same as of Em-C1. The ratio of grains each having protrusion portions, and the silver iodide content in a range of 0.6I to 1.4I was 73% of the total projected area, wherein I is the average iodide content of all the grains.

(Preparation of Comparative Emulsion Em-C3)

In the host grain formation step, the same operations as in Em-H3c were performed. In the epitaxial deposition step and the steps that follow, the same operations as in Em-C1 were performed. Thereby, Em-C3 was prepared.

The Em-C3 thus obtained was an emulsion in which 92% of the total projected area of the grains was occupied by silver halide grains each having protrusion portions formed on the surface of the host tabular grain. The protrusion portions were located mainly on the apex portions of the host tabular grain. The average silver halide composition in the protrusion portions and the average silver iodide content of al the grains were the same as those of Em-C1. 79% of the total projected area of the grains was occupied by the grains each having protrusion portions and having the silver iodide content within the range of 0.6I to 1.4I, wherein the average silver iodide content was assumed to be I.

(Preparation of Emulsion Em-C4 of the Present Invention)

In the grain formation step, the same operations as in Em-H3a were performed. The following operation was added, thereby performing epitaxial deposition using the Em-H3a as host grains.

The temperature of the reaction liquid was lowered to 40° C., and 22 g of an alkali-processed gelatin was added. Then the spectral sensitizing dyes S-2, S-8 and S-13 were added at a molar ratio of 88:8:4 at the ratio of 85% of the saturated covering amount. The spectral sensitizing dyes were used as fine solid dispersions, as in the Em-A2. After that, an aqueous silver nitrate solution and an aqueous sodium chloride solution were added by the double-jet method over 8 minutes with a constant flow rate, and epitaxial deposition was performed. During the addition, the silver potential was held at +120 mV with respect to a saturated calomel electrode. The silver amount used for the epitaxial deposition was 4% of the host grains. Then the spectral sensitizing dyes S-2, S-8 and S-13 were further added at a molar ratio of 88:8:4 at the ratio of 10% of the saturated covering amount.

After that, desalting was performed by a publicly-known flocculation method at 35° C. as in the Em-B1. A gelatin was added and the pH and the pAg were adjusted to 5.9 and 8.7, respectively, at 40° C. After $5\times10^{-5}$ mol of antifoggant F-6 was added, the emulsion was raised to 50° C. The potassium thiocyanate, chloroauric acid, sodium thiosulfate, and N,N-dimethylselenourea were added to perform optimal chemical sensitization. $5\times10^{-4}$ mol of antifoggant F-1 was added to finish the chemical sensitization. The resultant emulsion was stored in a refrigerator.

The Em-C4 thus obtained was an emulsion in which 89% of the total projected area of the grains was occupied by silver halide grains each having protrusion portions formed on the surface of the host tabular grain. The protrusion portions were located mainly on the apex portions of the host tabular grain. The ratio of the silver halide grains having the silver bromide content in the protrusion portions of 70 mol % or more, was 89%. The average halide composition in the protrusion portions was of silver iodide:silver bromide:silver chloride=0.7:99.3:0 (mol %). The average silver iodide content of all the grains was 3.8 mol %. 47% of the total projected area of the grains was occupied by the grains each having protrusion portions and having a silver iodide content within the range of 0.6I to 1.4I, wherein the average silver iodide content was assumed to be I.

(Preparation of Emulsion Em-C5 of the Present Invention)

In the host grain formation step, the same operations as in Em-H3b were performed. In the epitaxial deposition step and the steps that follow, the same operations as in Em-C4 were performed. Thereby, Em-C5 was prepared.

The Em-C5 thus obtained was an emulsion in which 93% of the total projected area of the grains was occupied by silver halide grains each having protrusion portions formed on the surface of the host tabular grain. The protrusion portions were mainly on the apex portions of the host tabular grain. The ratio of grains having the silver bromide content in the protrusion portions of 70 mol % or more, was 93% with respect to the total projected area. The average silver halide composition in the protrusion portions and the average silver iodide content of all the grains were the same as those of the Em-C4. The ratio of grains each having protrusion portions and having the iodide content within the range of 0.6I to 1.4I, was 71%, with respect to the total projected area.

(Preparation of Emulsion Em-C6 of the Present Invention)

In the host grain formation step, the same operations as in Em-H3c were performed. In the epitaxial deposition step and the steps that follow, the same operations as in Em-C4 were performed. Thereby, Em-C6 was prepared.

The Em-C6 thus obtained was an emulsion in which 94% of the total projected area of the grains was occupied by silver halide grains each having protrusion portions formed on the surface of the host tabular grain. The protrusion portions were mainly on the apex portions of the host tabular grains. The ratio of grains each having the silver bromide content in the protrusion portions of 70 mol % or more, was 94% with respect to the total projected area. The average silver halide composition in the protrusion portions and the average silver iodide content of all the grains were the same as those of the Em-C4. The ratio of grains each having protrusion portions and having the iodide content within the range of 0.6I to 1.4I, was 79%, with respect to the total projected area.

(Preparation of Samples 301 to 306 and Evaluation Concerning Photographic Properties and Pressure Resistance)

A support was coated with the emulsions Em-C1 to Em-C6 in the same manner as Example 1, and samples 301 to 306 were obtained respectively. In the preparation step of the Em-C1 to C6, an emulsion from which potassium hexacyanoruthenate II was removed was prepared and, similarly, a support was coated with the emulsion. The life of a photoelectron was measured at the same time as samples 301 to 306. Thereby, it was confirmed that a shallow electron-trapping zone was formed in the Em-C1 to C6.

The samples 301 to 306 were exposed for 1/100 sec in the same manner as Example 1 and the following color reversal development was carried out.

In this process, unexposed and completely exposed specimens of sample 301 were subjected to running processing, at a ratio of 1:1, until the replenishment volume reached to 4 times the tank volume. After that, processing for evaluation was performed.

| Processing Step | Time | Temperature | Tank volume | Replenishment rate |
|---|---|---|---|---|
| 1st development | 4 min | 38° C. | 37 L | 2,200 mL/m$^2$ |
| 1st washing | 2 min | 38° C. | 16 L | 4,000 mL/m$^2$ |
| Reversal | 2 min | 38° C. | 17 L | 1,100 mL/m$^2$ |
| Color development | 6 min | 38° C. | 30 L | 2,200 mL/m$^2$ |
| Pre-bleaching | 2 min | 38° C. | 19 L | 1,100 mL/m$^2$ |
| Bleaching | 6 min | 38° C. | 30 L | 220 mL/m$^2$ |
| Fixing | 4 min | 38° C. | 29 L | 1,100 mL/m$^2$ |
| 2nd washing | 4 min | 38° C. | 35 L | 4,000 mL/m$^2$ |
| Final rinsing | 1 min | 25° C. | 19 L | 1,100 mL/m$^2$ |

The compositions of the processing solutions were as follows.

| <1st developer> | <Tank solution> | <Replenisher> |
|---|---|---|
| Nitrilo-N,N,N-trimethylene phosphonic acid · pentasodium salt | 1.5 g | 1.5 g |
| Diethylenetriamine pentaacetic acid · pentasodium salt | 2.0 g | 2.0 g |
| Sodium sulfite | 30 g | 30 g |
| Hydroquinone · potassium monosulfonate | 20 g | 20 g |
| Potassium carbonate | 15 g | 20 g |
| Potassium bicarbonate | 12 g | 15 g |
| 1-phenyl-4-methyl-4-hydroxymethyl-3-pyrazolidone | 2.5 g | 3.0 g |
| Potassium bromide | 2.5 g | 1.4 g |
| Potassium thiocyanate | 1.2 g | 1.2 g |
| Potassium iodide | 2.0 mg | — |
| Diethyleneglycol | 13 g | 15 g |
| Water to make | 1,000 mL | 1,000 mL |
| pH | 9.60 | 9.60 |

The pH was adjusted by sulfuric acid or potassium hydroxide.

| <Reversal solution> | <Tank solution> | <Replenisher> |
|---|---|---|
| Nitrilo-N,N,N-trimethylene phosphonic acid · pentasodium salt | 3.0 g | the same as tank solution |
| Stannous chloride · dihydrate | 1.0 g | |
| p-aminophenol | 0.1 g | |
| Sodium hydroxide | 8 g | |
| Glacial acetic acid | 15 mL | |
| Water to make | 1,000 mL | |
| pH | 6.00 | |

The pH was adjusted by acetic acid or sodium hydroxide.

| <Color developer> | <Tank solution> | <Replenisher> |
|---|---|---|
| Nitrilo-N,N,N-trimethylene phosphonic acid · pentasodium salt | 2.0 g | 2.0 g |
| Sodium sulfite | 7.0 g | 7.0 g |
| Trisodium phosphate · dodecahydrate | 36 g | 36 g |
| Potassium bromide | 1.0 g | — |
| Potassium iodide | 90 mg | — |
| Sodium hydroxide | 12.0 g | 12.0 g |
| Citrazinic acid | 0.5 g | 0.5 g |
| N-ethyl-N-(β-methanesulfon amidoethyl)-3-methyl-4 aminoaniline · 3/2 sulfuric acid · monohydrate | 10 g | 10 g |
| 3,6-dithiaoctane-1,8-diol | 1.0 g | 1.0 g |
| Water to make | 1,000 mL | 1,000 mL |
| pH | 11.80 | 12.00 |

The pH was adjusted by sulfuric acid or potassium hydroxide.

| <Pre-bleaching solution> | <Tank solution> | <Replenisher> |
|---|---|---|
| Ethylenediaminetetraacetic acid · disodium salt · dihydrate | 8.0 g | 8.0 g |
| Sodium sulfite | 6.0 g | 8.0 g |
| 1-thioglycerol | 0.4 g | 0.4 g |
| Formaldehyde sodium bisulfite adduct | 30 g | 35 g |
| Water to make | 1,000 mL | 1,000 mL |
| pH | 6.30 | 6.10 |

The pH was adjusted by acetic acid or sodium hydroxide.

| <Bleaching solution> | <Tank solution> | <Replenisher> |
|---|---|---|
| Ethylenediaminetetraacetic acid·disodium salt· dihydrate | 2.0 g | 4.0 g |
| Ethylenediaminetetraacetic acid·Fe(III)·ammonium· dihydrate | 120 g | 240 g |
| Potassium bromide | 100 g | 200 g |
| Ammonium nitrate | 10 g | 20 g |
| Water to make | 1,000 mL | 1,000 mL |
| pH | 5.70 | 5.50 |

The pH was adjusted by nitric acid or sodium hydroxide.

| <Fixing solution> | <Tank solution> | <Replenisher> |
|---|---|---|
| Ammonium thiosulfate | 80 g | the same as tank solution |
| Sodium sulfite | 5.0 g | |
| Sodium bisulfite | 5.0 g | |
| Water to make | 1,000 mL | |
| pH | 6.60 | |

The pH was adjusted by acetic acid or ammonia water.

| <Stabilizer> | <Tank solution> | <Replenisher> |
|---|---|---|
| 1,2-benzoisothiazoline-3-one | 0.02 g | 0.03 g |
| Polyoxyethylene-p-monononyl phenylether (average polymerization degree = 10) | 0.3 g | 0.3 g |
| Polymaleic acid (average molecular weight = 2,000) | 0.1 g | 0.15 g |
| Water to make | 1,000 mL | 1,000 mL |
| pH | 7.0 | 7.0 |

In the above development process, the solution was continuously circulated and stirred in each bath. In addition, a blowing pipe having small holes 0.3 mm in diameter formed at intervals of 1 cm was attached to the lower surface of each tank to continuously blow nitrogen gas to stir the solution.

After the development process, the density was measured with a red filter and the sensitivity was evaluated. The value of sensitivity is adopted when the density is equal to one-half of the sum of the maximum density and minimum density. The sensitivity was indicated relative to that of the sample 301, taken as being 100. The fog was evaluated at the value of maximum density (the lower the maximum density is, the higher the fog is). The fog after storage was also evaluated by the maximum density value in the same manner as in Example 1.

Before the exposure, a 5 g load was applied with a needle having a thickness of 0.1 mmϕ, and the emulsion surface was scratched at a speed of 1 cm per second. Then the development process was performed as previously. The density of the scratched portion was measured using an aperture of 10 $\mu$mmϕ, and the occurrence of fog due to the scratch was evaluated (the lower the density is, the higher the fog is).

The results obtained are shown in Table 3 below.

As is evident from Table 3, the emulsion of the present in which the silver bromide content of the protrusion portions is 70% or more, has excellent sensitivity and storage stability. Further, when the silver iodide content of the grains is within the range of 0.6I to 1.4I (I represents an average silver iodide content), excellent pressure resistance, in that the occurrence of fog due to a scratch is considerably reduced.

Example-4

(Preparation of Host Tabular Grain Em-H4a)

A polyvinyl alcohol (having vinyl acetate with polymerization degree of 1700, and average saponification rate of 98% in alcohol, hereinafter referred to as polymer (PV)) and an aqueous gelatin solution (1250 mL of water containing 5 g of a polymer (PV) and 8 g of a deionized alkali-processed gelatin) were prepared in a reaction vessel. The pH was adjusted to 10.5 and the temperature was held at 50° C. While the resultant solution was stirred, 200 mL of Ag-1 solution (containing 0.58 mol/L of $AgNO_3$) and 200 mL of X-1 solution (containing 0.58 mol/L of KBr) were added over 35 minutes. The addition was performed by the double-jet method using a precision liquid transmission pump. The temperature of the solution was immediately raised from 50° C. to 72° C.

After 5 minutes had passed, the pH was adjusted to 5.8. An Ag-2 solution (containing 1.177 mol/L of $AgNO_3$) and a X-2 solution (containing 1.177 mol/L of KBr) were used. While the pBr was maintained at 3.1, 600 mL of each solution was added at a flow rate of 10 mL/minute by the fixed quantity double-jet method. $2.4\times10^{-8}$ mol of potassium hexachloroiridium IV per mol of the total silver amount of host grains was added. Then, an aqueous gelatin solution (200 mL of water containing 30 g of gelatin) and the spectral sensitizing dyes S-4, and S-12 were added at a molar ratio of 75:25 at the ratio of 97% of the saturated covering amount. The spectral sensitizing dyes were used as solid dispersions, as in the Em-A2. 100 mL of each of the Ag-3 solution (2.94 mol/L of $AgNO_3$) and X-3 solution (2.67 mol/L of KBr, 0.27 mol/L of KI) were added at 5 mL/minute. The grain formation step was completed.

Desalting was performed by a publicly-known flocculation method at 35° C. A gelatin was added and the pH and the pAg were adjusted to 5.9 and 8.7, respectively, at 40° C., thereby obtaining the host tabular grain Em-H4a. Em-H4a comprises tabular grains, each having a (100) plane as a main plane, and with an average equivalent-circle diameter of 0.74 $\mu$m, an equivalent-circle diameter variation coefficient of 16%, an average thickness of 0.062 $\mu$m, and an average aspect ratio of 12. The Em-H4a was a silver bromoiodide emulsion having a silver iodide content of 2.4 mol %.

TABLE 3

| Sample No. | Emulsion | Remarks | Halide composition in protrusion portion (mol %) (I/Br/Cl) | α (*) | Relative sensitivity | Maximum density | Maximum density after storage | Density after scratch in unexposed portion |
|---|---|---|---|---|---|---|---|---|
| 301 | Em-C1 | Comp. | 0.4/9.2/90.4 | 48% | 100 | 2.18 | 1.65 | 1.85 |
| 302 | Em-C2 | Comp. | 0.4/9.2/90.4 | 73% | 117 | 2.25 | 1.72 | 1.89 |
| 303 | Em-C3 | Comp. | 0.4/9.2/90.4 | 79% | 123 | 2.25 | 1.77 | 1.91 |
| 304 | Em-C4 | Inv. | 0.7/99.3/0 | 47% | 98 | 2.20 | 2.11 | 1.95 |
| 305 | Em-C5 | Inv. | 0.7/99.3/0 | 71% | 120 | 2.27 | 2.19 | 2.18 |
| 306 | Em-C6 | Inv. | 0.7/99.3/0 | 79% | 126 | 2.28 | 2.20 | 2.18 |

(*) α: Ratio, to the total projected area, of grains each having silver iodide content in a range of 0.6 I to 1.4 I to total, wherein I mol % is average silver iodide content of all grains.

(Preparation of Host Tabular Grain Em-H4b)

The host tabular grain Em-H4b was prepared in the same manner as the Em-H4a except that the following change was effected. $1.3\times10^{-5}$ mol of thiourea dioxide per mol of the silver amount of host grains was added immediately before the addition of the Ag-2 liquid was initiated. $2.8\times10^{-4}$ mol of sodium ethylthiosulfonate per mol of the silver amount of host grains was added immediately after the addition of the Ag-2 liquid was completed. Thereby, a hole-trapping zone was formed inside the grain.

(Preparation of Comparative Emulsion Em-D1)

In the grain formation step, the same operations as in Em-H4a were performed. The following operation was added, thereby performing epitaxial deposition using the Em-H4a as host grains.

An aqueous silver nitrate solution, an aqueous sodium chloride solution, and an aqueous potassium hexacyanoruthenate II were added by the triple-jet method over 5 minutes with a constant flow rate, and epitaxial deposition was performed. The silver amount used for the epitaxial deposition was 2% of the host grains. The amount of potassium hexacyanoruthenate II added was $1.3\times10^{-4}$ mol per mol of the silver amount of host grains.

After that, desalting was performed by a publicly-known flocculation method at 35° C. as in the Em-B1. A gelatin was added and the pH and the pAg were adjusted to 5.9 and 8.7, respectively, at 40° C. After $5\times10^{-5}$ mol of antifoggant F-7 was added, the emulsion was raised to 50° C. The potassium thiocyanate, chloroauric acid, sodium thiosulfate, and N,N-dimethylselenourea were added to perform optimal chemical sensitization. $5\times10^{-4}$ mol of antifoggant F-1 was added to finish the chemical sensitization. The resultant emulsion was stored in a refrigerator.

The emulsion Em-D1 thus obtained was an emulsion in which 85% of the total projected area of the grains was occupied by silver halide grains each having portions formed on the surface of the host tabular grains. The protrusion portions were located mainly on the apex portions of the host tabular grain. The halogen composition of the protrusions was of silver iodide:silver bromide:silver chloride=0.5:7.0:92.5 (mol %).

(Preparation of Comparative Emulsion Em-D2)

The Em-D2 was prepared in the same manner as the Em-D1 except that, in the preparation process, the process of preparing the Em-H4a was changed to that of Em-H4b, thereby introducing a hole-trapping zone within the host grain.

The ratio of the silver halide grains each having protrusion portions formed on the host tabular grains to the total projected area of the grains of the Em-D2, and the halogen composition of the protrusions were the same as those of the Em-D1.

(Preparation of Emulsion Em-D3 of the Invention)

In the grain formation step, the same operations as in Em-H4a were performed. The following operation was added, thereby performing epitaxial deposition using the Em-H4a as host grains.

An aqueous silver nitrate solution, an aqueous sodium bromide solution, and an aqueous potassium hexacyanoruthenate II were added by the triple-jet method over 5 minutes with a constant flow rate, and epitaxial deposition was performed. During the addition, the silver potential was held at +120 mV with respect to a saturated calomel electrode. The silver amount used for the epitaxial deposition was 2% of the host grains. The amount of potassium hexacyanoruthenate II added was $1.3\times10^{-4}$ mol per mol of the total silver amount of host grains.

After that, desalting was performed by a publicly-known flocculation method at 35° C. as in the Em-D1. A gelatin was added and the pH and the pAg were adjusted to 5.9 and 8.7, respectively, at 40° C. After $5\times10^{-5}$ mol of antifoggant F-7 was added, the emulsion was raised to 50° C. The potassium thiocyanate, chloroauric acid, sodium thiosulfate, and N,N-dimethylselenourea were added to perform optimal chemical sensitization. $5\times10^{-4}$ mol of antifoggant F-1 was added to finish the chemical sensitization. The resultant emulsion was stored in a refrigerator.

The emulsion Em-D3 thus obtained was an emulsion in which 87% of the total projected area of the grains was occupied by silver halide grains each having protrusion portions formed on the surface of the host tabular grains. The protrusion portions were located mainly on the apex portions of the host tabular grain. The halogen composition of the protrusions was of silver iodide:silver bromide:silver chloride=0.2:99.8:0 (mol %).

(Preparation of Emulsion Em-D4 of the Invention)

The Em-D4 was prepared in the same manner as the Em-D3 except that, in the preparation process of the host grains, the process of preparing the Em-H4a was changed to that of Em-H4b, thereby introducing a hole-trapping zone within the host grain.

The ratio of the silver halide grains each having protrusion portions formed on the host tabular grains to the total projected area of the grains of the Em-D3, and the halogen composition of the protrusions were the same as those of the Em-D3.

(Formation of Samples 401 to 404 and Evaluation Concerning Photographic Properties and Pressure Resistance)

A support was coated with the emulsions Em-D1 to Em-D4 in the same manner as Example 1, and samples 401 to 404 were obtained respectively. It was confirmed by the same manner as in Example 3 that a shallow electron-trapping zone was formed within the grain. The samples 401 to 406 were exposed for 1/100 sec in the same manner as Example 1 and the following color negative development was carried out.

By using the FP-350 negative processor manufactured by Fuji Photo Film Co., Ltd., the resultant samples were processed by the following method (until the accumulated replenisher amount of each solution was three times the mother solution tank volume).

(Processing Method)

| Step | Time | | Temperature | Replenishment rate* |
|---|---|---|---|---|
| Color development | 2 min. | 45 sec. | 38° C. | 45 mL |
| Bleaching | 1 min. | 00 sec. | 38° C. | 20 mL bleaching solution overflow was entirely supplied into bleach-fix tank |
| Bleach-fix | 3 min. | 15 sec. | 38° C. | 30 mL |
| Washing (1) | | 40 sec. | 35° C. | counter flow piping from (2) to (1) |
| Washing (2) | 1 min. | 00 sec. | 35° C. | 30 mL |
| Stabilization | | 40 sec. | 38° C. | 20 mL |
| Drying | 1 min. | 15 sec. | 55° C. | |

*The replenishment rate is represented by a value per 1.1 m of a 35-mm wide sample (equivalent to one role of 24 Ex. film).

The compositions of the processing solutions are presented below.

| | Tank solution (g) | Replenisher (g) |
|---|---|---|
| (Color developer) | | |
| Diethylenetriamine pentaacetic acid | 1.0 1.1 | |
| 1-hydroxyethylidene-1,1-diphosphonic acid | 2.0 | 2.0 |
| Sodium sulfite | 4.0 | 4.4 |
| Potassium carbonate | 30.0 | 37.0 |
| Potassium bromide | 1.4 | 0.7 |
| Potassium iodide | 1.5 mg | |
| Hydroxyaminesulfate | 2.4 | 2.3 |
| 4-[N-ethyl-N-(β-hydroxy ethyl) amino]-2-methyl aniline sulfate | 4.5 | 5.5 |
| Water to make | 1.0 L | 1.0 L |
| pH (adjusted by potassium hydroxide and sulfuric acid) | 10.05 | 10.10 |
| (Bleaching solution) common to tank solution and replenisher (g) | | |
| Ferric ammonium ethylenediamine tetraacetate dihydrate | 120.0 | |
| Disodium ethylenediamine tetraacetate | 10.0 | |
| Ammonium bromide | 100.0 | |
| Ammonium nitrate | 10.0 | |
| Bleaching accelerator $(CH_3)_2N\text{-}CH_2\text{-}CH_2\text{-}S\text{-}S\text{-}CH_2\text{-}CH_2\text{-}N(CH_3)_2\cdot 2HCl$ | | 0.005 mol |
| Ammonia water (27%) | 15.0 mL | |
| Water to make | 1.0 L | |
| pH (adjusted by ammonia water and nitric acid) | | 6.3 |
| (Bleach-fix bath) | | |
| Ferric ammonium ethylene diaminetetraacetate dihydrate | 50.0 | — |
| Disodium ethylenediamine tetraacetate | 5.0 | 2.0 |
| Sodium sulfite | 12.0 | 20.0 |
| Aqueous ammonium thiosulfate solution (700 g/L) | 240.0 mL | 400.0 mL |

-continued

| | Tank solution (g) | Replenisher (g) |
|---|---|---|
| Ammonia water (27%) | 6.0 mL | — |
| Water to make | 1.0 L | 1.0 L |
| pH (adjusted by ammonia water and acetic acid) | 7.2 | 7.3 |
| (Washing water) common to tank solution and replenisher | | |

Tap water was supplied to a mixed-bed column filled with an H type strongly acidic cation exchange resin (Amberlite IR-120B: available from Rohm & Haas Co.) and an OH type basic anion exchange resin (Amberlite IR-400) to set the concentrations of calcium and magnesium to be 3 mg/L or less. Subsequently, 20 mg/L of sodium isocyanuric acid dichloride and 0.15 g/L of sodium sulfate were added. The pH of the solution ranged from 6.5 to 7.5.

| (Stabilizer) | common to tank solution and replenisher (g) |
|---|---|
| Sodium p-toluenesulfinate | 0.03 |
| Polyoxyethylene-p-monononyl phenylether (average polymerization degree 10) | 0.2 |
| Disodium ethylenediaminetetraacetate | 0.05 |
| 1,2,4-triazole | 1.3 |
| 1,4-bis(1,2,4-triazole-l-ylmethyl) piperazine | 0.75 |
| Water to make | 1.0 L |
| pH | 8.5 |

After the development process, the density was measured with a red filter and the sensitivity was evaluated. The density at the fog density plus 0.2 is adopted as the sensitivity value. The sensitivity was indicated relative to that of the sample 401, taken as being 100. The storability and the reciprocity law property at low illumination were also evaluated in the same manner as in Example 1.

The results obtained are shown in Table 4 below.

TABLE 4

| Sample No. | Emulsion | Remarks | Halide composition in protrusion portion (mol %) (I/Br/Cl) | Hole-trapping zone | Relative sensitivity (1/100 sec.) | Fog | Fog after storage | Relative sensitivity (20 sec.) |
|---|---|---|---|---|---|---|---|---|
| 401 | Em-D1 | Comp. | 0.5/7.0/92.5 | None | 100 | 0.14 | 0.27 | 68 |
| 402 | Em-D2 | Com. | 0.5/7.0/92.5 | Present | 148 | 0.19 | 0.35 | 98 |
| 403 | Em-D3 | Inv. | 0.2/99.8 | None | 100 | 0.12 | 0.15 | 85 |
| 404 | Em-D4 | Inv. | 0.2/99.8 | Present | 148 | 0.14 | 0.19 | 138 |

As is evident from Table 4, the emulsion of the present invention in which the silver bromide content of the protrusion portions is 70% or more, as long as hole-trapping zones exist in the grain, has a more remarkable effect concerning reduction of fog after storage and decrease in reciprocity law failure at low illumination, than the comparative emulsion having a low silver bromide content.

Example 5

Multi-layered color photographic lightsensitive material was made using the following method.

(Making of Sample 501)

(1) Preparation of Triacetylcellulose Film

Triacetylcellulose was dissolved (13% by mass) by a common solution casting process in dichloromethane/methanol=92/8 (mass ratio), and triphenyl phosphate and biphenyldiphenyl phosphate in a mass ratio of 2:1, which are plasticizers, were added to the resultant solution so that the total amount of the plasticizers was 14% to the triacetylcellulose. Then, a triacetylcellulose film was made by a band process. The thickness of the support after drying was 97 μm.

(2) Components of Undercoat Layer

The two surfaces of the triacetylcellulose film were subjected to undercoating treatment. Numbers represent weight contained per 1 liter of an undercoat solution.

The two surfaces of the triacetylcellulose film were subjected to corona discharge treatment before undercoating treatment.

| | |
|---|---|
| Gelatin | 10.0 g |
| Salicylic acid | 0.5 g |
| Glycerin | 4.0 g |
| Acetone | 700 mL |
| Methanol | 200 mL |
| Dichloromethane | 30 mL |
| Formaldehyde | 0.1 mg |
| Water to make | 1.0 L |

(3) Coating of Back Layers

One surface of the undercoated support was coated with the following back layers.

| | |
|---|---|
| 1st Layer | |
| Binder: acid-processed gelatin (isoelectric point 9.0) | 1.00 g |
| Polymeric latex: P-2 (average grain size 0.1 μm) | 0.13 g |
| Polymeric latex: P-3 (average grain size 0.2 μm) | 0.23 g |
| Ultraviolet absorbent U-1 | 0.030 g |
| Ultraviolet absorbent U-3 | 0.010 g |
| Ultraviolet absorbent U-4 | 0.020 g |
| High-boiling organic solvent Oil-2 | 0.030 g |
| Surfactant W-3 | 0.010 g |
| Surfactant W-6 | 3.0 mg |
| 2nd layer | |
| Binder: acid-processed gelatin (isoelectric point 9.0) | 3.10 g |
| Polymeric latex: P-3 (average grain size 0.2 μm) | 0.11 g |
| Ultraviolet absorbent U-1 | 0.030 g |
| Ultraviolet absorbent U-3 | 0.010 g |
| Ultraviolet absorbent U-4 | 0.020 g |
| High-boiling organic solvent Oil-2 | 0.030 g |
| Surfactant W-3 | 0.010 g |

-continued

| | |
|---|---|
| Surfactant W-6 | 3.0 mg |
| Dye D-2 | 0.10 g |
| Dye D-10 | 0.12 g |
| Potassium sulfate | 0.25 g |
| Calcium chloride | 0.5 mg |
| Sodium hydroxide | 0.03 g |
| 3rd layer | |
| Binder: acid-processed gelatin (isoelectric point 9.0) | 3.30 g |
| Surfactant W-3 | 0.020 g |
| Potassium sulfate | 0.30 g |
| Sodium hydroxide | 0.03 g |
| 4th layer | |
| Binder: lime-processed gelatin (isoelectric point 5.4) | 1.15 g |
| 1:9 copolymer of methacrylic acid and methylmethacrylate (average grain size 2.0 μm) | 0.040 g |
| 6:4 copolymer of methacrylic acid and methylmethacrylate (average grain size 2.0 μm) | 0.030 g |
| Surfactant W-3 | 0.060 g |
| Surfactant W-2 | 7.0 mg |
| Hardener H-1 | 0.23 g |

(4) Coating of Photosensitive Emulsion Layers

Sample 501 was made by coating photosensitive emulsion layers presented below on the side opposite to the side having the back layers. Numbers represent addition amounts per $m^2$. Note that the effects of added compounds are not restricted to the described purposes.

| | | |
|---|---|---|
| 1st layer: Antihalation layer | | |
| Black colloidal silver | | 0.25 g |
| Gelatin | | 2.40 g |
| Ultraviolet absorbent U-1 | | 0.15 g |
| Ultraviolet absorbent U-3 | | 0.15 g |
| Ultraviolet absorbent U-4 | | 0.10 g |
| Ultraviolet absorbent U-5 | | 0.10 g |
| High-boiling organic solvent Oil-1 | | 0.10 g |
| High-boiling organic solvent Oil-2 | | 0.10 g |
| High-boiling organic solvent Oil-5 | | 0.010 g |
| Dye D-4 | | 1.0 mg |
| Dye D-8 | | 2.5 mg |
| Fine crystal solid dispersion of dye E-1 | | 0.05 g |
| 2nd layer: Interlayer | | |
| Gelatin | | 0.50 g |
| Compound Cpd-A | | 0.2 mg |
| Compound Cpd-K | | 3.0 mg |
| Compound Cpd-M | | 0.030 g |
| Ultraviolet absorbent U-6 | | 6.0 mg |
| High-boiling organic solvent Oil-3 | | 0.010 g |
| High-boiling organic solvent Oil-4 | | 0.010 g |
| High-boiling organic solvent Oil-7 | | 2.0 mg |
| Dye D-7 | | 4.0 mg |
| 3rd layer: Interlayer | | |
| Yellow colloidal silver | silver | 0.020 g |
| Silver iodobromide emulsion whose surface and internal portion are fogged (cubic, average silver iodide 1%, average equivalent-sphere grain size 0.06 μm) | silver | 0.010 g |
| Gelatin | | 0.60 g |
| Compound Cpd-D | | 0.020 g |
| High-boiling organic solvent Oil-3 | | 0.010 g |
| High-boiling organic solvent Oil-8 | | 0.010 g |
| 4th layer: Low-speed red-sensitive emulsion layer | | |
| Emulsion Em-A1 | silver | 0.40 g |
| Gelatin | | 0.80 g |

-continued

| | | | |
|---|---|---|---|
| Coupler C-1 | | 0.15 | g |
| Coupler C-2 | | 7.0 | mg |
| Coupler C-10 | | 3.0 | mg |
| Coupler C-12 | | 2.0 | mg |
| Ultraviolet absorbent U-3 | | 0.010 | g |
| Compound Cpd-I | | 0.020 | g |
| Compound Cpd-D | | 3.0 | mg |
| Compound Cpd-J | | 2.0 | mg |
| High-boiling organic solvent Oil-10 | | 0.030 | g |
| Additive P-1 | | 5.0 | mg |
| 5th layer: Medium-speed red-sensitive emulsion layer | | | |
| Emulsion C | silver | 0.15 | g |
| Emulsion D | silver | 0.15 | g |
| Gelatin | | 0.70 | g |
| Coupler C-1 | | 0.15 | g |
| Coupler C-2 | | 7.0 | mg |
| Coupler C-10 | | 3.0 | mg |
| Compound Cpd-D | | 3.0 | mg |
| Ultraviolet absorbent U-3 | | 0.010 | g |
| High-boiling organic solvent Oil-10 | | 0.030 | g |
| Additive P-1 | | 7.0 | mg |
| 6th layer: High-speed red-sensitive emulsion layer | | | |
| Emulsion E | silver | 0.15 | g |
| Emulsion F | silver | 0.20 | g |
| Gelatin | | 1.50 | g |
| Coupler C-1 | | 0.60 | g |
| Coupler C-2 | | 0.015 | g |
| Coupler C-3 | | 0.030 | g |
| Coupler C-10 | | 5.0 | mg |
| Ultraviolet absorbent U-1 | | 0.010 | g |
| Ultraviolet absorbent U-2 | | 0.010 | g |
| High-boiling organic solvent Oil-6 | | 0.030 | g |
| High-boiling organic solvent Oil-9 | | 0.020 | g |
| High-boiling organic solvent Oil-10 | | 0.050 | g |
| Compound Cpd-D | | 5.0 | mg |
| Compound Cpd-K | | 1.0 | mg |
| Compound Cpd-F | | 0.030 | g |
| Additive P-1 | | 0.010 | g |
| Additive P-4 | | 0.030 | g |
| 7th layer: Interlayer | | | |
| Gelatin | | 0.70 | g |
| Additive P-2 | | 0.10 | g |
| Dye D-5 | | 0.020 | g |
| Dye D-9 | | 6.0 | mg |
| Compound Cpd-I | | 0.010 | g |
| Compound Cpd-M | | 0.040 | g |
| Compound Cpd-O | | 3.0 | mg |
| Compound Cpd-P | | 5.0 | mg |
| High-boiling organic solvent Oil-6 | | 0.050 | g |
| 8th layer: Interlayer | | | |
| Yellow colloidal silver | silver | 0.020 | g |
| Gelatin | | 1.00 | g |
| Additive P-2 | | 0.05 | g |
| Ultraviolet absorbent U-1 | | 0.010 | g |
| Ultraviolet absorbent U-3 | | 0.010 | g |
| Compound Cpd-A | | 0.050 | g |
| Compound Cpd-D | | 0.030 | g |
| Compound Cpd-M | | 0.050 | g |
| High-boiling organic solvent Oil-3 | | 0.010 | g |
| High-boiling organic solvent Oil-6 | | 0.050 | g |
| 9th layer: Low-speed green-sensitive emulsion layer | | | |
| Emulsion C | silver | 0.25 | g |
| Emulsion H | silver | 0.30 | g |
| Emulsion I | silver | 0.25 | g |
| Gelatin | | 1.30 | g |
| Coupler C-4 | | 0.20 | g |
| Coupler C-5 | | 0.050 | g |
| Coupler C-6 | | 0.020 | g |
| Compound Cpd-A | | 5.0 | mg |
| Compound Cpd-B | | 0.030 | g |
| Compound Cpd-D | | 5.0 | mg |
| Compound Cpd-G | | 2.5 | mg |
| Compound Cpd-F | | 0.010 | g |
| Compound Cpd-K | | 2.0 | mg |

-continued

| | | | |
|---|---|---|---|
| Ultraviolet absorbent U-6 | | 5.0 | mg |
| High-boiling organic solvent Oil-2 | | 0.25 | g |
| Additive P-1 | | 5.0 | mg |
| 10th layer: Medium-speed green-sensitive emulsion layer | | | |
| Emulsion I | silver | 0.30 | g |
| Emulsion J | silver | 0.30 | g |
| Silver bromide emulsion which is internally fogged (cubic, average equivalent-sphere grain size 0.11 μm) | silver | 3.0 | mg |
| Gelatin | | 0.70 | g |
| Coupler C-4 | | 0.25 | g |
| Coupler C-5 | | 0.050 | g |
| Coupler C-6 | | 0.020 | g |
| Compound Cpd-A | | 5.0 | mg |
| Compound Cpd-B | | 0.030 | g |
| Compound Cpd-F | | 0.010 | g |
| Compound Cpd-G | | 2.0 | mg |
| High-boiling organic solvent Oil-2 | | 0.20 | g |
| High-boiling organic solvent Oil-9 | | 0.050 | g |
| 11th layer: High-speed green-sensitive emulsion layer | | | |
| Emulsion K | silver | 0.40 | g |
| Gelatin | | 0.80 | g |
| Coupler C-4 | | 0.30 | g |
| Coupler C-5 | | 0.080 | g |
| Coupler C-7 | | 0.050 | g |
| Compound Cpd-A | | 5.0 | mg |
| Compound Cpd-B | | 0.030 | g |
| Compound Cpd-F | | 0.010 | g |
| High-boiling organic solvent Oil-2 | | 0.20 | g |
| High-boiling organic solvent Oil-9 | | 0.050 | g |
| 12th layer: Yellow filter layer | | | |
| Yellow colloidal silver | silver | 0.010 | g |
| Gelatin | | 1.0 | g |
| Compound Cpd-C | | 0.010 | g |
| Compound Cpd-M | | 0.10 | g |
| High-boiling organic solvent Oil-1 | | 0.020 | g |
| High-boiling organic solvent Oil-6 | | 0.10 | g |
| Fine crystal solid dispersion of dye E-2 | | 0.20 | g |
| 13th layer: Interlayer | | | |
| Gelatin | | 0.40 | g |
| Compound Cpd-Q | | 0.20 | g |
| Dye D-6 | | 3.0 | mg |
| 14th layer: Low-speed blue-sensitive emulsion layer | | | |
| Emulsion L | silver | 0.15 | g |
| Emulsion N | silver | 0.20 | g |
| Emulsion N | silver | 0.10 | g |
| Gelatin | | 0.80 | g |
| Coupler C-8 | | 0.020 | g |
| Coupler C-9 | | 0.30 | g |
| Coupler C-10 | | 5.0 | mg |
| Compound Cpd-B | | 0.10 | g |
| Compound Cpd-I | | 8.0 | mg |
| Compound Cpd-K | | 1.0 | mg |
| Compound Cpd-M | | 0.010 | g |
| Ultraviolet absorbent U-6 | | 0.010 | g |
| High-boiling organic solvent Oil-2 | | 0.010 | g |
| 15th layer: Medium-speed blue-sensitive emulsion layer | | | |
| Emulsion N | silver | 0.20 | g |
| Emulsion O | silver | 0.20 | g |
| Silver bromide emulsion which is internally fogged (cubic, average equivalent-sphere grain size 0.11 μm) | silver | 3.0 | mg |
| Gelatin | | 0.80 | g |
| Coupler C-8 | | 0.020 | g |
| Coupler C-9 | | 0.25 | g |
| Coupler C-10 | | 0.010 | g |
| Compound Cpd-B | | 0.10 | g |
| Compound Cpd-E | | 0.030 | g |
| Compound Cpd-N | | 2.0 | mg |
| High-boiling organic solvent Oil-2 | | 0.010 | g |

-continued

16th layer: High-speed blue-sensitive emulsion layer

| | | | |
|---|---|---|---|
| Emulsion P | silver | 0.20 | g |
| Emulsion Q | silver | 0.25 | g |
| Gelatin | | 2.00 | g |
| Coupler C-3 | | 5.0 | mg |
| Coupler C-8 | | 0.10 | g |
| Coupler C-9 | | 1.00 | g |
| Coupler C-10 | | 0.020 | g |
| High-boiling organic solvent Oil-2 | | 0.10 | g |
| High-boiling organic solvent Oil-3 | | 0.020 | g |
| Ultraviolet absorbent U-6 | | 0.10 | g |
| Compound Cpd-B | | 0.20 | g |
| Compound Cpd-N | | 5.0 | mg |

17th layer: 1st protective layer

| | | |
|---|---|---|
| Gelatin | 1.00 | g |
| Ultraviolet absorbent U-1 | 0.15 | g |
| Ultraviolet absorbent U-2 | 0.050 | g |
| Ultraviolet absorbent U-5 | 0.20 | g |
| Compound Cpd-O | 5.0 | mg |
| Compound Cpd-A | 0.030 | g |
| Compound Cpd-H | 0.20 | g |
| Dye D-1 | 8.0 | mg |
| Dye D-2 | 0.010 | g |
| Dye D-3 | 0.010 | g |
| High-boiling organic solvent Oil-3 | 0.10 | g |

-continued

18th layer: 2nd protective layer

| | | | |
|---|---|---|---|
| Colloidal silver | silver | 2.5 | mg |
| Fine grain silver iodobromide emulsion (average grain size 0.06 μm, AgI content 1 mol %) | silver | 0.10 | g |
| Gelatin | | 0.80 | g |
| Ultraviolet absorbent U-1 | | 0.030 | g |
| Ultraviolet absorbent U-6 | | 0.030 | g |
| High-boiling organic solvent Oil-3 | | 0.010 | g |

19th layer: 3rd protective layer

| | | |
|---|---|---|
| Gelatin | 1.00 | g |
| Polymethylmethacrylate (average grain size 1.5 μm) | 0.10 | g |
| 6:4 copolymner of methylmethacrylate and methacrylic acid (average grain size 1.5 pm) | 0.15 | g |
| Silicone oil SO-1 | 0.20 | g |
| Surfactant W-1 | 3.0 | mg |
| Surfactant W-2 | 3.0 | mg |
| Surfactant W-3 | 0.040 | g |
| Surfactant W-7 | 0.015 | g |

In addition to the above compositions, additives F-1 to F-9 were added to all emulsion layers. Also, a gelatin hardener H-1 and surfactants W-3, W-4, W-5, and W-6 for coating and emulsification were added to each layer.

Furthermore, phenol, 1,2-benzisothiazoline-3-one, 2-phenoxyethanol, phenethylalcohol, and p-benzoic butylester were added as antiseptic and mildewproofing agents.

TABLE 5

| Emulsion | Characteristics | Average equivalent-sphere grain size (μm) | Variation coefficient (%) | Average AgI content (mol %) | Halide composition structure of silver halide grain | AgI content (mol %) in grain surface | Other characteristics (1) | (2) | (3) | (4) | (5) |
|---|---|---|---|---|---|---|---|---|---|---|---|
| C | Monodisperse (111) tabular grain Average aspect ratio 9.0 | 0.30 | 19 | 3.0 | Triple structure | 0.1 | ○ | ○ | | ○ | ○ |
| D | Monodisperse (111) tabular grain Average aspect ratio 10.0 | 0.35 | 21 | 4.8 | Triple structure | 2.0 | ○ | ○ | | ○ | ○ |
| E | Monodisperse (111) tabular grain Average aspect ratio 14.0 | 0.40 | 10 | 2.0 | Quadruple structure | 1.5 | | ○ | | | |
| F | Monodisperse (111) tabular grain Average aspect ratio 18.5 | 0.55 | 12 | 1.6 | Triple structure | 0.6 | ○ | ○ | | | ○ |
| G | Monodisperse cubic grain | 0.15 | 9 | 3.5 | Quadruple structure | 2.0 | | | ○ | | |
| H | Monodisperse cubic grain | 0.24 | 12 | 4.9 | Quadruple structure | 0.1 | ○ | ○ | | ○ | |
| I | Monodisperse (111) tabular grain Average aspect ratio 9.0 | 0.30 | 12 | 3.5 | Quintuple structure | 4.5 | ○ | ○ | | ○ | ○ |
| J | Monodisperse (111) tabular grain Average aspect ratio 10.0 | 0.45 | 21 | 3.0 | Quadruple structure | 0.2 | ○ | ○ | | ○ | ○ |
| K | Monodisperse (111) tabular grain Average aspect ratio 20.5 | 0.60 | 13 | 2.7 | Triple structure | 1.3 | ○ | ○ | | | ○ |
| L | Monodisperse tetradecahedral grain | 0.31 | 9 | 7.5 | Triple structure | 7.0 | | | ○ | | ○ |

TABLE 5-continued

| Emulsion | Characteristics | Average equivalent-sphere grain size (μm) | Variation coefficient (%) | Average AgI content (mol %) | Halide composition structure of silver halide grain | AgI content (mol %) in grain surface | Other characteristics (1) | (2) | (3) | (4) | (5) |
|---|---|---|---|---|---|---|---|---|---|---|---|
| M | Monodisperse tetradecahedral grain | 0.31 | 9 | 7.5 | Triple structure | 5.0 | ○ | ○ | | ○ | ○ |
| N | Monodisperse (111) tabular grain Average aspect ratio 7.0 | 0.33 | 13 | 2.1 | Quadruple structure | 4.0 | ○ | ○ | ○ | | |
| O | Monodisperse (111) tabular grain Average aspect ratio 11.0 | 0.43 | 9 | 2.5 | Quadruple structure | 1.0 | ○ | ○ | | ○ | ○ |
| P | Monodisperse (111) tabular grain Average aspect ratio 20.0 | 0.75 | 21 | 2.8 | Triple structure | 0.5 | ○ | ○ | | | ○ |

(Other characteristics; ○ = satisfy the condition)
(1): A reduction sensitizer was added during grain formation.
(2): A selenium sensitizer was used as a chemical sensitizer.
(3): Rhodium salt was added during grain formation.
(4): After chemical sensitization, silver nitrate in an amount of 10 mol % with respect to the emulsion grains that are present at the time of addition thereof, and an equimolar amount of potassium bromide, were added to form shell.
(5): 10 or more dislocation lines were observed per grain on the average with a transmission electron microscope.
Note that all photosensitive emulsions were chemically sensitized by using sodium thiosulfate, potassium thiocyanate, and sodium chloroaurate.
Note also that iridium salt was appropriately added during grain formation.
Note also that chemically modified gelatin whose amino groups were partially modified to phthalic acid amide, was added to emulsions B, C, E, H, J, N, and Q during preparation thereof.

TABLE 6

Spectral sensitization of emulsions A-P

| Emulsion | Added sensitizing dyes | Addition amount (g) per mol of silver halide | Addition time of sensitizing dyes |
|---|---|---|---|
| C | S-2 | 0.45 | Before chemical sensitization |
| | S-8 | 0.04 | Before chemical sensitization |
| | S-13 | 0.02 | Before chemical sensitization |
| D | S-2 | 0.5 | After chemical sensitization |
| | S-3 | 0.05 | After chemical sensitization |
| | S-8 | 0.05 | Before chemical sensitization |
| | S-13 | 0.015 | Before chemical sensitization |
| E | S-1 | 0.01 | Before chemical sensitization |
| | S-2 | 0.45 | Before chemical sensitization |
| | S-8 | 0.05 | Before chemical sensitization |
| | S-13 | 0.01 | After chemical sensitization |
| F | S-2 | 0.4 | Before chemical sensitization |
| | S-3 | 0.04 | Before chemical sensitization |
| | S-8 | 0.04 | Before chemical sensitization |
| G | S-4 | 0.3 | After chemical sensitization |
| | S-5 | 0.05 | After chemical sensitization |

TABLE 6-continued

Spectral sensitization of emulsions A-P

| Emulsion | Added sensitizing dyes | Addition amount (g) per mol of silver halide | Addition time of sensitizing dyes |
|---|---|---|---|
| | S-12 | 0.1 | After chemical sensitization |
| H | S-4 | 0.2 | Before chemical sensitization |
| | S-5 | 0.05 | After chemical sensitization |
| | S-9 | 0.15 | Before chemical sensitization |
| | S-14 | 0.02 | After chemical sensitization |
| I | S-4 | 0.3 | Before chemical sensitization |
| | S-9 | 0.2 | Before chemical sensitization |
| | S-12 | 0.1 | Before chemical sensitization |
| J | S-4 | 0.35 | Before chemical sensitization |
| | S-5 | 0.05 | After chemical sensitization |
| | S-12 | 0.1 | Before chemical sensitization |
| K | S-4 | 0.3 | Before chemical sensitization |
| | S-9 | 0.05 | Before chemical sensitization |
| | S-12 | 0.1 | Before chemical sensitization |
| | S-14 | 0.02 | Before chemical sensitization |
| L, M | S-6 | 0.1 | After chemical sensitization |

TABLE 6-continued

Spectral sensitization of emulsions A-P

| Emulsion | Added sensitizing dyes | Addition amount (g) per mol of silver halide | Addition time of sensitizing dyes |
|---|---|---|---|
| | S-10 | 0.2 | After chemical sensitization |
| | S-11 | 0.05 | After chemical sensitization |
| N | S-6 | 0.05 | After chemical sensitization |
| | S-7 | 0.05 | After chemical sensitization |
| | S-10 | 0.25 | After chemical sensitization |
| | S-11 | 0.05 | After chemical sensitization |
| O | S-10 | 0.4 | After chemical sensitization |
| | S-11 | 0.15 | After chemical sensitization |
| P | S-6 | 0.05 | After chemical sensitization |
| | S-7 | 0.05 | After chemical sensitization |
| | S-10 | 0.3 | Before chemical sensitization |
| | S-11 | 0.1 | Before chemical sensitization |

TABLE 6-continued

Spectral sensitization of emulsions A-P

| Emulsion | Added sensitizing dyes | Addition amount (g) per mol of silver halide | Addition time of sensitizing dyes |
|---|---|---|---|
| Q | S-6 | 0.05 | Before chemical sensitization |
| | S-7 | 0.05 | Before chemical sensitization |
| | S-10 | 0.2 | Before chemical sensitization |
| | S-11 | 0.25 | Before chemical sensitization |

C-1

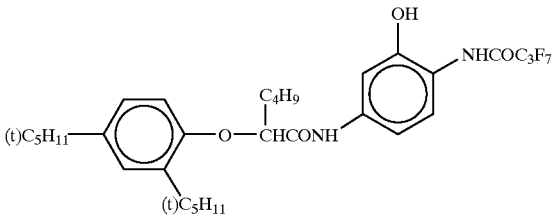

C-2

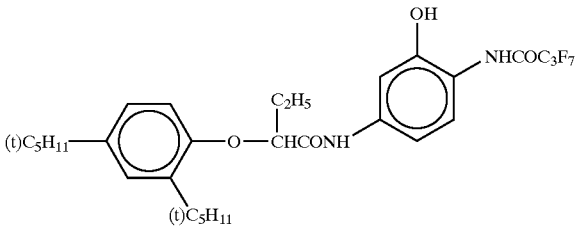

C-3

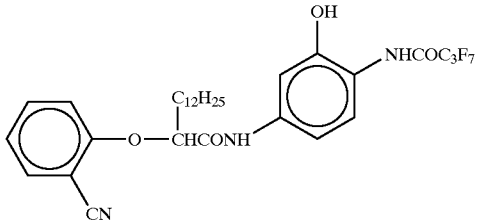

C-4

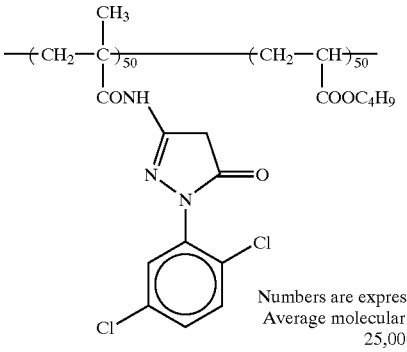

Numbers are expressed in weight%
Average molecular weight: About 25,000

-continued
C-5
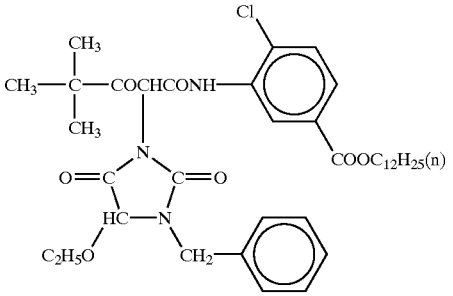
C-6
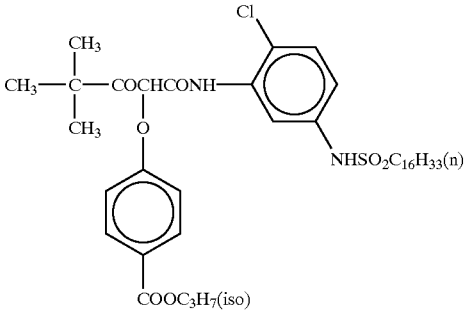
C-7
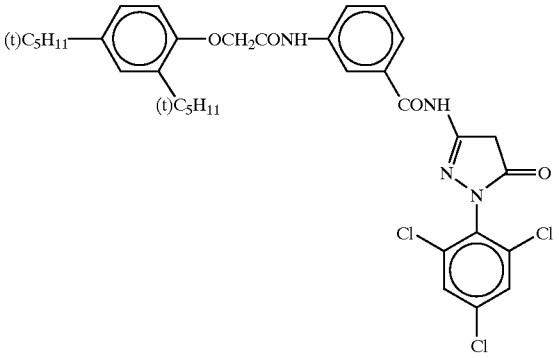
C-8
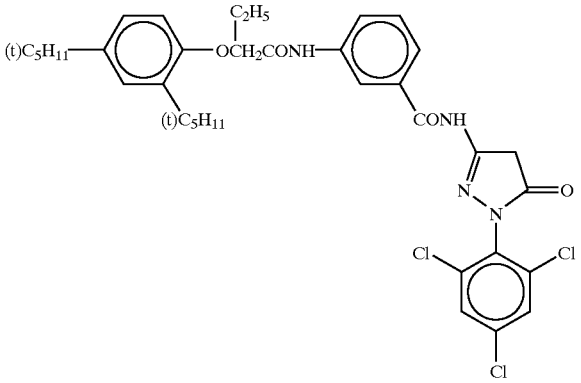
C-9
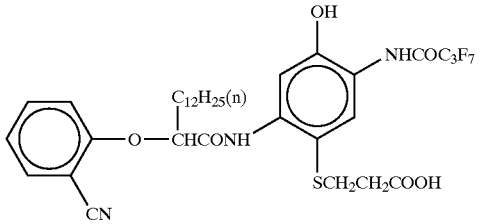
C-10
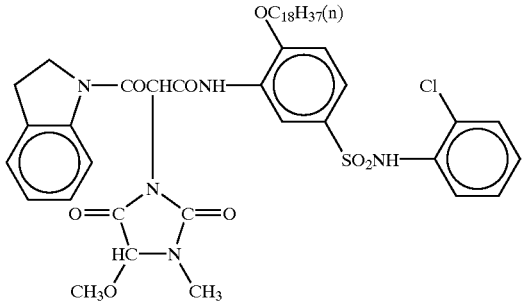
C-11
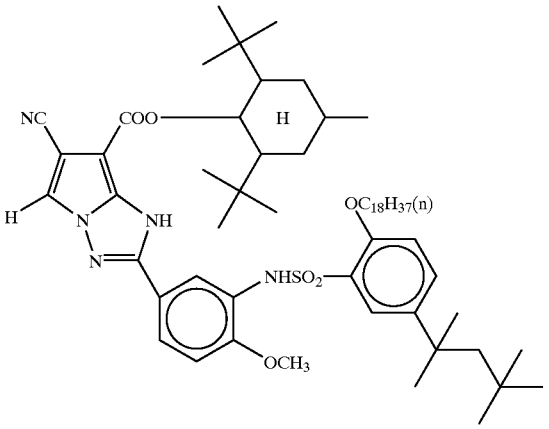
C-12
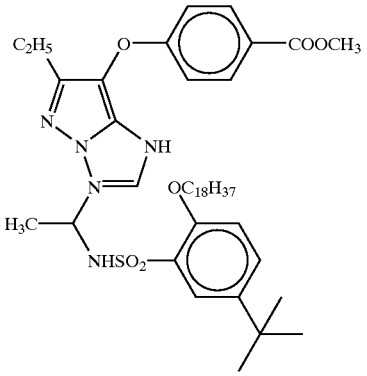

-continued
C-13
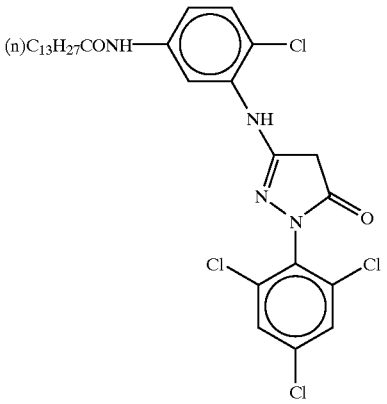
Oil-1
Tri-n-hexyl phophate
Oil-2
Tricresyl phosphate
Oil-3
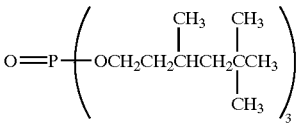
Oil-4
Tricyclohexyl phosphate
Oil-5
Di-2-ethylhextyl succinate
Oil-6
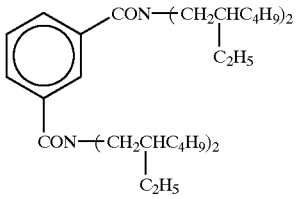
Oil-7
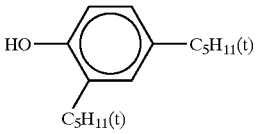
Oil-8
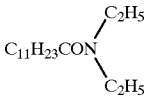
Oil-9
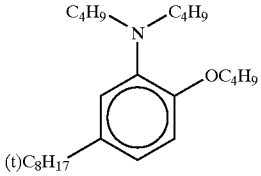
Oil-10
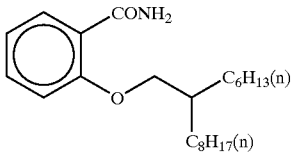
Cpd-A
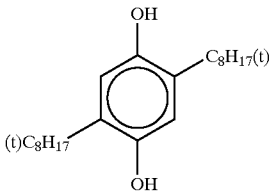
Cpd-B
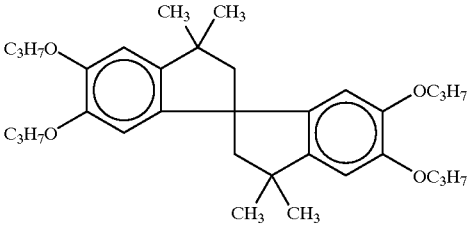
Cpd-C
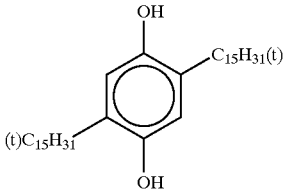

-continued
Cpd-D
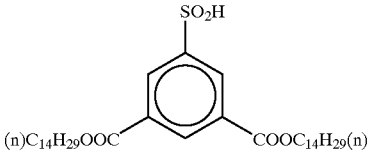
Cpd-E
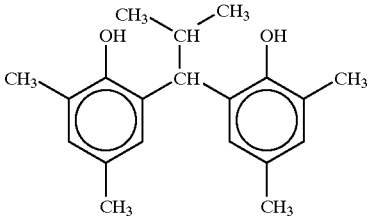
Cpd-F
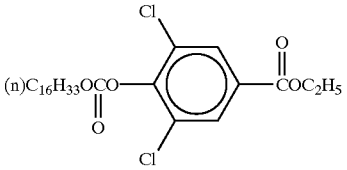
Cpd-G
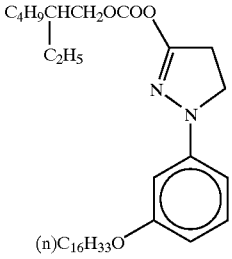
Cpd-H
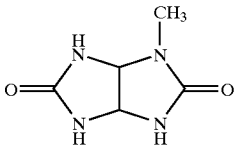
Cpd-I
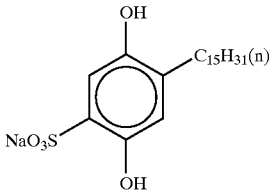
Cpd-J
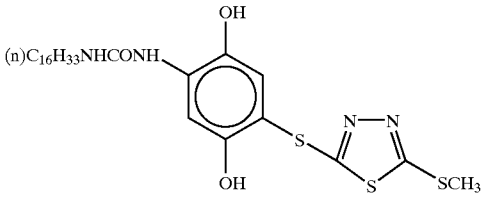
Cpd-K
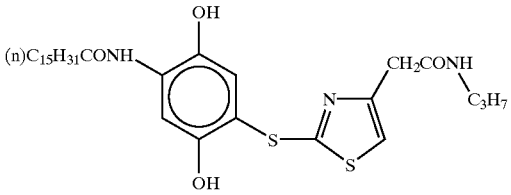
Cpd-L
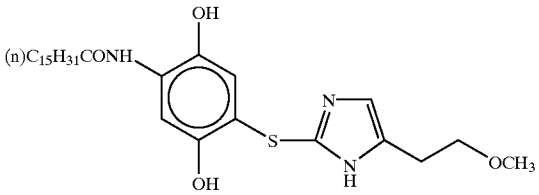
Cpd-M
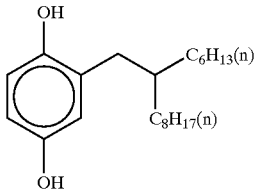
Cpd-N
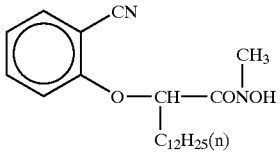
Cpd-O
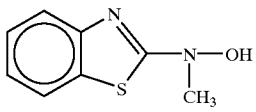
Cpd-P
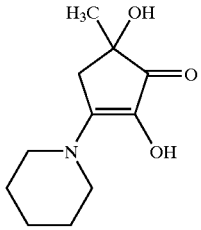
Cpd-Q
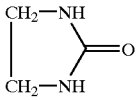

-continued
U-1
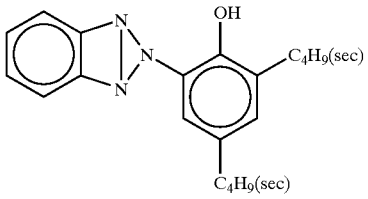
U-2
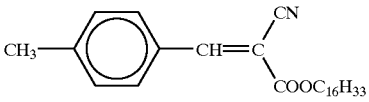
U-3
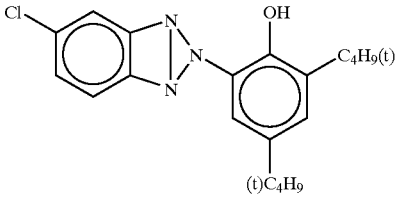
U-4
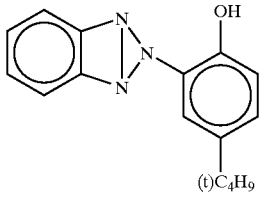
U-5
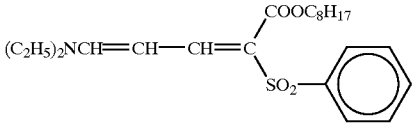
U-6
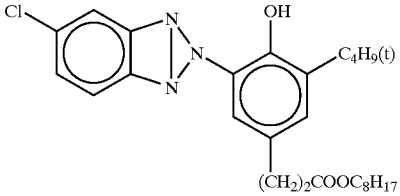
S-1
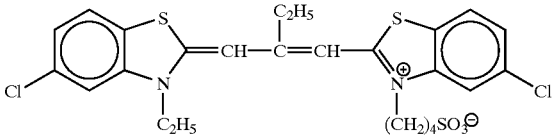
S-2
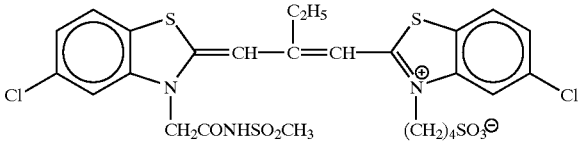
S-3
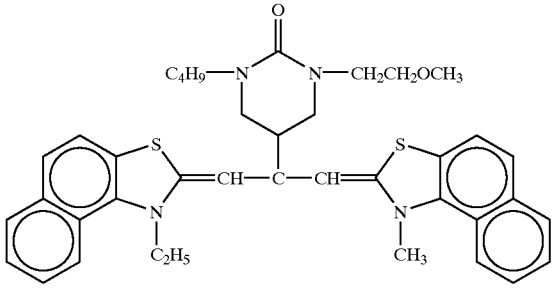
S-4
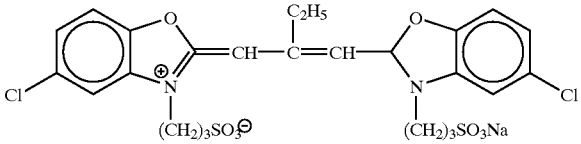
S-5
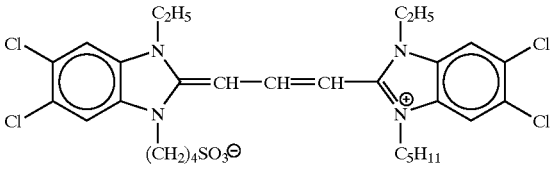
S-6
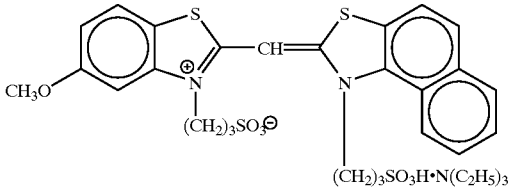
S-7
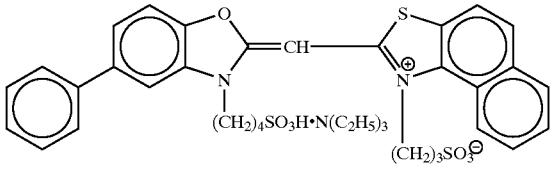
S-8
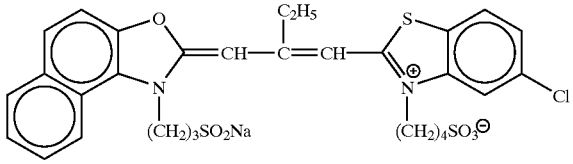

-continued
S-9
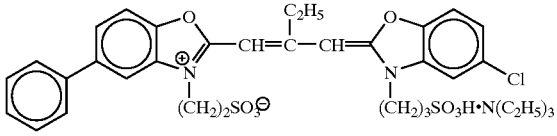
S-10
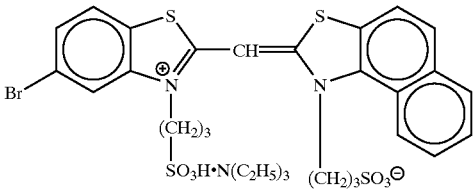
S-11
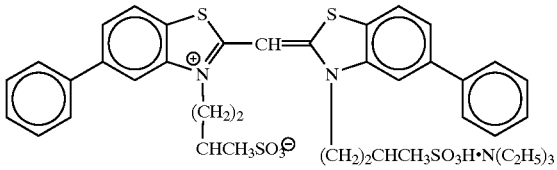
S-12
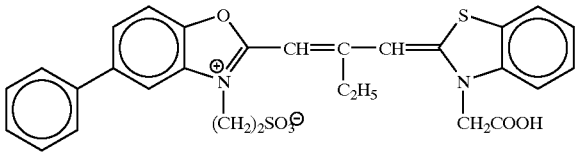
S-13
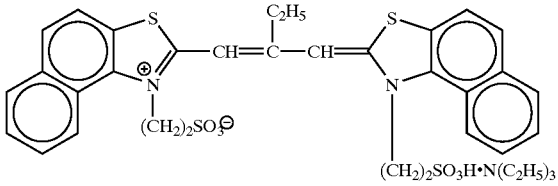
S-14
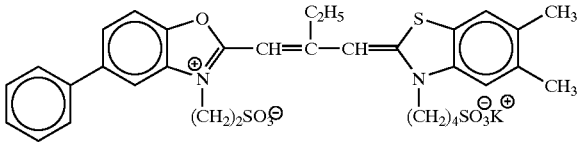
D-1
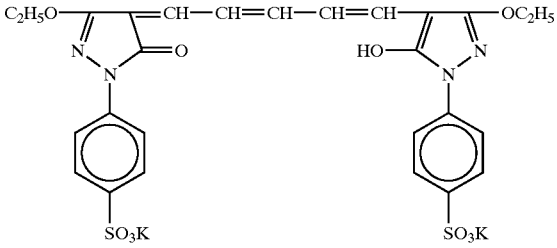
D-2
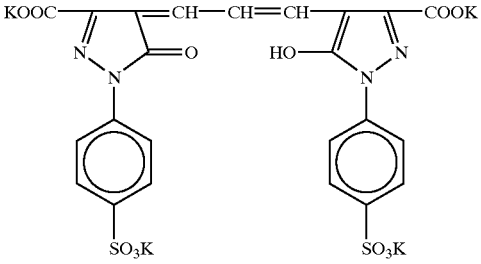
D-3
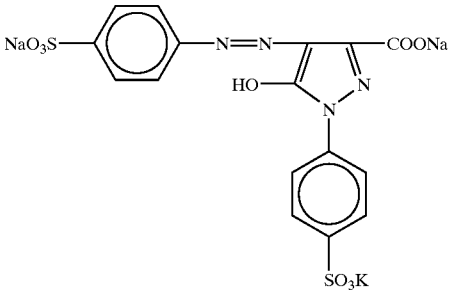
D-4
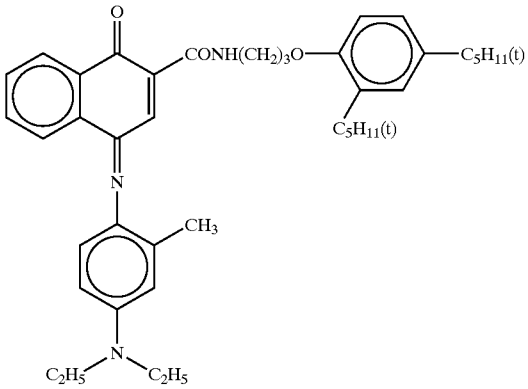
D-5
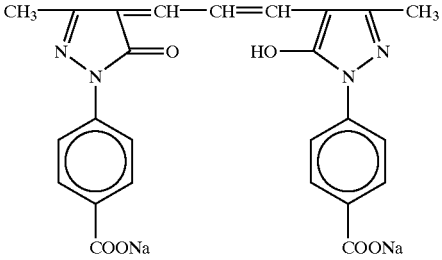
D-6
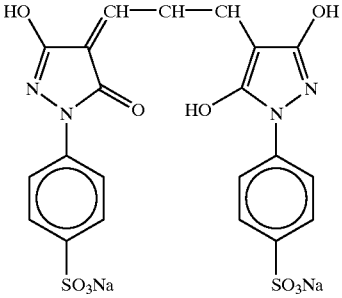

-continued
D-7
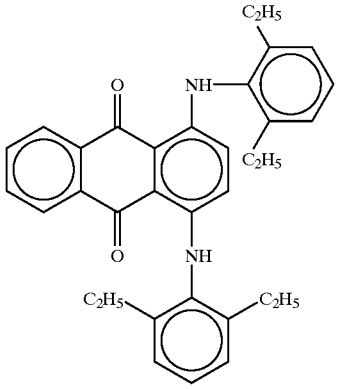
D-8
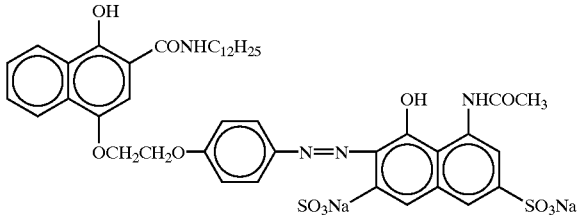
D-9
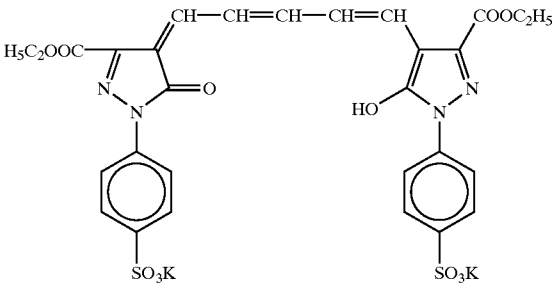
D-10
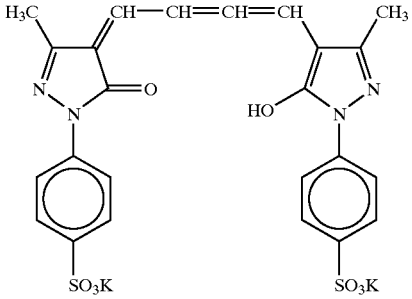
E-1
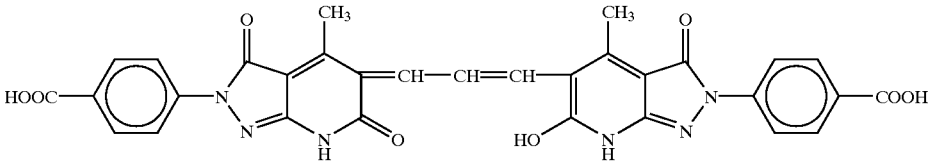
E-2
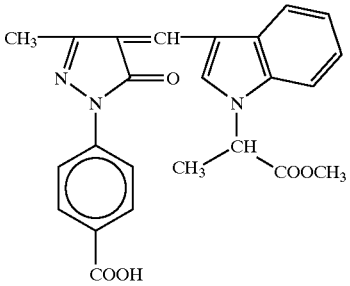
H-1
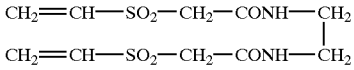
W-1
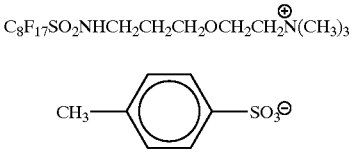
W-2
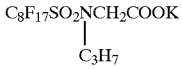
W-3
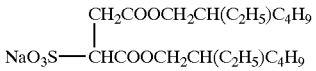
W-4
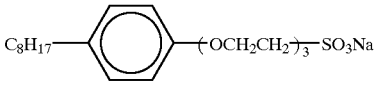

-continued

W-5

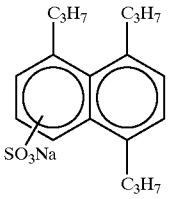

$C_8F_{17}SO_3Li$

W-6

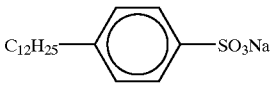

W-7

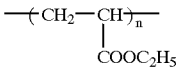

(n = 100–1000)

P-1

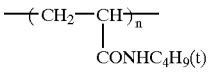

(n = 100–1000)

P-2

(n = 100–1000)

SO-1

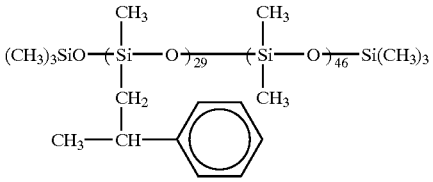

F-1

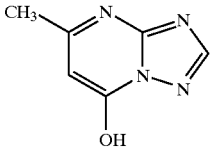

F-2

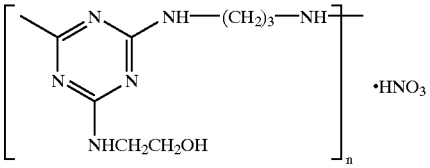

(n = 3 ~ 4)

F-3

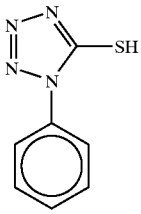

F-4

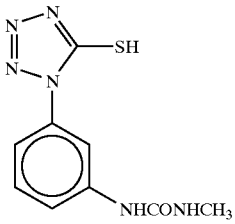

F-5

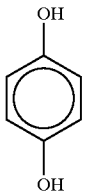

F-6

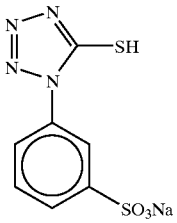

F-7

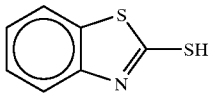

F-8

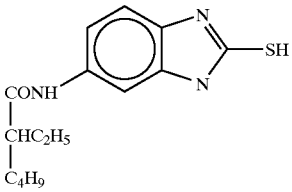

Preparation of Dispersions of Organic Solid Disperse Dyes (Preparation of Dispersion of Dye E-1)

100 g of Pluronic F88 (an ethylene oxide-propylene oxide block copolymer) manufactured by BASF CORP. and water were added to a wet cake of the dye E-1 (the net weight of E-1 was 270 g), and the resultant material was stirred to make 4,000 g. Next, the Ultra Visco Mill (UVM-2) manufactured by Imex K.K. was filled with 1,700 mL of zirconia beads with an average grain size of 0.5 mm, and the slurry was milled through this UVM-2 at a peripheral speed of approximately 10 m/sec and a discharge rate of 0.5 L/min for 2 hr. The beads were filtered out, and water was added to dilute the material to a dye concentration of 3%. After that, the material was heated to 90° C. for 10 hr for stabilization. The average grain size of the obtained fine dye grains was 0.30 μm, and the grain size distribution (grain size standard deviation X 100/average grain size) was 20%.

(Preparation of Solid Dispersion of Dye E-2)

Water and 270 g of W-4 were added to 1,400 g of a Processing Step Time Tempera-Tank Replenishment wet cake of E-2 containing 30 mass % of water, and the resultant material was stirred to form a slurry having an E-2 concentration of 40 mass %. Next, the Ultra Visco Mill (UVM-2) manufactured by Imex K.K. was filled with 1,700 mL of zirconia beads with an average grain size of 0.5 mm, and the slurry was milled through this UVM-2 at a peripheral speed of approximately 10 m/sec and a discharge rate of 0.5 L/min for 8 hr, thereby obtaining a solid fine-grain dispersion of E-2. This dispersion was diluted to 20 mass % by ion exchange water to obtain a solid fine-grain dispersion. The average grain size was 0.15 μm.

(Preparation of Samples 502–504)

Sample 502 was prepared by replacing the emulsion Em-A1 used in sample 501 with the same silver amount of emulsion Em-A8. Similarly, Samples 503 and 504 were prepared by replacing the emulsion Em-A1 used in sample 501 with the same silver amount of emulsions Em-A9 and -A12, respectively.

(Evaluation of Photographic Properties, Storage Stability, and Reciprocity Law Properties at Low Illumination)

The samples 501 to 504 were exposed and the development was carried out in the same manner as Example 3. The photographic properties were evaluated. However, the time of performing the first development process was changed to 6 minutes. The sensitivity was expressed by the sensitivity point at which the cyan density was 1.0. The sensitivity was indicated relative to that of the sample 501, taken as being 100. The fog was evaluated at the value of maximum density (the lower the maximum density is, the higher the fog is). The evaluation method of the storability and the reciprocity law properties at low illumination was conducted in according to that of Example 1.

The results obtained are shown in Table 7 below.

As is evident from Table 7, the effect of the preset invention can also be obtained in multiplayer color photographic lightsensitive materials.

Example 6

(Preparation of Host Tabular Grain Em-H6)

The host tabular grain Em-H6 was prepared by sequentially performing the following operations.

(1) Grain Formation Step (1-1) Nucleation Step 1400 mL of an aqueous solution containing 1 g of potassium bromide and 1 g of low-molecular-weight oxidation-processed gelatin with an average molecular weight of 10,000 to 20,000 were held at 35° C. and stirred. 100 mL of an aqueous solution containing 2 g of silver nitrate, 100 mL of an aqueous solution containing 1.4 g of potassium bromide, and 50 mL of an aqueous solution containing 0.3 g of low-molecular-weight oxidation-processed gelatin with an average molecular weight of 10,000 to 20,000 were added simultaneously by the triple-jet method over 50 seconds.

(1-2) Ripening Step

The aqueous potassium bromide solution was added to set the silver potential at −55 mV, and the temperature was raised to 55° C. Then, 30 g of succinated gelatin were added.

(1-3) First Growth Step 600 mL of an aqueous solution containing 195 g of silver nitrate, and 600 mL of an aqueous solution containing 137 g of potassium bromide were added by the double-jet method over 32 minutes while the flow rates were accelerated. During the addition, the silver potential was held at −20 mV with respect to a saturated calomel electrode.

(1-4) Second Growth Step 40 mL of an aqueous solution containing 10 g of silver nitrate, and 40 mL of an aqueous solution containing 6.6 g of potassium bromide and 0.85 g of potassium iodide were added by the double-jet method over 4 minutes with a constant flow rate. During the addition, the silver potential was held at 0 mV with respect to a saturated calomel electrode.

TABLE 7

| Sample No. | Emulsion in 4th layer | Remarks | Halide composition in protrusion portion (mol %) (I/Br/Cl) | Silver amount in protrusion portion (with respect to host grains | Shallow electron-trapping zone | Spectral sensitizer | Calcium |
|---|---|---|---|---|---|---|---|
| 501 | Em-A1 | Comp. | | 0 | none | S-2/S-13 | none |
| 502 | Em-A8 | Comp. | 0.6/23.9/75.5 | 9 | present | S-2/S-13 | none |
| 503 | Em-A9 | Inv. | 0.5/99.5/0 | 9 | present | S-2/S-13 | none |
| 504 | Em-A1 | Comp. | | 0 | none | S-2/S-13 | none |

| Sample No. | Relative sensitivity at a density of 1.0 (1/100 sec.) | Maximum density | Maximum density after storage | Relative sensitivity at a density of 1.0 (20 sec.) | Magenta residual color |
|---|---|---|---|---|---|
| 501 | 100 | 3.34 | 3.28 | 35 | 0.057 |
| 502 | 219 | 3.25 | 2.84 | 138 | 0.060 |
| 503 | 224 | 3.29 | 3.18 | 182 | 0.057 |
| 504 | 231 | 3.30 | 3.21 | 186 | 0.019 |

(1-5) Third Growth Step 50 mL of an aqueous solution containing 12 g of silver nitrate, and 50 mL of an aqueous solution containing 7.4 g of potassium bromide and 1 g of potassium iodide were added by the double-jet method over 8 minutes with a constant flow rate. During the addition, the silver potential was held at +50 mV with respect to a saturated calomel electrode. $5.0\times10^{-5}$ mol of potassium hexacyanoferrate(II) per mol of silver amount of host grains was added 4 minutes after starting the addition. Thereby, a shallow electron-trapping zone was formed inside the grain.

(2) Desalting and Dispersing Step

Desalting is performed by a publicly-known flocculation method at 35° C. A gelatin was added and the pH and the pAg were adjusted to 5.9 and 8.5, respectively, at 50°C.

The emulsion Em-H6 obtained comprises tabular grains, each having a (111) plane as a main plane, and with an average equivalent-circle diameter of 0.77 μm, an equivalent-circle diameter variation coefficient of 22%, an average thickness of 0.070 μm, and an average aspect ratio of 11. The Em-H6 was a silver bromoiodide emulsion having a silver iodide content of 3.9 mol %.

(Preparation of Comparative Emulsion Em-E2)

(1) Grain Formation Step

The same operations as in Em-H6 were performed.

(2) Epitaxial Deposition Step

The following operation was added following the grain formation step, thereby performing epitaxial deposition using the Em-H6 as host grains.

The temperature of the reaction liquid was lowered to 35° C., and 12 g of an alkali-processed gelatin was added. The spectral sensitizing dyes S-1, S-8 and S-13 were added at a molar ratio of 36:60:4, with the amount of 90% of the saturated covering amount.

After that, an aqueous silver nitrate solution and an aqueous sodium chloride solution were added by the double-jet method over 12 minutes with a constant flow rate, and epitaxial deposition was performed. The silver amount used for the epitaxial deposition was 16% of the host grains. Then the spectral sensitizing dyes S-1, S-8 and S-13 were further added at a molar ratio of 36:60:4, as dispersions at an amount corresponding to 10% of the saturated covering amount.

(2) Desalting and Dispersing Step

Desalting was performed by a publicly-known flocculation method at 35° C. as in the Em-H6. A gelatin was added and the pH and the pAg were adjusted to 5.9 and 8.5, respectively, at 50° C.

(3) Chemical Sensitization Step

After $5\times10^{-5}$ mol of antifoggant F-6 was added, the emulsion was held at 50 C. The chloroauric acid, sodium thiosulfate, and N,N-dimethylselenourea were added to perform optimal chemical sensitization. 5× mol of antifoggant F-1 was added to finish the chemical sensitization. The resultant emulsion was stored in a refrigerator.

The emulsion Em-E2 thus obtained was an emulsion in which 92% of the total projected area of the grains was occupied by silver halide grains each having protrusion portions formed on the surface of the host tabular grain. The protrusion portions were located mainly on the apex portions of the host tabular grain. The average silver iodide content was 3.8 mol %, and the halogen composition of the protrusion portions was of silver iodide:silver bromide:silver chloride=0.5:9.2:90.3 (mol %).

(Preparation of Comparative Emulsion Em-E3)

(1) Grain Formation Step

The same operations as in Em-E2 were performed.

(2) Epitaxial Deposition Step

The following operation was added following the grain formation step, thereby performing epitaxial deposition using the Em-H6 as host grains.

The temperature of the reaction liquid was lowered to 35° C., and 12 g of an alkali-processed gelatin was added. The spectral sensitizing dyes S-1, S-8 and S-13 were added at a molar ratio of 36:60:4, with the amount of 90% of the saturated covering amount, in the same manner as Em-E2.

After that, an aqueous silver nitrate solution and an aqueous sodium chloride solution were added by the double-jet method over 12 minutes with a constant flow rate, and epitaxial deposition was performed. During the addition, the silver potential was held at +150 mV with respect to a saturated calomel electrode. The silver amount used for the epitaxial deposition was 16% of the host grains. Then the spectral sensitizing dyes S-1, S-8 and S-13 were further added at a molar ratio of 36:60:4, as dispersions with the amount corresponding to 10% of the saturated covering amount.

(2) Desalting and Dispersing Step

The same operations as in Em-E2 were performed.

(3) Chemical Sensitization Step

The same operations as in Em-E2 were performed.

The emulsion Em-E3 thus obtained was an emulsion in which 93% of the total projected area of the grains was occupied by silver halide grains each having protrusion portions formed on the surface of the host tabular grain. The protrusions were located mainly on the apex portions of the host tabular grain. The average silver iodide content was 3.8 mol %, and the halogen composition of the protrusion portions was of silver iodide:silver bromide:silver chloride= 0.5:99.5:0 (mol %).

(Preparation of Comparative Emulsion Em-E4)

The emulsion Em-E4 was prepared in the same manner as the emulsion Em-E2, except that in the preparation process, the addition time of the aqueous silver nitrate solution and the aqueous sodium chloride solution for the epitaxial deposition was changed to 6 minutes while maintaining a constant flow rate, thereby reducing the silver amount of the protrusion portions to 8% with respect to the silver amount of the host grain.

(Preparation of Comparative Emulsion Em-E5)

The emulsion Em-E8 was prepared in the same manner as the emulsion Em-E3, except that in the preparation process, the addition time of the aqueous silver nitrate solution and the aqueous sodium chloride solution for the epitaxial deposition was changed to 6 minutes while maintaining a constant flow rate, thereby reducing the silver amount of the protrusions to 8% in relation to the silver amount of the host grain.

(Preparation of Comparative Emulsion Em-E6)

The emulsion Em-E6 was prepared in the same manner as the emulsion Em-E2, except that in the preparation process, $1\times10^{-3}$ mol/molAg of potassium thiocyanate in relation to the total silver amount of host grains was added immediately before addition of the aqueous silver nitrate and sodium chloride solutions for epitaxial deposition.

(Preparation of Comparative Emulsion Em-E7)

The Em-E7 was prepared in the same manner as the emulsion Em-E3, except that in the preparation process, $1\times10^{-3}$ mol/molAg of potassium thiocyanate in relation to the total silver amount of host grains was added immediately before addition of the aqueous silver nitrate and sodium bromide solutions for epitaxial deposition.

(Preparation of Comparative Emulsion Em-E8)

The Em-E8 was prepared in the same manner as the emulsion Em-E4, except that in the preparation process, $1\times10^{-3}$ mol/molAg of potassium thiocyanate in relation to the total silver amount of host grains was added immediately before addition of the aqueous silver nitrate and sodium chloride solutions for epitaxial deposition.

(Preparation of Emulsion Em-E9 of the Present Invention)

The Em-E9 was prepared in the same manner as the emulsion Em-E5, except that in the preparation process, $1\times10^{-3}$ mol/molAg of potassium thiocyanate in relation to the total silver amount of host grains was added immediately before addition of the aqueous silver nitrate and sodium bromide solutions for epitaxial deposition.

(Preparation of Emulsion Em-E10 of the Present Invention)

The Em-E10 was prepared in the same manner as the emulsion Em-E9, except that in the preparation process, is the addition time of the aqueous silver nitrate solution and the aqueous sodium chloride solution for the epitaxial deposition was changed to 4 minutes and 30 seconds while maintaining a constant flow rate, thereby reducing the silver amount of the protrusion portions to 6% in relation to the silver amount of the host grain.

(Preparation of Comparative Emulsion Em-E1)

The Em-E1 was prepared in the same manner as the emulsion Em-E10, except that in the preparation process, the protrusion portions were not formed by omitting the step of adding the aqueous silver nitrate solution and the aqueous sodium bromide solution for epitaxial deposition.

(Formation of Samples 601 to 610)

A support was coated with the emulsions Em-E1 to Em-E10 in the same manner as Example 1, and samples 601 to 610 were obtained respectively.

(Evaluation Concerning Photographic Properties, Storability and Reciprocity Law Property at Low Illumination)

The samples 601 to 610 were exposed for 1/100 sec through a gelatin filter SC-5 manufactured by Fuji Photo Film Co., Ltd. The color negative development was performed as in Example 4.

After the development is performed, density measurement was carried out using a red filter, and sensitivity and fog were evaluated. The sensitivity value at which the density is fog density plus 0.2 was adopted as the sensitivity value. The sensitivity was indicated by the relative value when the sensitivity of the sample 601 is assumed to be 100.

A similar evaluation was performed concerning the sample which was stored for 7 days at 50° C. and a relative humidity of 55% before exposure. The storability was evaluated.

The reciprocity law property at low illumination was evaluated by performing exposure with the exposure time changed from 1/100 sec to 60 sec while maintaining the exposure amount, and subsequently performing the same development and density measurement.

The results obtained are shown in Table 8 below.

TABLE 8

| Sample | Emulsion | Remarks | Halide composition in protrusion portion (mol %) (I/Br/Cl) | Silver amount in protrusion portion (with respect to host %) | Shallow electron-trapping zone |
|---|---|---|---|---|---|
| 601 | Em-E1 | Comp. | | 0 | present |
| 602 | Em-E2 | Comp. | 0.5/9.2/90.3 | 16 | present |
| 603 | Em-E3 | Comp. | 0.5/99.5/0 | 16 | present |
| 604 | Em-E4 | Comp. | 0.5/9.2/90.3 | 8 | present |
| 605 | Em-E5 | Inv. | 0.5/99.5/0 | 8 | present |
| 606 | Em-E6 | Comp. | 0.5/9.2/90.3 | 16 | present |
| 607 | Em-E7 | Comp. | 0.5/99.5/0 | 16 | present |
| 608 | Em-E8 | Comp. | 0.5/9.2/90.3 | 8 | present |
| 609 | Em-E9 | Inv. | 0.5/99.5/0 | 8 | present |
| 610 | Em-E10 | Inv. | 0.5/99.5/0 | 6 | present |

| Sample | Presence or absence of SCN in protrusion portion | Relative sensitivity (1/100 sec) | Fog | Fog after storage | Relative sensitivity (60 sec) |
|---|---|---|---|---|---|
| 601 | absent | 100 | 0.05 | 0.09 | 40 |
| 602 | absent | 178 | 0.12 | 0.40 | 95 |
| 603 | absent | 151 | 0.07 | 0.16 | 83 |
| 604 | absent | 224 | 0.11 | 0.41 | 120 |
| 605 | absent | 225 | 0.08 | 0.17 | 105 |
| 606 | present | 209 | 0.09 | 0.40 | 132 |
| 607 | present | 170 | 0.09 | 0.17 | 107 |
| 608 | present | 251 | 0.08 | 0.43 | 151 |
| 609 | present | 257 | 0.05 | 0.15 | 209 |
| 610 | present | 269 | 0.05 | 0.12 | 234 |

As is evident from Table 8, the emulsion of the present invention has a high sensitivity, and fog after storage is good. The emulsion also has excellent properties, that is, a very high sensitivity even in a case of an exposure at low illumination (exposure for 60 sec). It can also be understood that still better effect can be obtained in a case where the protrusion portions contain a pseudo halide, or the silver amount of the protrusion portions is 8% or less.

Example 7

(Formation of Samples 701 to 704 and Evaluation Concerning Photographic Properties and Surface Development Sensitivity/Full Development Sensitivity)

A support was coated with the emulsions Em-E4, -E5,-E8 and -E9 of Example 6 in the same manner as Example 1, and samples 701 to 704 were obtained respectively.

The development and sensitometry were performed on the sample pieces of the samples 701 to 704, based on the definition of the surface development sensitivity/full development sensitivity in the description of this text. The surface development sensitivity/full development sensitivity was determined, and is indicated relative to the surface development sensitivity of the sample 701, taken as being 100.

Then, the samples were exposed for 1/100 sec in the same manner as Example 1, and the color reversal development was carried out as in Example 3. The density measurement was carried out using a red filter, and the sensitivity was evaluated. The value of sensitivity is adopted when the density is equal to one-half of the sum of the maximum density and minimum density. The sensitivity was indicated relative to that of the sample 701, taken as being 100.

The results obtained are shown in Table 9 below.

TABLE 9

| Sample | Chloride ion content in protrusion portion (mol %) | Presence or absence of KSCN during protrusion portion formation | Surface development sensitivity | Full development sensitivity | Sensitivity (Reversal processing) |
|---|---|---|---|---|---|
| 701 | 91.3 | absent | 100 | 55 | 100 |
| 702 | 0 | absent | 80 | 85 | 130 |
| 703 | 91.3 | present | 112 | 70 | 110 |
| 704 | 0 | present | 115 | 125 | 165 |

As is evident from Table 9, in the emulsion of the present invention having high sensitivity and high storage stability in which the silver bromide content of the protrusion portions is 70% or more, the greater the full development sensitivity is, compared to the surface development sensitivity, the higher sensitivity can be obtained in a reversal processing (processing using a silver halide solvent (such as KSCN)).

Example 8

(Preparation of Emulsion Em-F1 of the Present Invention)

The emulsion Em-F1 was prepared in the same manner as the emulsion Em-A9, except that in the preparation of the emulsion Em-A9 of Example 1, the compound PP-1-1 was added after the chemical sensitization is finished.

(Preparation of Emulsion Em-F2 of the Present Invention)

The emulsion Em-F2 was prepared in the same manner as the emulsion Em-A9, except that in the preparation of the emulsion Em-A9 of Example 1, the compound PP-II-1 was added after the chemical sensitization is finished.

(Preparation of Emulsion Em-F3 of the Present Invention)

The emulsion Em-F3 was prepared in the same manner as the emulsion Em-A9, except that in the preparation of the emulsion Em-A9 of Example 1, the compound PP-III-2 was added after the chemical sensitization is finished.

(Preparation of Emulsion Em-F4 of the Present Invention)

The emulsion Em-F4 was prepared in the same manner as the emulsion Em-A9, except that in the preparation of the emulsion Em-A9 of Example 1, the compound PP-V-3 was added after the chemical sensitization is finished.

(Preparation of Emulsion Em-F5 of the Present Invention)

The emulsion Em-F5 was prepared in the same manner as the emulsion Em-A10, except that in the preparation of the emulsion Em-A10 of Example 1, the compound PP-1-1 was added after the chemical sensitization is finished.

(Preparation of Emulsion Em-F6 of the Present Invention)

The emulsion Em-F6 was prepared in the same manner as the emulsion Em-A10, except that in the preparation of the emulsion Em-A10 of Example 1, the compound PP-II-1 was added after the chemical sensitization is finished.

(Preparation of Emulsion Em-F7 of the Present Invention)

The emulsion Em-F7 was prepared in the same manner as the emulsion Em-A10, except that in the preparation of the emulsion Em-A10 of Example 1, the compound PP-III-2 was added after the chemical sensitization is finished.

(Preparation of Emulsion Em-F8 of the Present Invention)

The emulsion Em-F8 was prepared in the same manner as the emulsion Em-A10, except that in the preparation of the emulsion Em-A10 of Example 1, the compound PP-V-3 was added after the chemical sensitization is finished.

(Formation of Samples 801 to 812)

The sample 801 was formed in the same manner as the multi-layered color photographic lightsensitive material: sample 501 of Example 5. Similarly, the samples 802 and 803 were formed by replacing the emulsion Em-A1 with the same silver amount of the emulsions Em-A9 and Em-A10. Similarly, the samples 804 to 811 were formed by replacing the emulsion Em-A1 with the same silver amount of the emulsions Em-F1 to -F8.

(Evaluation Concerning Photographic Properties, Storability, Reciprocity Law Property at Low Illumination, and RMS Graininess)

The samples 801 to 811 were exposed and the development was carried out in the same manner as Example 5. The photographic properties were evaluated. The value of the sensitivity was expressed with a sensitivity point at which the cyan density was 1.0. The sensitivity was indicated relative to that of the sample 801, taken as being 100. The fog was evaluated at the value of maximum density (the lower the maximum density is, the higher the fog is). The evaluation method of the storability and the reciprocity law properties at low illumination was based on that of Example 5. Concerning the RMS graininess of the strips after processing, the RMS graininess thereof was measured when the cyan density was 1.0 and the value was indicated relative to the RMS graininess of the sample 801, taken as being 100. The smaller the value is, the better the graininess is.

The results obtained are shown in Table 10 below.

TABLE 10

| Sample | Emulsion in 4th layer | Remarks | Halide composition in protrusion portion (mol %) (I/Br/Cl) | Additive after chemical sensitization | Relative sensitivity at density 1.0 (1/100 sec) | Maximum sensitivity | Maximum sensitivity after storage | Relative sensitivity at density 1.0 (20 sec) | RMS granularity |
|---|---|---|---|---|---|---|---|---|---|
| 801 | Em-A1 | Comp. | 0 | none | 100 | 3.34 | 3.28 | 35 | 100 |
| 802 | Em-A9 | Inv. | 9 | none | 224 | 3.29 | 3.18 | 182 | 99 |
| 803 | Em-A10 | Inv. | 5 | none | 221 | 3.23 | 3.20 | 184 | 100 |
| 804 | Em-F1 | Inv. | 9 | PP-I-1 | 225 | 3.25 | 3.19 | 186 | 91 |
| 805 | Em-F2 | Inv. | 9 | PP-II-1 | 231 | 3.26 | 3.20 | 183 | 90 |
| 806 | Em-F3 | Inv. | 9 | PP-III-2 | 226 | 3.28 | 3.18 | 184 | 92 |
| 807 | Em-F4 | Inv. | 9 | PP-V-3 | 224 | 3.27 | 3.17 | 185 | 91 |
| 808 | Em-F5 | Inv. | 5 | PP-I-1 | 227 | 3.24 | 3.19 | 181 | 90 |
| 809 | Em-F6 | Inv. | 5 | PP-II-1 | 219 | 3.25 | 3.20 | 184 | 92 |
| 810 | Em-F7 | Inv. | 5 | PP-III-2 | 226 | 3.26 | 3.19 | 186 | 92 |
| 811 | Em-F8 | Inv. | 5 | PP-V-3 | 224 | 3.24 | 3.18 | 184 | 91 |

As is evident from Table 10, by using the polymer or the compound capable of selectively adsorbing to (100) surface of silver halide grain specified in the present invention, an emulsion superior in the sensitivity/graininess ratio can be prepared.

Example 9

(Preparation of Emulsion Em-G1 of the Present Invention)

The host tabular grain Em-G1 was prepared by sequentially performing the following operations.

(1) Host Grain Formation Step (1-1) Nucleation Step 1,000 mL of an aqueous solution containing 0.8 g of potassium bromide and 3 g of low-molecular-weight oxidation-processed gelatin with an average molecular weight of 10,000 to 20,000 were held at 35° C. and stirred. 30 mL of an aqueous solution containing 3 g of silver nitrate, 40 mL of an aqueous solution containing 2.2 g of potassium bromide, and 50 mL of an aqueous solution containing 1.1 g of low-molecular-weight oxidation-processed gelatin with an average molecular weight of 10,000 to 20,000 were added simultaneously by the triple-jet method over 45 seconds.

(1-2) Ripening Step

The aqueous potassium bromide solution was added to set the silver potential at −30 mV, and the temperature was raised to 68° C. Then, 26 g of succinated gelatin were added.

(1-3) First Growth Step 650 mL of an aqueous solution containing 108 g of silver nitrate, and 650 mL of an aqueous solution containing 74 g of potassium bromide and 3.2 g of potassium iodide were added by the double-jet method over 51 minutes. During the addition, the silver potential was held at 0 mV with respect to a saturated calomel electrode. After the addition is finished, the potassium bromide was added to set the silver potential at −35 mV, and the temperature of the reaction vessel was lowered to 40° C.

(1-4) Second Growth Step 130 mL of an aqueous solution containing 20 g of silver nitrate, and 130 mL of an aqueous solution containing 13.6 g of potassium bromide and 1.4 g of potassium iodide were added by the double-jet method over 18 minutes with a constant flow rate. During the addition, the silver potential was held at 15 mV with respect to a saturated calomel electrode.

(2) Epitaxial Deposition Step

The following operation was added after the grain formation step, thereby performing epitaxial deposition.

15 g of alkali-processed gelatin was added, 0.4 g of potassium iodide was added, and 0.2 mol of calcium ion was added. The spectral sensitizing dyes DYE-I-12, DYE-II-6 and S-13 were added at a molar ratio of 37:56:7, with the amount of 96% of the saturated covering amount, in the same manner as Example 1. $4.0\times10^{-5}$ mol of potassium hexacyanoruthenate(II) per mol of silver amount of host grains was added, and $2.1\times10^{-3}$ mol of potassium thiocyanate per mol of silver amount of host grains was added.

After that, an aqueous silver nitrate solution and an aqueous sodium bromide solution were added by the double-jet method over 10 minutes with a constant flow rate, and epitaxial deposition was performed. During the addition, the silver potential was held at +100 mV with respect to a saturated calomel electrode. The silver amount used for the epitaxial deposition was 5% of the host grains.

(3) Desalting and Dispersing Step

Desalting is performed by a publicly-known flocculation method at 35° C. A gelatin was added and the pH and the pAg were adjusted to 5.9 and 8.2, respectively, at 50° C.

(4) Chemical Sensitization Step

After $5\times10^{-5}$ mol of antifoggant F-6 was added, the emulsion was held at 50° C. The chloroauric acid, sodium thiosulfate, and N,N-dimethylselenourea were added to perform optimal chemical sensitization. $5\times10^{-4}$ mol of antifoggant F-1 was added to finish the chemical sensitization. The resultant emulsion was stored in a refrigerator.

The emulsion Em-G1 obtained comprises silver halide grains, in an amount of 91% of the total projected area, each composed of a tabular grain, as a host grain, having a (111) plane as a main plane, and with an average equivalent-circle diameter of 0.73 μm, an equivalent-circle diameter variation coefficient of 25%, an average thickness of 0.081 μm, and an average aspect ratio of 9; and protrusion portions were formed mainly on the apexes of the host tabular grain. The average silver iodide content of the outer-shell-8%-region (in relation to the silver amount of the host grain) of the host grain was 7 mol %. The emulsion was a silver iodobromide emulsion having an average silver iodide content of all the grains of 3.4 mol %. The halogen composition of the protrusion portions was of silver iodide:silver bromide:silver chloride=2.0:98.0:0 (mol %).

(Preparation of Emulsion Em-G2 of the Present Invention)

The emulsion Em-G2 was prepared in the same manner as the emulsion Em-G1, except that in the preparation of Em-G1, the (1-4) second growth step was changed in the following manner. The second growth step of the Em-G2 is as follows.

(1-4) Second Growth Step 130 mL of an aqueous solution containing 20 g of silver nitrate, and 130 mL of an aqueous solution containing 11.7 g of potassium bromide and 4.1 g of potassium iodide were added by the double-jet method over 18 minutes with a constant flow rate. During the addition, the silver potential was held at 15 mV with respect to a saturated calomel electrode.

The emulsion Em-G2 obtained comprises silver halide grains, in an amount of 90% of the total projected area, each composed of a tabular grain, as a host grain, having a (111) plane as a main plane, and with an average equivalent-circle diameter of 0.71 μm, an equivalent-circle diameter variation coefficient of 25%, an average thickness of 0.084 μm, and an average aspect ratio of 8.5; and protrusion portions were formed mainly on the apexes of the host tabular grain. The average silver iodide content of the outer-shell-8%-region (in relation to the silver amount of the host grain) of the host grain was 20 mol %. The emulsion was a silver iodobromide emulsion having an average silver iodide content of all the grains of 5.5 mol %. The halogen composition of the protrusion portions was of silver iodide:silver bromide:silver chloride=2.6:97.4:0 (mol %).

(Preparation of Emulsion Em-G3 of the Present Invention)

The emulsion Em-G3 was prepared in the same manner as the emulsion Em-G2, except that in the preparation of Em-G2, the (1-3) first growth step was changed in the following manner. The first growth step of the Em-G3 is as follows.

(1-3) First Growth Step

An ultrafine-grain emulsion was prepared by the external stirring apparatus described in JP-A-10-43570, using 650 mL of an aqueous solution containing 108 g of silver nitrate, 650 mL of an aqueous solution containing 74 g of potassium bromide, 3.2 g of potassium iodide, and 100 g of low-molecular-weight oxidation-processed gelatin with an average molecular weight of 20,000. The ultrafine-grain emulsion was continuously added in the reaction vessel, and the ultrafine grains were dissolved. Thereby, the host grains grew over 51 minutes. By adding an aqueous potassium bromide solution separately, the silver potential was held at 0 mV with respect to a saturated calomel electrode. After the addition is finished, the potassium bromide was added to set the silver potential at −35 mV, and the temperature of the reaction vessel was lowered to 40° C.

The emulsion Em-G3 obtained comprises silver halide grains, in an amount of 93% of the total projected area, each composed of a tabular grain, as a host grain, having a (111) plane as a main plane, and with an average equivalent-circle diameter of 0.92 μm, an equivalent-circle diameter variation coefficient of 26%, an average thickness of 0.051 μm, and an average aspect ratio of 18; and protrusion portions were formed mainly on the apexes of the host tabular grain. The average silver iodide content of the outer-shell-8%-region (in relation to the silver amount of the host grain) of the host grain was 20 mol %. The emulsion was a silver iodobromide emulsion having an average silver iodide content of all the grains of 5.5 mol %. The halogen composition of the protrusion portions was of silver iodide:silver bromide:silver chloride=2.4:97.6:0 (mol %).

(Preparation of Samples 901 to 903)

The samples 901 to 903 were formed by replacing the emulsion Em-A1 with the same silver amount of the emulsions Em-G1 to -G3, in the preparation of the multi-layered color photographic lightsensitive material: sample 501 of Example 5.

(Evaluation Concerning Photographic Properties, Storability, and Reciprocity Law Property at Low Illumination)

The samples 901 to 903 were exposed and the development was carried out in the same manner as Example 5. The photographic properties were evaluated. The value of the sensitivity was expressed at which the cyan density was 1.0. The sensitivity was indicated relative to that of the sample 901, taken as being 100. The fog was evaluated at the value of maximum density (the lower the maximum density is, the higher the fog is). The evaluation of the storability and the reciprocity law properties at low illumination was based on that of Example 5.

The results obtained are shown in Table 11 below.

TABLE 11

| Sample No. | Emulsion in 4th layer | Remarks | Average silver iodide content of all grains (mol %) | Silver iodide content in outer-shell -8%- region of host grain (mol %) | Average aspect ratio of host grain |
|---|---|---|---|---|---|
| 901 | Em-G1 | Inv. | 3.4 | 7 | 9 |
| 902 | Em-G2 | Inv. | 5.5 | 20 | 8.5 |
| 903 | Em-G3 | Inv. | 5.5 | 20 | 18 |

| Sample No. | Relative sensitivity at density 1.0 (1/100 sec) | Maximum sensitivity | Maximum sensitivity after storage | Relative sensitivity at density 1.0 (20 sec) |
|---|---|---|---|---|
| 901 | 100 | 3.34 | 3.28 | 85 |
| 902 | 135 | 3.31 | 3.25 | 114 |
| 903 | 158 | 3.32 | 3.26 | 131 |

As is evident from Table 11, the emulsion of the present invention can heighten the sensitivity in the case where the average silver iodide content in the outer-shell-8%-region (in relation to the silver amount of the host grain) of the host grain was (I+5) mol % or more, wherein I mol % is the average silver iodide content of all the grains. Further, it is more effective if the aspect ratio of the host grain is high.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed:

1. A silver halide photographic emulsion comprising grains, wherein 70% or more of the total projected area of the grains is occupied by silver halide grains each meeting requirements (a) to (d) below:

(a) the grain is composed of a tabular silver halide host grain having two mutually parallel main planes and aspect ratio of 2 or more, and a silver halide protrusion portion epitaxially junctioned on the surface of the host grain;

(b) the silver bromide contents of both the host grain and the protrusion portion are 70 mol % or more;

(c) the percentage of the silver amount in the protrusion is 12% or less of the silver amount in the host grain; and (d) the grain has a shallow electron-trapping zone.

2. The silver halide photographic emulsion according to claim 1, wherein 70% or more of the total projected area of the grains is occupied by silver halide grains each further meeting the following requirement (e) in addition to the above requirements (a) to (d):

(e) at least one main plane of the host grain has at least one apex, and the protrusion portion is present on each apex of the main plane.

3. The silver halide photographic emulsion according to claim 1, wherein 70% or more of the total projected area of the grains is occupied by silver halide grains each further meeting the following requirement (f) in addition to the above requirements (a) to (d):

(I) the silver iodide content of each silver halide grain is in a range of 0.6I to 1.4I mol %, wherein I (mol %) is the average silver iodide content of all the grains.

4. The silver halide photographic emulsion according to claim 2, wherein 70% or more of the total projected area of the grains is occupied by silver halide grains each further meeting the following requirement (f) in addition to the above requirements (a) to (e):

(f) the silver iodide content of each silver halide grain is in a range of 0.6I to 1.4I mol %, wherein I (mol %) is the average silver iodide content of all the grains.

5. The silver halide photographic emulsion according to claim 1, wherein 70% or more of the total projected area of the grains is occupied by silver halide grains each further meeting the following requirement (g) in addition to the above requirements (a) to (d):

(g) the grain has a hole-trapping zone.

6. The silver halide photographic emulsion according to claim 2, wherein 70% or more of the total projected area of the grains is occupied by silver halide grains each further meeting the following requirement (g) in addition to the above requirements (a) to (e):

(g) the grain has a hole-trapping zone.

7. The silver halide photographic emulsion according to claim 3, wherein 70% or more of the total projected area of the grains is occupied by silver halide grains each further meeting the following requirement (g) in addition to the above requirements (a) to (d) and (f):

(g) the grain has a hole-trapping zone.

8. The silver halide photographic emulsion according to claim 1, wherein 70% or more of the total projected area of the grains is occupied by silver halide grains each further meeting the following requirement (h) in addition to the above requirements (a) to (d):

(h) the protrusion portion contains a pseudo halide.

9. The silver halide photographic emulsion according to claim 1, wherein 70% or more of the total projected area of the grains is occupied by silver halide grains each further meeting the following requirement (i) in addition to the above requirements (a) to (d):

(1) the average silver iodide content in an outer-shell-8%-region (in relation to the silver amount of the host grain) of the host grain is (I+5) mol % or more, wherein I (mol %) is the average silver iodide content of all the grains.

10. The silver halide photographic emulsion according claim 1, wherein 70% or more of the total projected area of the grains is occupied by silver halide grains each further meeting the following requirement (j) in addition to the above requirements (a) to (d):

(j) the aspect ratio of the host grain is 15 or more.

11. The silver halide photographic emulsion according to claim 1, wherein 70% or more of the total projected area of the grains is occupied by silver halide grains each further meeting the following requirement (k) in addition to the above requirements (a) to (d):

(k) the emulsion has a full development sensitivity that is higher than a surface development sensitivity thereof.

12. The silver halide photographic emulsion according to claim 1, wherein at least one of the compounds represented by the following formula (DYE-I) is contained:

Formula (DYE-1)

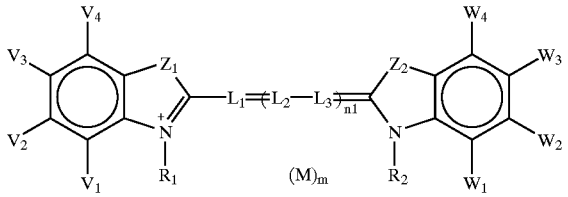

wherein $Z_1$ and $Z_2$ each independently represent an oxygen atom, a sulfur atom, a selenium atom, a tellurium atom, or a >NR group; R represents an alkyl group, an aryl group, or a heterocyclic group; each of $L_1$, $L_2$ and $L_3$ independently represents a methine group; n1 is 0, 1, 2 or 3; each of $V_1$, $V_2$, $V_3$, $V_4$, $W_1$, $W_2$, $W_3$, and $W_4$ independently represents a hydrogen atom or a substituent; two substituents may be bonded to each other to form a ring, wherein the sum of the $\pi$ value of the substituents $V_1$ to $V_4$ is regarded as $\pi V$, and the sum of the $\pi$ value of the substituents $W_1$ to $W_4$ is regarded as $\pi W$, either of the $\pi V$ or $\pi W$ is 0.70 or less; M represents a charge-balanced counter ion; m represents a number needed for neutralizing the charge of a molecule; $R_1$ represents an alkyl group, an aryl group, or a heterocyclic group; and $R_2$ represents a substituent represented by any one of the following formulae:

$-(La)_{ka}CONHSO_2Ra$, $-(Lb)_{kb}SO_2NHCORb$, $-(Lc)_{kc}CONHCORc$, $-(Ld)_{kd}SO_2NHSO_2Rd$, and $-(Le)_{ke}COOH$ wherein Ra, Rb, Rc and Rd independently represent an alkyl group, an aryl group, a heterocyclic group, an alkoxy group, an aryloxy group, heterocyclyloxy group, or an amino group; La, Lb, Lc, Ld and Le independently represent a methylene group; and ka, kb, kc, kd and ke independently represent integers of 1 or more.

13. The silver halide photographic emulsion according to claim 12, wherein calcium is contained.

14. The silver halide photographic emulsion according to claim 1, wherein a polyvinylpyrrolidone-based compound having a repeating unit represented by the following formula (PP-I) is contained:

Formula (PP-I)

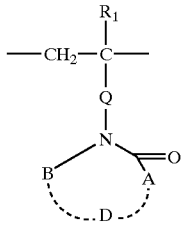

wherein $R_1$ represents a hydrogen atom or an alkyl group; Q represents a single bond, —$COOR_2$—, or —$CONHR_2$—; A represents a single bond or an oxygen atom; B represents a single bond or —CO—; D represents —$(CH{=}CH)_2$—, —$(CH_2)_n$—, provided that n is an integer of 3 to 5 when both A and B are a single bond, n is 2 or 3 when A is an oxygen atom and B is a single bond, and n is an integer of 2 to 4 when A is a single bond and B is —CO—, or D represents a phenylene group, when A is a single bond and B is —CO—; and $R_2$ represents a substituted or unsubstituted divalent hydrocarbon group having 2 to 8 carbon atoms.

15. The silver halide photographic emulsion according to claim 1, wherein the silver halide photographic emulsion contains a compound represented by the following formula (PP-II):

Formula (PP-II)

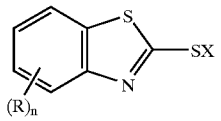

wherein X represents hydrogen or an alkali metal atom; R represents a hydrogen atom, a halogen atom, or an alkyl group having 1 to 5 carbon atoms; and n represents an integer of 1 to 4.

16. The silver halide photographic emulsion according to claim 1, wherein at least one compound selected from the group consisting of the compounds represented by the following formula (PP-III) which is capable of selectively adsorbing to the (100) plane of the silver halide grain, and a spectral sensitizing dye which is capable of selectively adsorbing to the (100) plane of the silver halide grain, is contained:

Formula (PP-III)

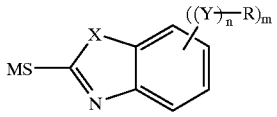

wherein R represents an alkyl group, alkenyl group, alkynyl group, aryl group, or aralkyl group, each of which may be substituted or unsubstituted; Y represents —O—, —S—, —$NR_1$—, —$NR_2CO$—, —$CONR_3$—, —$NR_4SO_2$—, —$SO_2NR_5$—, —COO—, —OCO—, —CO—, —$SO_2$—, —$NR_6CONR_7$—, —$NR_8CSNR_9$—, or —$NR_{10}COO$—; $R_1$, $R_2$, $R_3$, $R_4$, $R_5$, $R_6$, $R_7$, $R_8$, $R_9$ and $R_{10}$ independently represent a hydrogen atom, or an alkyl group, alkenyl group, alkynyl group, aryl group, or aralkyl group, each of which may be substituted or unsubstituted; n is 0 or 1; m is an integer from 1 to 4; X represents —O—, —S—, or —NR'—, wherein R' represents a hydrogen atom, or an alkyl group or alkenyl group, which may be substituted or unsubstituted; and M represents a hydrogen atom, an alkali metal atom, an alkaline-earth metal atom, an ammonium group, or a group capable of cleaving under an alkali condition, wherein the sum of the carbon atoms of —$((Y)_n$—$R)_m$ is 1 or more and 30 or less.

17. The silver halide photographic emulsion according to claim 1, wherein the silver halide photographic emulsion contains at least one polymer having a repeating unit represented by the following formula (PP-IV):

Formula (PP-IV)

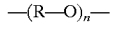

wherein R represents an alkylene group having 2 to 10 carbon atoms; and n represents the average number of the repeating units, and is from 4 to 200.

18. The silver halide photographic emulsion according to claim 17, wherein the polymer having a repeating unit represented by the formula (PP-IV) is a polymer selected from a group consisting of vinyl polymers obtained from at least one kind of monomer component of the following formula (PP-V), and polyurethane of the following formula (PP-VI):

Formula (PP-V)

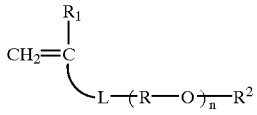

Formula (PP-VI)

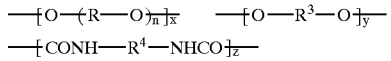

wherein R represents an alkylene group having 2 to 10 carbon atoms; n represents the average number of repeating units, and is from 4 to 200; $R^1$ represents a hydrogen atom, or a lower alkyl group; R represents a monovalent substituent; L represents a divalent linkage group; $R^3$ and $R^4$ independently represent an alkylene group having 1 to 20 carbon atoms, a phenylene group having 6 to 20 carbon atoms, or an aralkylene group having 7 to 20 carbon atoms; each of x, y and z represent a weight percentage of each component, and x is 1 to 70, y is 1 to 70, and z is 20 to 70, provided that x+y+z=100.

19. The silver halide photographic emulsion according to claim 17, wherein the polymer having a repeating unit represented by the formula (PP-IV) contains a block polymer components of polyalkyleneoxide represented by the following formulae (PP-VII) and (PP-VIII):

Formula (PP-VII)

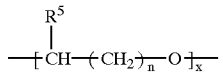

-continued

Formula (PP-VIII)

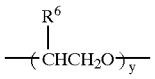

wherein $R^5$ represents a hydrogen atom, an alkyl group having 1 to 10 carbon atoms, or an aryl group having 6 to 10 carbon atoms; n represents an integer of 1 to 10, provided that when n=1, $R^5$ will not be a hydrogen atom; $R^6$ represents a hydrogen atom, or a lower alkyl group having 4 or less carbon atoms substituted by a hydrophilic group; and x and y independently represent the repeating number (number average polymerization degree) of each unit.

20. The silver halide photographic emulsion according to claim 12, wherein 70% or more of the total projected area of the grains is occupied by silver halide grains further meeting the following requirements (h) to (j) in addition to the above requirements (a) to (d):

(h) the protrusion portion contains a pseudo halide;

(i) the average silver iodide content in an outer-shell-8%-region (in relation to the silver amount of the host grain) of the host grain is (I+5) mol % or more, wherein I (mol %) is the average silver iodide content of all the grains;

(j) the aspect ratio of the host grain is 15 or more; and (k) the emulsion has a full development sensitivity that is higher than a surface development sensitivity thereof.

* * * * *